United States Patent [19]

Wendt et al.

[11] Patent Number: 4,972,059

[45] Date of Patent: Nov. 20, 1990

[54] METHOD AND APPARATUS FOR ADJUSTING THE TEMPERATURE PROFILE OF FOOD PRODUCTS DURING MICROWAVE HEATING

[75] Inventors: Dan J. Wendt, Lino Lakes; Jonathon D. Kemske, White Bear; Peter S. Pesheck, Brooklyn Center; Ronald R. Lentz, Plymount; Sheryl L. Smith, Minneapolis; Diane R. Rosenwald, Shoreview; Robert B. Shomo, Jr., Circle Pines; David H. Larkey, Champlin; Matthew W. Lorence, Bloomington, all of Minn.; John Eger, Jr., Miami, Fla.; Alvaro Santos, Miami, Fla.; Thomas R. Frigge, Miami, Fla.

[73] Assignee: The Pillsbury Company, Minneapolis, Minn.

[21] Appl. No.: 162,280

[22] Filed: Feb. 29, 1988

[51] Int. Cl.[5] ..... H05B 6/80

[52] U.S. Cl. ..... 219/10.55 E; 219/10.55 F; 219/10.55 M; 426/107; 426/234; 426/243; 99/DIG. 14

[58] Field of Search ..... 219/10.55 E, 10.55 F, 219/10.55 R, 10.55 D, 10.55 M; 426/107, 241, 242, 243, 234; 99/DIG. 14, 451; 126/391

[56] References Cited

U.S. PATENT DOCUMENTS

| | | | |
|---|---|---|---|
| 3,219,460 | 11/1965 | Brown | 219/10.55 E |
| 3,302,632 | 2/1967 | Fichtner | 219/10.55 E |
| 3,665,491 | 5/1972 | Cooper | 219/10.55 |
| 3,985,992 | 10/1976 | Goltsos | 219/10.55 |
| 4,015,085 | 3/1977 | Woods | 219/10.55 |
| 4,039,797 | 8/1977 | Olsen | 219/10.55 |
| 4,041,266 | 8/1977 | Moore | 219/10.55 |
| 4,091,119 | 5/1978 | Bach | 426/234 |
| 4,125,752 | 11/1978 | Wegener | 219/10.55 |
| 4,135,996 | 1/1979 | Fread | 219/10.55 |
| 4,144,435 | 3/1979 | Clark et al. | 219/10.55 |
| 4,144,438 | 3/1979 | Gelman et al. | 219/10.55 |
| 4,196,331 | 4/1980 | Leveckis et al. | 219/10.55 |
| 4,204,105 | 5/1980 | Leveckis et al. | 219/10.55 |
| 4,228,334 | 10/1980 | Clark et al. | 219/10.55 |
| 4,230,924 | 10/1980 | Brastad et al. | 219/10.55 E |
| 4,268,738 | 5/1981 | Flautt, Jr. | 219/10.55 |
| 4,283,427 | 8/1981 | Winters et al. | 426/107 |
| 4,316,070 | 2/1982 | Prosise et al. | 219/10.55 |
| 4,319,109 | 3/1982 | Bowles | 219/10.49 |
| 4,320,274 | 3/1982 | Dehn | 219/10.55 |
| 4,345,133 | 8/1982 | Cherney et al. | 219/10.55 E |
| 4,471,193 | 9/1984 | Walter | 219/10.55 |
| 4,518,651 | 5/1985 | Wolfe, Jr. | 428/308.8 |
| 4,580,023 | 4/1986 | Simpson | 219/10.55 |
| 4,642,434 | 2/1987 | Cox et al. | 219/10.55 |
| 4,656,325 | 4/1987 | Keefer | 219/10.55 |
| 4,659,890 | 4/1987 | Viet | 219/10.55 |
| 4,683,362 | 7/1987 | Yangas | 219/10.55 |
| 4,689,458 | 8/1987 | Levendusky et al. | 219/10.55 E |
| 4,698,472 | 10/1987 | Cox et al. | 219/10.55 |
| 4,703,149 | 10/1987 | Sugisawa et al. | 219/10.55 E |
| 4,814,568 | 3/1989 | Keefer | 219/10.55 E |

FOREIGN PATENT DOCUMENTS

| | | |
|---|---|---|
| 0000797 | 2/1979 | European Pat. Off. . |
| 0091779 | 10/1983 | European Pat. Off. . |
| 0185488 | 6/1986 | European Pat. Off. . |
| 0206811 | 12/1986 | European Pat. Off. . |
| 1593523 | 7/1981 | United Kingdom . |

*Primary Examiner*—Philip H. Leung
*Attorney, Agent, or Firm*—Arnold, White & Durkee

[57] ABSTRACT

A method and apparatus is disclosed for a system for heating food products in a variety of microwave ovens. The invention allows the temperature profile of the food product to be set at a predetermined level. A grid is used in combination with a conductive ring. There is preferably a spacing between the grid and the surface of the food product between about 0.25 inch and about 2.4 inches, a margin between openings in the grid between about 0.6 inch and about 1.8 inches, and the openings in the grid are of a size between about 0.75 inch and about 1.75 inches. A single iris embodiment is disclosed. The single iris may be in contact with the surface of the food product or spaced therefrom. An embodiment is also disclosed wherein a grid is in contact with the food surface.

55 Claims, 26 Drawing Sheets

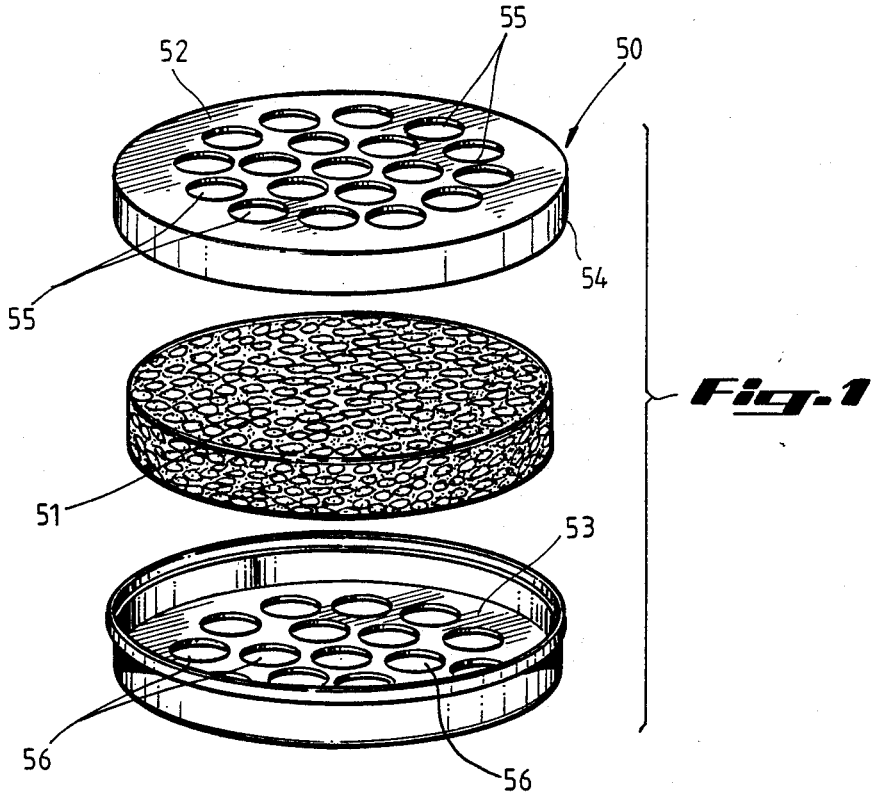
Fig. 1
Fig. 1A
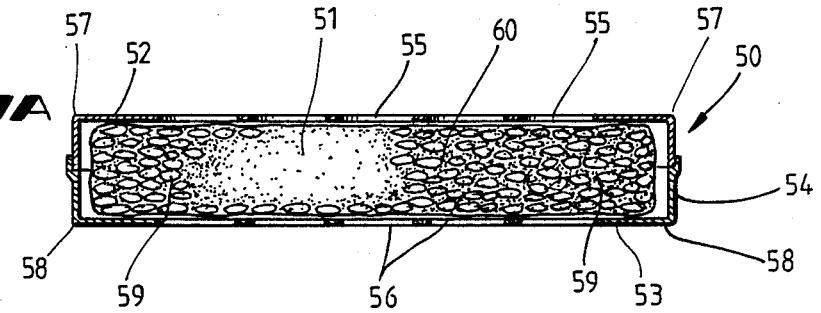
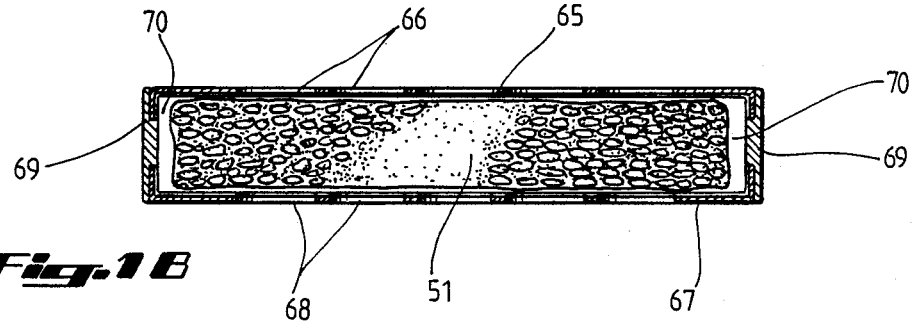
Fig. 1B

Fig. 3
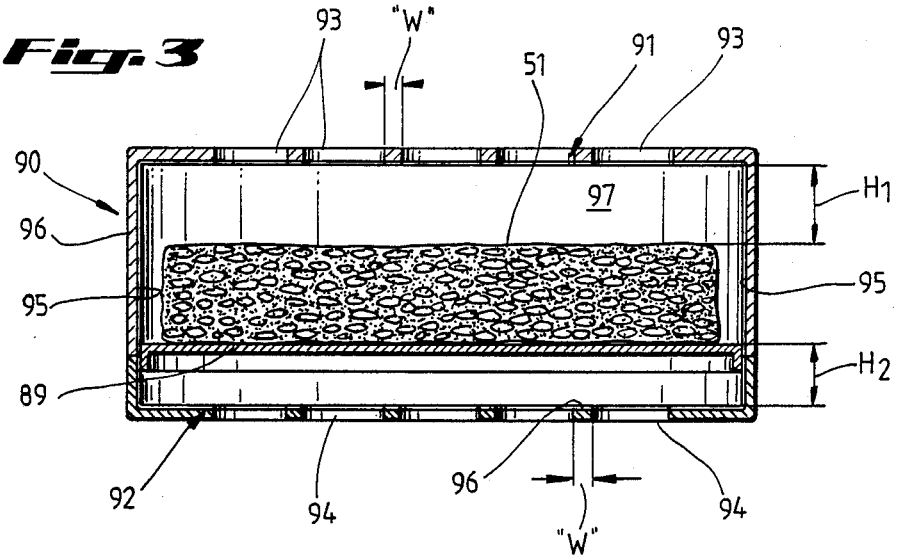
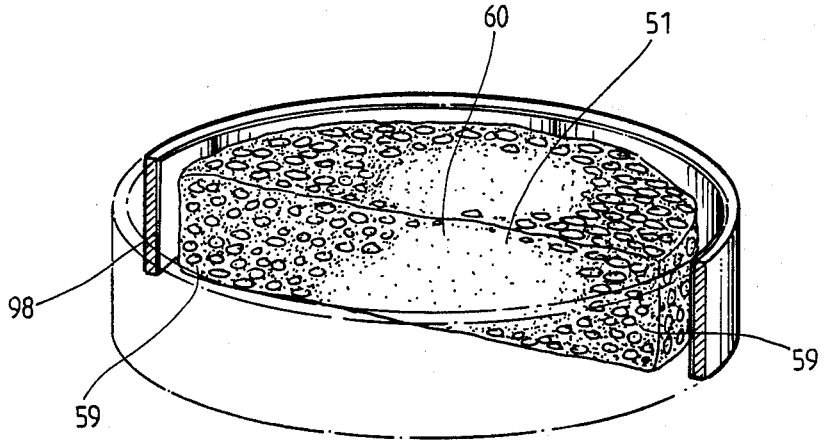
Fig. 4

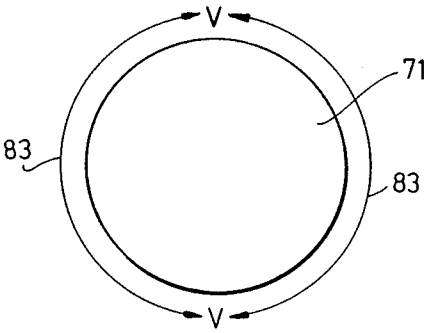
Fig. 8A
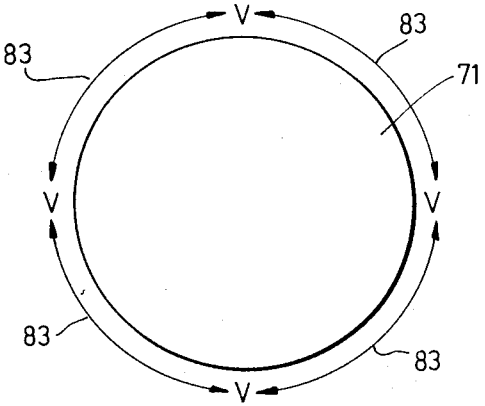
Fig. 8B
Fig. 7
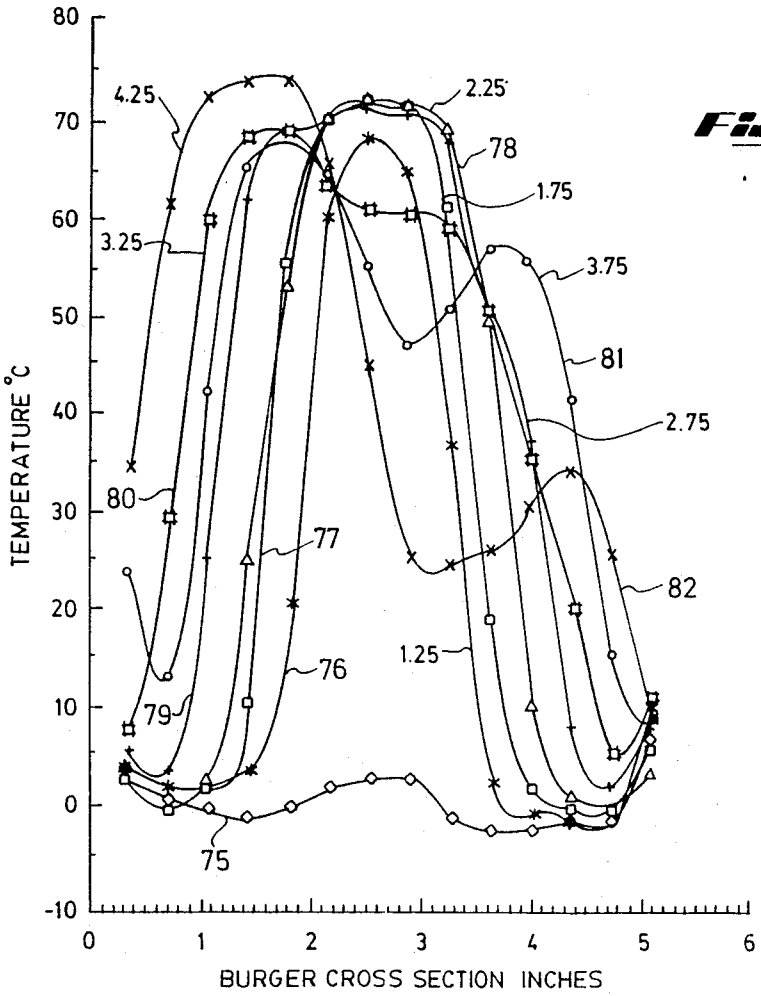

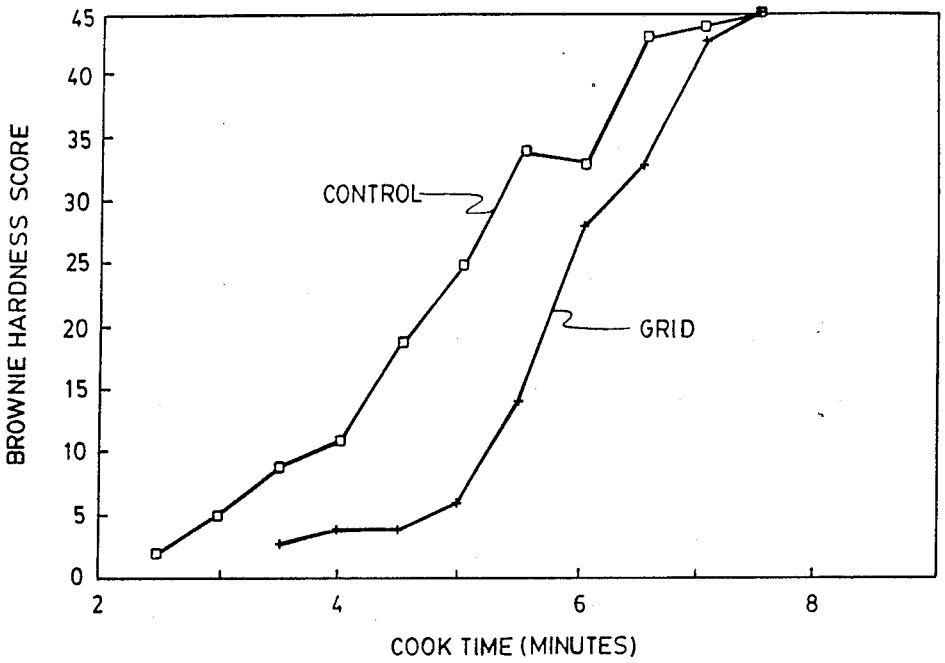
Fig. 20
Fig. 9C
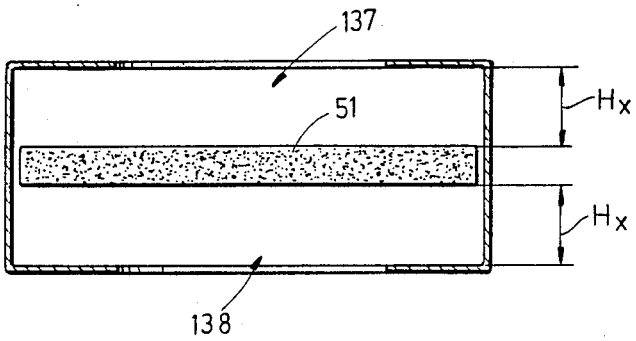
Fig. 9D
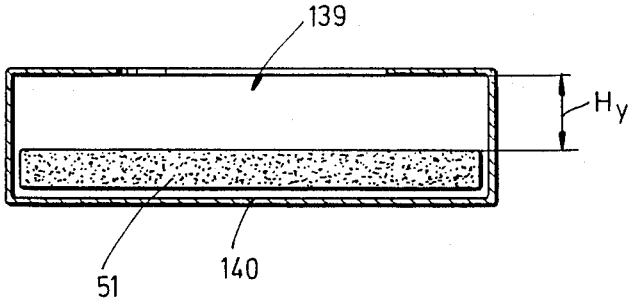

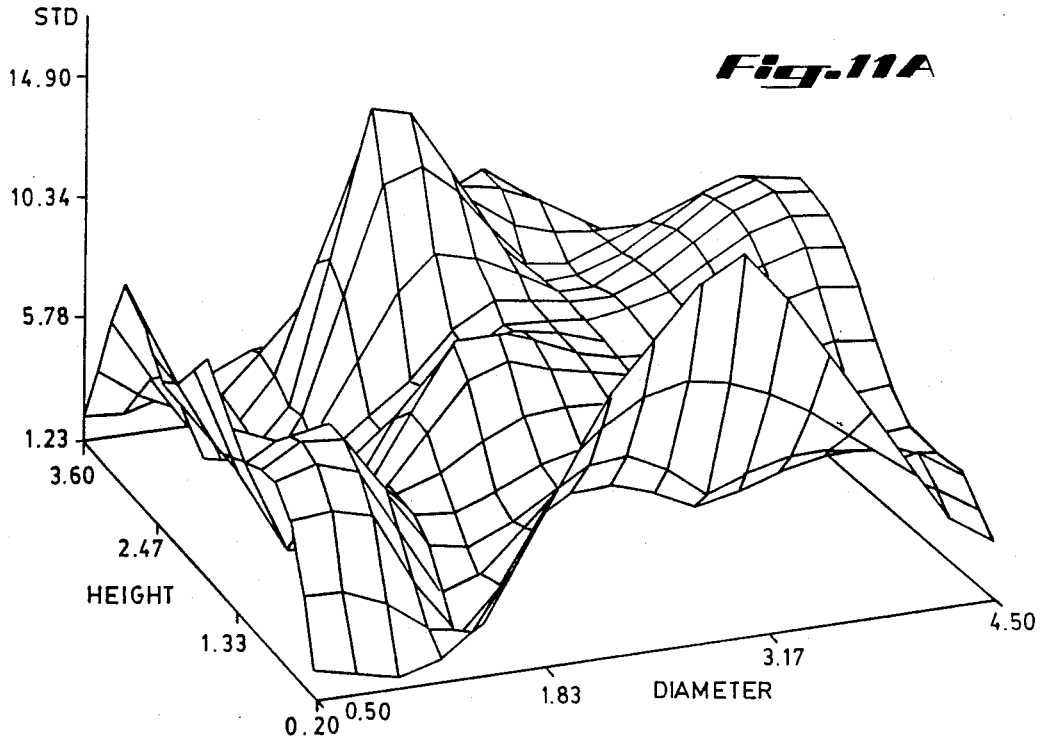
Fig. 11A
Fig. 11B
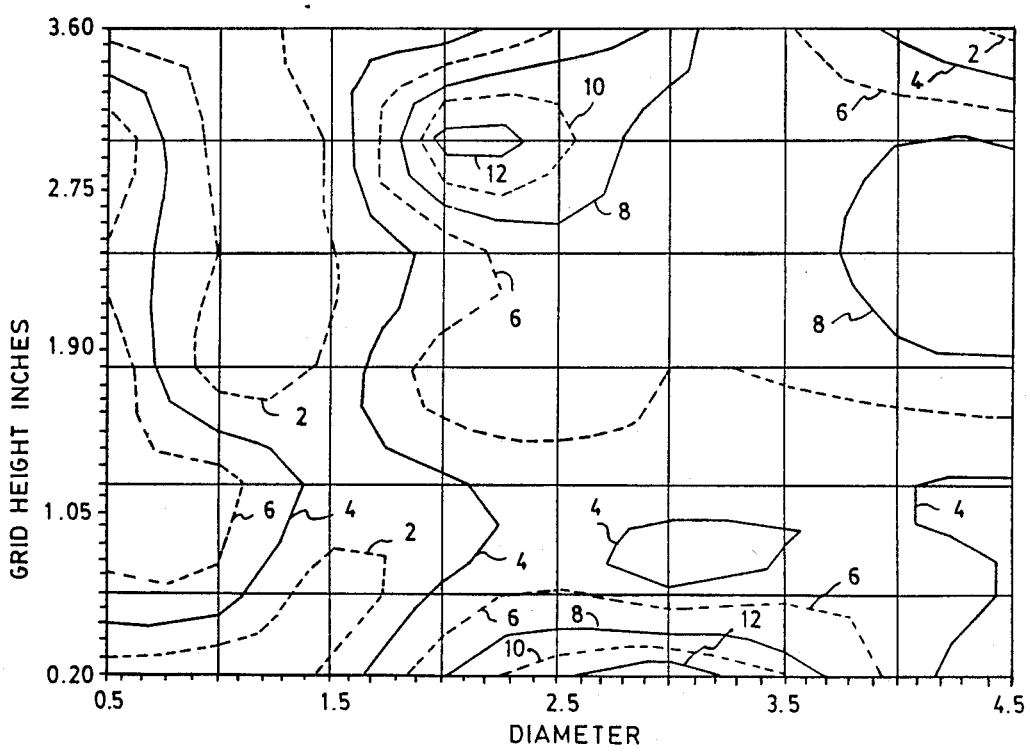

TEMPERATURE °C
BURGER CROSS SECTION INCHES
0.00
0.25
0.50
0.75
1.00
1.25
0
10
20
30
40
50
60
70
80
0
1
2
3
4
5
6

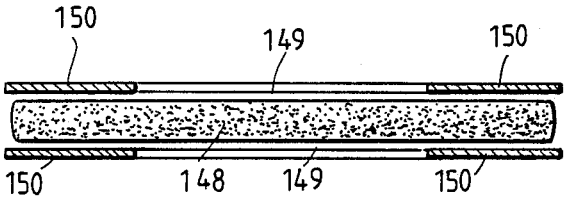
Fig. 34A
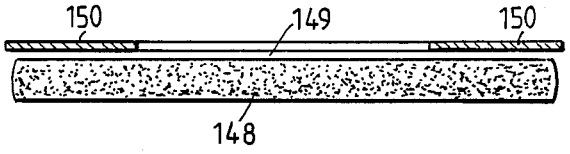
Fig. 34B
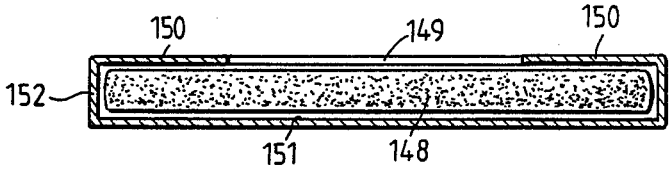
Fig. 34C
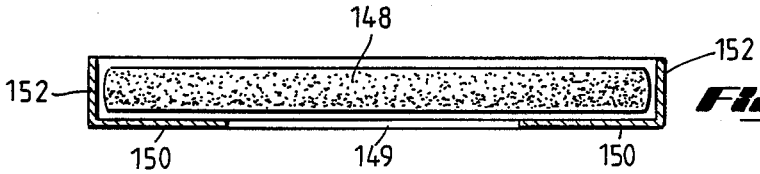
Fig. 34D
Fig. 34E
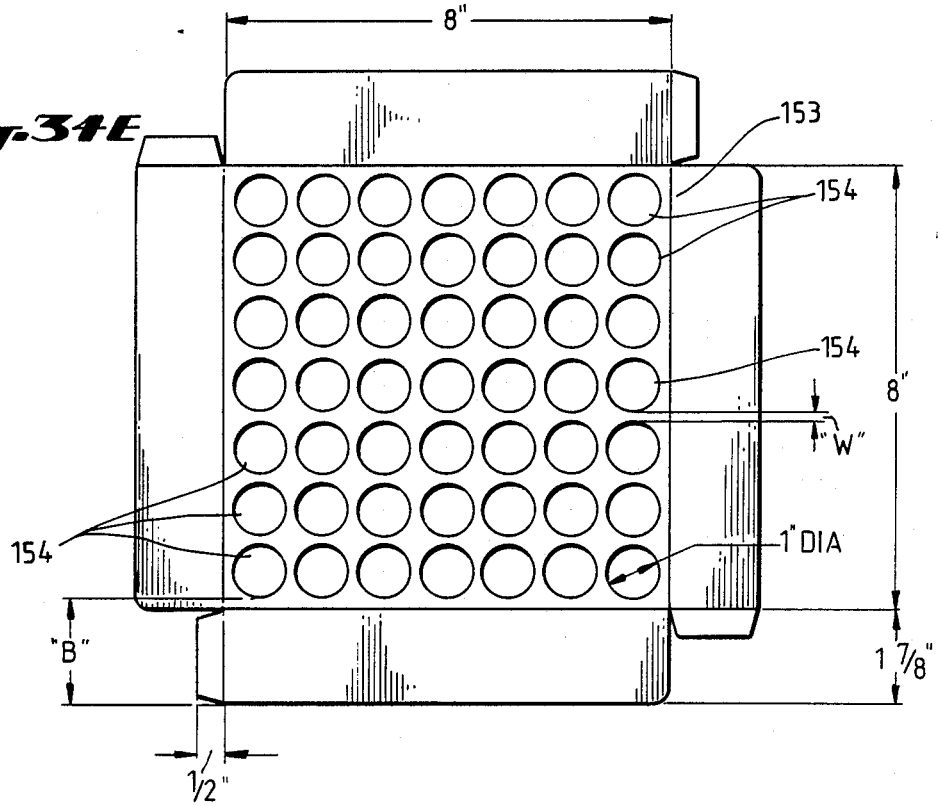

METHOD AND APPARATUS FOR ADJUSTING THE TEMPERATURE PROFILE OF FOOD PRODUCTS DURING MICROWAVE HEATING

CROSS-REFERENCE TO RELATED APPLICATIONS

This application discloses subject matter related to application Ser. No. 119,381, filed Nov. 10, 1987, entitled "Susceptor in Combination with Grid for Microwave Oven Package", by Dan J. Wendt et al., the entire disclosure of which is incorporated herein by reference.

BACKGROUND OF THE INVENTION

Microwave heating of food products has a number of disadvantages and problems which have eluded practical and satisfactory solution for many years. Food products typically heat differently in a microwave oven, than would be the case if the same food product were placed in a conventional oven or grill, etc. In many cases where a food product has been cooked in a microwave oven, the result was an inferior tasting food product as compared to that which can be produced by conventional cooking means.

In the past, significant problems have been encountered involving the nonuniform heating of food in a microwave oven. When certain foods are cooked in a microwave oven, it is not uncommon to have areas which are overcooked. Such overcooking can result in undesirable attributes such as hardness, toughness, discoloration, off taste, as well as other undesirable attributes. Nonuniform heating of food sometimes results in raw spots in the food product. In some instances, some areas of a food product may be overcooked, while other areas of the same food product remain undercooked or raw. Thus, extreme examples of nonuniform heating exist where a food product may have both overcooked areas and undercooked areas in the same food product.

A basic challenge in consumer microwave design is to ensure a uniform field strength within the oven. Manufacturers have used different cavity designs, methods of feeding the microwave cavity, mode stirrers and product turntables in attempts to provide more uniform heating of food. If an oven design could be optimized to a single food product, in a controlled geometry, good uniformity results might be obtained. Instead, consumer microwave ovens are used on a multitude of food products, some of which will have good uniformity results in an oven and some which will have local hot and cold spots.

Designing a product for microwave preparation is difficult because of the range of oven designs that are in use. A product that works well in one microwave oven may not work well in another. Microwave brownies are particularly sensitive to overheating in microwave hot spots. The dehydration that results from a hot spot creates a hard texture after the brownies are cool. In particularly nonuniform ovens, raw spots and overcooked spots may exist in the same pan of brownies.

In the past, significant problems have been encountered with food products whose dielectric properties change significantly during microwave heating. It has been discovered that the amount of microwave energy which is absorbed by a food product during heating is related to the dielectric properties of the food product. More specifically, the relative dielectric loss factor (E″) will significantly affect the extent to which microwave energy is absorbed by the food product. Some foods, when heated in a microwave oven, will undergo dramatic changes in the dielectric properties of the food, and specifically the relative dielectric loss factor. For example, in frozen meat the relative dielectric loss factor E″ may initially be 0.34 when the meat is frozen at −24° C., and change during microwave heating to a value over 10 at 50° C.

During exposure to microwave radiation, a large piece of frozen meat may have one or more localized spots which thaw first. When these spots thaw, the dielectric properties of that portion of the meat change dramatically so that those spots then begin to absorb disproportionately large share of the microwave energy. The areas of the meat which are still frozen continue to absorb significantly less microwave radiation because the dielectric properties of the frozen areas of the meat have not changed significantly. This can result in a phenomenon which may be referred to as "thermal runaway." In this phenomenon, the significant change in dielectric properties which result as the food is heated by microwave radiation, such as when frozen meat is thawed, may result in spots which become very hot and/or cooked, separated by only a few centimeters from spots which are still frozen solid. Some mechanism has long been needed for dealing with significant changes in dielectric properties, which result in consequent differences in absorption of microwave radiation, during microwave heating.

In the past, many foods cooked in a microwave oven have had a problem with the criticality of the heating time. Microwave heating tends to heat foods more rapidly than may be the case with conventional cooking. The difference between an undercooked food product, and an overcooked food product, may be only a few seconds of heating time. Although most microwave ovens have timing mechanisms for precisely setting the microwave heating time, the criticality of heating time causes significant problems when efforts are made to mass produce food products for use in a large variety of microwave ovens. Microwave ovens commonly available to consumers vary significantly in cooking characteristics. Differences in power, oven cavity dimensions, stirrers, standing wave patterns, etc. from one microwave oven model to another result in significant differences in microwave heating characteristics among various microwave ovens. Food products which are mass produced for consumption by consumers having different models of microwave ovens need a reasonable margin for error in microwave heating time required to produce a satisfactorily cooked food product. Thus, with many foods the need has existed to reduce the criticality of heating time for a food product intended to be heated in a microwave oven. In other words, the "window" of time between the point in time where the food product is undercooked, and the point in time when the food product is overcooked, needs to be as large as possible without compromising the other advantages of microwave heating, such as unduly lengthening overall cook time.

The differences in various models of microwave ovens used by consumers makes it difficult to mass produce a food product for general consumption. The same food product will cook differently in different models of microwave ovens, and even in different examples of the same model oven. A need has long existed for some means to handle differences in microwave ovens so that a food product may be cooked in a variety of models of microwave ovens without significantly varying the cooking parameters.

Many commercial fast food establishments have equipment for the conventional cooking of hamburgers which has been optimized for hamburger patties of a particular size and mass. For example, a moving belt conveys hamburger patties through a flame broiler. The length of travel through the flame broiler, the temperature, and time of exposure have all been adjusted so that when the hamburger patties emerge at the end of the moving belt, hamburger patties of a standard size and weight are properly cooked. One difficulty with such an arrangement is that once it has been optimized for a particular size hamburger patty, it cannot be practically used alone to cook significantly larger hamburger patties. Such a mechanism may be difficult to adjust, and once it is properly set up to correctly cook hamburger patties of a standard size, it cannot conveniently be changed to cook hamburger patties which are significantly larger or smaller. It is desirable in commercial fast food establishments to provide a choice of larger hamburgers to consumers. Many commercial fast food establishments have attempted to meet consumer demand for larger hamburgers by offering "double hamburgers", where two standard size hamburger patties are provided in a single hamburger. Another complicating factor in such commercial fast food establishments is the need to provide food on demand. Hamburger meat must be conveniently maintained in a frozen condition. Thus, it is desirable to transform the hamburger patty from a frozen state to a properly cooked state as quickly as possible, and without advance notice of a customer order.

A need has existed to provide a means for producing a predetermined heating profile in a food product. For example, in the above example of a commercial fast food establishment having a standard infrared cooking mechanism which is optimized for a standard size food product, a need exists to provide a precooking means which can produce a predetermined heating profile in the food product, such that when the food product is subsequently heated by the standard cooking apparatus, the food product will be properly cooked. For example, a means has been needed to provide a heating profile for a larger hamburger patty which preheated the hamburger patty in a manner where the temperature distribution throughout the meat, prior to introducing the meat onto the standard moving belt for flame broiling hamburger patties, was set so that the large hamburger patty would be properly cooked when it emerged from the conventional cooking apparatus. The flexibility which would be provided by an invention which gave the ability to design a particular heating profile in a food product, using microwave technology, would open up remarkable opportunities for improving the quality of microwave cooking. It would also open up significant opportunities for combination heating utilizing microwave technology in combination with conventional heating to produce highly satisfactory and pleasant tasting food products. Also, significant reductions in total cook time could be achieved.

SUMMARY OF THE INVENTION

The present invention provides a method and apparatus for adjusting the temperature profile of a food product during exposure to microwave radiation. In a particularly advantageous application of the present invention, the temperature profile may be adjusted for uniformity. Thus, the present invention may include a means for providing a substantially uniform heating profile for a food product in a microwave oven.

The means for adjusting the temperature profile of the food product during microwave heating includes a conductive sheet containing one or more tuned apertures or perforations whose size and geometry may be adjusted in accordance with the teachings of this invention to provide a predetermined or desired temperature profile for the food product. The conductive sheet may take the form of a grid, particularly where uniformly heated food is desired.

Conductive side walls defining a conductive ring may be used in combination with a grid, particularly where it is desirable to alter an electric field boundary condition with the result of a reduction in edge heating of a food product.

BRIEF DESCRIPTION OF THE DRAWINGS

FIG. 1 is an exploded perspective view of a microwave food package constructed in accordance with the present invention.

FIG. 1A is a cross-sectional view of the package shown in FIG. 1.

FIG. 1B is a cross-sectional view of an alternative embodiment of the invention.

FIG. 3 is a cross-sectional view of an alternative embodiment of the invention.

FIG. 4 is a cross-sectional perspective view of a conductive ring used in connection with a food product for microwave heating.

FIG. 7 is a graph depicting temperature heating profiles for a food product heated where a conductive sheet has various diameter openings.

FIG. 8A is a schematic representation of the current and voltage nodes surrounding a circular opening in the conductive sheet.

FIG. 8B is a similar schematic diagram showing current and voltage nodes for a larger opening in the conductive sheet.

FIG. 9C is a cross-sectional view of a food product and package having a single opening in the top of the package, and a single opening in the bottom of the package.

FIG. 9D is a cross-sectional view of a food product in a package having a single opening in the top of the package and a reflective surface on the bottom of the package.

FIG. 11A is a contour plot depicting temperature variability in a heating profile as a function of hole diameter and grid spacing from the food product.

FIG. 11B is a two-dimensional contour plot which is similar to FIG. 10.

FIG. 20 is a graph depicting hardness scores for brownies heated in a microwave oven, comparing brownies cooked with and without a package constructed in accordance with the present invention.

FIG. 22B is a graph similar to FIG. 22A for larger size samples.

FIG. 34A is an alternative embodiment of the invention having a single aperture above and below the food product.

FIG. 34B is an alternative embodiment of the invention having a single opening on one side of the food product.

FIG. 34C is an alternative embodiment of the invention having the food product in an enclosed conductive package having a single opening.

FIG. 34D is an alternative embodiment of the invention having the food product in a pan having a single opening at the bottom of the pan.

FIG. 34E depicts a preferred embodiment of a grid which has been used in connection with brownies to provide satisfactory results in practice.

DETAILED DESCRIPTION OF A PREFERRED EMBODIMENT

Figure 1C:
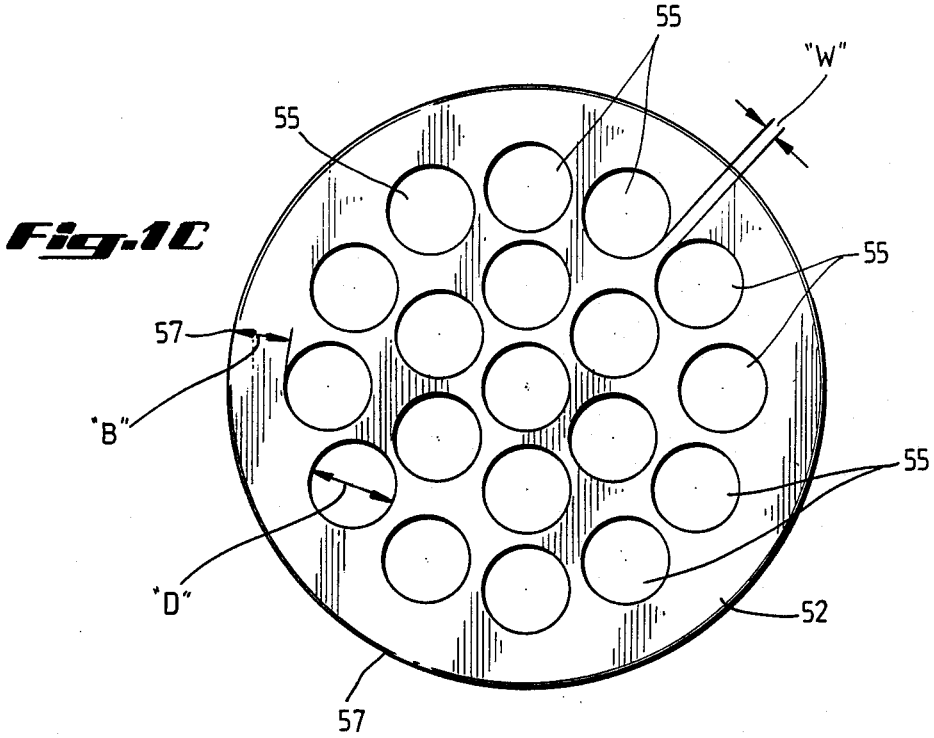
FIG. 1C is a top view of the grid shown in FIG. 1A.

The present invention may take the form of several different embodiments. One embodiment may be explained with reference to FIG. 1A.

Description Of An Illustrative Embodiment

FIG. 1A shows a food product 51 enclosed within a special apparatus 50 for microwave heating constructed in accordance with the present invention. The food heating package 50, in the illustrated example, includes the combination of a first conductive sheet 52, a second conductive sheet 53, and side walls 54 defining a conductive ring around the food product 51. An exploded view of the microwave heating apparatus 50 is shown in FIG. 1.

The first conductive sheet 52 includes tuned apertures 55 which provide openings in the conductive sheet 52. In a preferred embodiment, a plurality of apertures 55 define a grid 52. In this example, the grid 52 is in contact with the upper surface of the food product 51. A top view of the grid 52 is shown in FIG. 1C.

In this example, the food product 51 is a hamburger patty. The hamburger 51 has dielectric properties which may be represented by a relative dielectric constant E′ and a relative dielectric loss factor E″. Hereinafter, the relative dielectric constant E′ may be referred to simply as dielectric constant E′, with the understanding that such term is intended to refer to the relative dielectric constant E′. Also, reference to dielectric loss factor E″ should be understood as intending the relative dielectric loss factor E″. The size of the openings 55, and the spacing of the openings 55, are selected in order to adjust the temperature profile of the hamburger 51 during microwave heating. The first grid 52 provides a first means for adjusting the temperature profile of the food product 51.

The second conductive sheet 53 similarly defines a second grid 53 provides a second means for adjusting the temperature profile of the food product 51 having similar tuned apertures 56 therein.

In the illustrated example, the food product 51 has lateral dielectric properties which are substantially uniform. In other words, the dielectric properties of the hamburger 51 for any plane passing through the food product 51, which plane is substantially parallel to the plane of the first conductive sheet 52, will have substantially uniform dielectric properties prior to microwave heating.

In this illustrated example, the conductive side walls 51 form a conductive ring which is integrally joined with the outer edges 57 of the first conductive sheet 52. Similarly, the conductive ring 54 is also integrally joined with the outer edges 58 of the lower conductive sheet 53.

Figure 5:
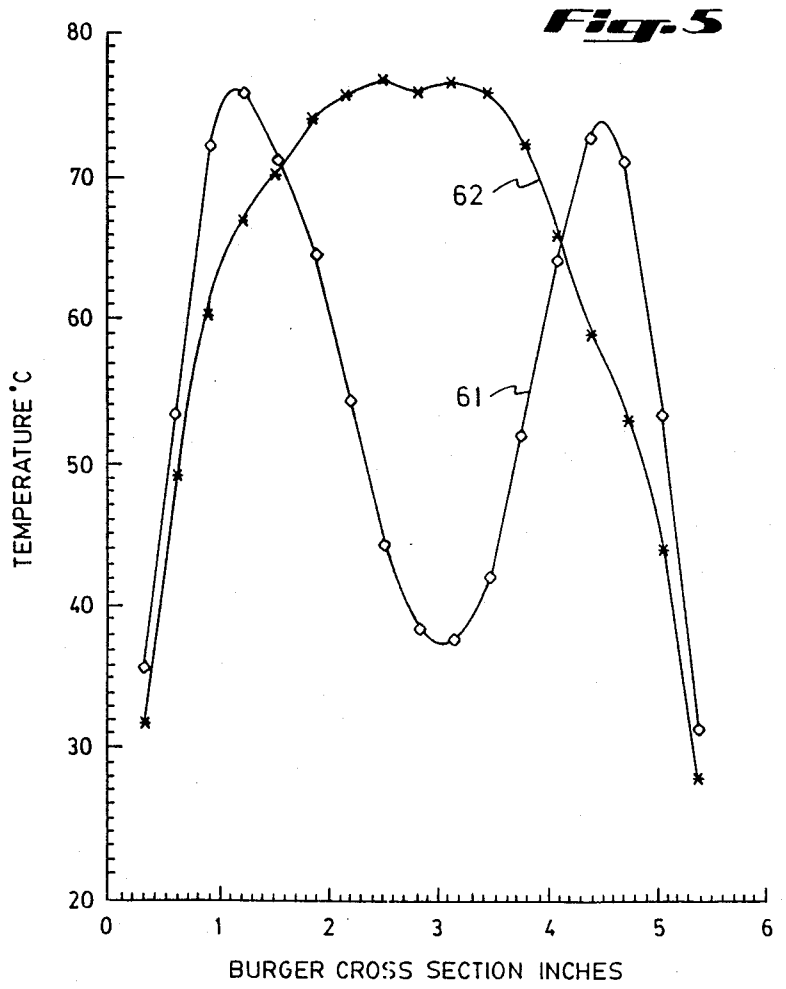
FIG. 5 is a graph depicting the temperature profile during microwave heating of a hamburger without a grid, versus a hamburger with a grid and conductive ring.

The function and operation of the package 50 may be best explained with reference to FIG. 5. FIG. 5 is a graph depicting the temperature profile during microwave heating of a hamburger patty 51 which is not enclosed in a microwave package according to the present invention, and a hamburger patty 51 which is enclosed within a grid 52 and a conductive ring or shield 54. As shown in FIG. 5, a hamburger patty 51 may exhibit significant heating at the outer edges 59 of the food product 51. At the same time, the center 60 of the hamburger patty 51 may exhibit significantly less heating during microwave irradiation. This undesirable temperature profile results in outer edges 59 which are overcooked, while the center 60 of the hamburger patty 51 may be severely undercooked or raw. This is depicted by curve 61 shown in FIG. 5.

FIG. 5 also depicts curve 62, which represents the effect of the present invention in changing the temperature profile of a hamburger food product 51. In this example, a combination of effects created by the conductive ring 54 and the grid 52 had been utilized. First, the conductive ring 54 creates an electromagnetic boundary condition. Electric fields tangential to the conductive surface of the conductive ring 54 are forced to zero at the surface of the ring 54. This effect reduces heating of the edges 59 of the hamburger 51. At the same time, the grid 52 includes tuned apertures 55 which are designed to heat uniformly across the center 60 of the hamburger patty 51. The combination of these two effects results in a temperature profile shown by curve 62 in FIG. 5 which produces more intensive heating of the center 60 of the hamburger 51 without overheating the edges 59. The temperature profile represented by curve 62 is much more desirable for this food product 51.

Figure 6:
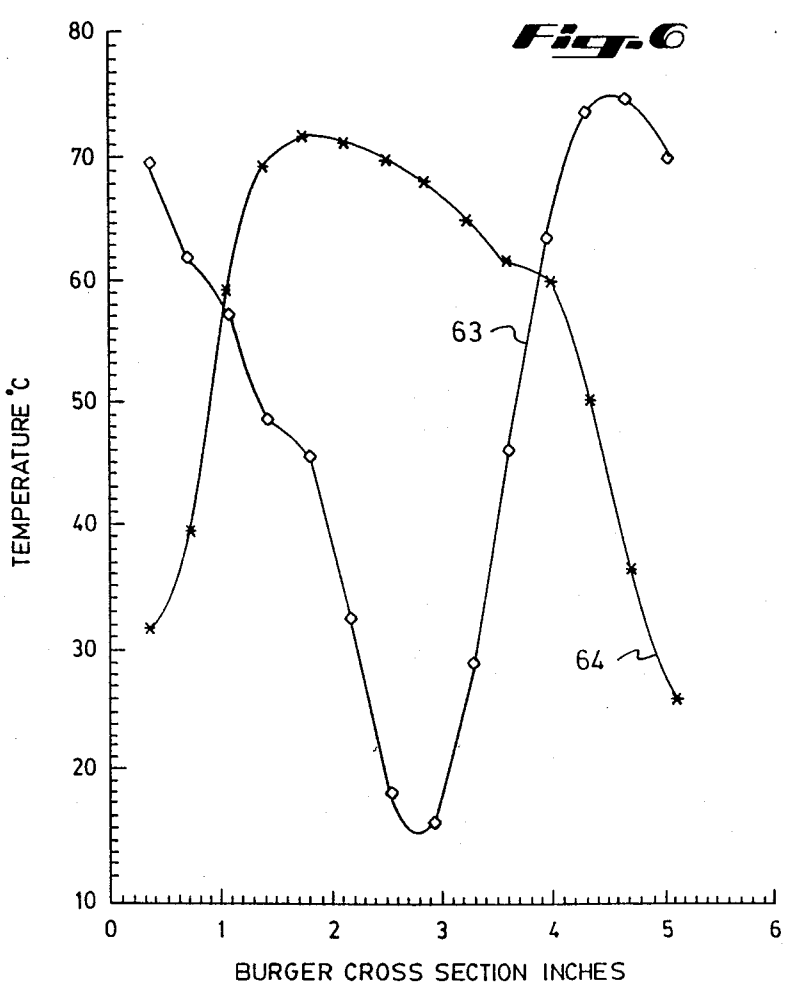
FIG. 6 is a graph depicting the temperature profile during microwave heating of a hamburger with and without a grid and conductive ring.

A tuned grid 52 in combination with a conductive ring 54 was used to produce the results of the experiment shown in FIG. 6. A different microwave oven was used to show that the improvement demonstrated in FIG. 5 could be achieved in a different oven.

Referring to FIG. 6, curve 63 shows the temperature profile for a hamburger patty heated in a microwave oven without utilizing a microwave package 50 constructed in accordance with the present invention. The edges of the hamburger patty heated significantly more than the center. The temperature profile shown by curve 63 is undesirable, and results in overcooked edges and an undercooked or raw center.

This undesirable temperature profile was adjusted by using a grid 52. In this example, the edge heating was substantially reduced, while the center heating was substantially enhanced. This is shown by curve 64 illustrated in FIG. 6. An alternative embodiment of the present invention is shown in FIG. 1B. In this example, a hamburger patty 51 is enclosed in a microwave package comprising a first tuned conductive sheet 65 including tuned apertures 66, and a second tuned conductive sheet 67 including tuned apertures 68. In this embodiment, the side walls 69 are formed from microwave transparent material, such as paper board. Thus, a microwave transparent gap 70 allows some microwave radiation to enter the sides 69 of the package to enhance edge heating of the food product 51.

Single Aperture In Contact With Food Product

Figure 1D:
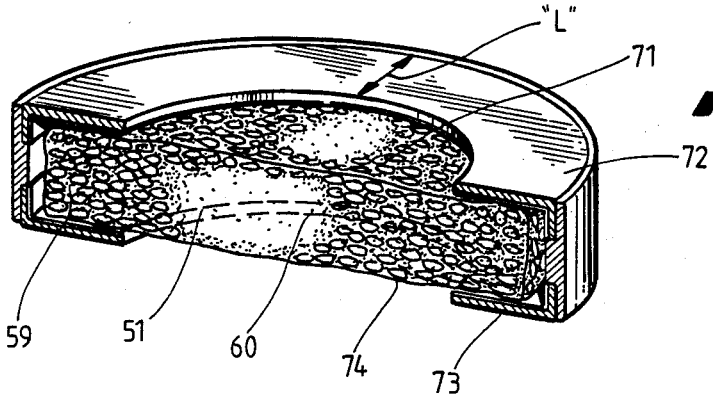
FIG. 1D is a cross-sectional perspective view of another alternative embodiment of the present invention.

The design and operation of the tuned conductive sheets may best be approached by considering the embodiment illustrated in FIG. 1D having a single tuned aperture 71 in a first conductive sheet 72. The illustrated embodiment also has a second conductive sheet 73, which includes a second tuned aperture 74.

For a conductive sheet 72 having a single opening 71 therein, it has been discovered that the most desirable region of operation occurs between a maximum and a minimum hole size. In the illustrated example, where the opening 71 is circular, this may be expressed as a region of operation between a minimum hole diameter and a maximum hole diameter. If the diameter of the hole 71 is too small, insufficient microwave energy will penetrate the conductive sheet 72 to properly heat the food product 51. However, if the opening 71 is too large, the heating profile of the food product 51 will become nonuniform, a condition which is oftentimes undesirable.

This principle may be best shown with reference to FIG. 7. In this graph, the temperature profile during microwave heating of a hamburger patty 51 was measured for conductive sheets 72 having various size openings 71. Curve 75 depicts the temperature profile where the diameter of the hole 71 was 0.75 inch. This hole size was too small, and very little heating of the food product 51 occurred. Significant heating of the center of the food product 51 occurred with a hole diameter of 1.25 inches, as shown by curve 76. Curve 77 shows that the heating of the center of the food product 51 improved with a hole diameter of 1.75 inches. A hole diameter of 2.25 inches resulted in a similar temperature profile, as shown by curve 78. A broader cross-section of the center of the food product 51 was heated when the hole size was increased to 2.75 inches, as shown by curve 79. When the hole diameter was increased to 3.25 inches, as shown by curve 80, the temperature profile of the center of the food product 51 began to drop. This effect is contrary to conventional wisdom in the art. In the case of simple shielding, conventional wisdom in the art would suggest that more heating would occur if holes were provided in the shielding and the size of the hole was increased. In the present invention, this does not necessarily occur. A hole diameter of 3.75 inches, as shown by curve 81, resulted in a dip in the temperature profile at the center of the food product 51. A hole diameter of 4.25 inches, corresponding with curve 82, exhibited an undesirably nonuniform temperature profile, as shown in FIG. 7.

The reason for this region of preferred operation is believed to be related to what may be referred to as the "mode of resonance" for a given size opening. "Mode of resonance" is intended to refer to the field distribution or the distribution of currents within the aperture 71. This may be explained with reference to FIG. 8A and FIG. 8B. In this example, where the hole diameter is approximately 1.2 inches, the opening 71 is believed to reach a "resonant" condition, influenced by the material below it. This is represented schematically in FIG. 8A by arrows 83 which represent currents induced in the conductive sheet 72. Voltage nodes occur at the top and bottom regions of the conductive sheet 72 immediately adjacent the opening 71, which are represented schematically by the symbol "V" shown in FIG. 8A.

In the example illustrated in FIG. 1D, when the diameter of the hole 71 reaches about 3.2 inches, the dimensions of the opening 71 are such that a second resonant condition may be reached. In this example, four voltage nodes, represented by the letter "V" in FIG. 8B, may be present. Currents induced in the conductive sheet 72 are represented by the arrows 83. The field inside the opening 71 becomes more complex. As a result, the temperature profile of the food substance 51 immediately adjacent the opening 71 becomes substantially less uniform. Consequently, it is desirable to operate the tuned aperture 71 in a region where the diameter falls between the dimensions which result in the condition shown in FIG. 8A, and the dimensions which result in the condition shown in FIG. 8B. In this region, the predominant mode of the electric field within the opening 71 is relatively simple, which is most conducive to the achievement of a uniform temperature profile in the food substance 51.

A determination of the dimensions for opening 71, which in this example is shown to be substantially in contact with, or immediately adjacent to, the surface of the food product 51, is dependent upon the dielectric properties of the food product 51. The dimensions used in the above discussion were based upon a food product 51 comprising hamburger meat having dielectric properties of E′ equal to about 3.4, and E″ equal to about 0.35. In this example, the meat 51 is frozen. The range of size for the opening 71 is also determined by the frequency of the microwaves which are employed in the microwave oven.

The size of the opening 71 is tuned by the following procedure. First, the dielectric properties of the food product 51 should be measured. Specifically, the dielectric constant E′ should be measured at the temperature of the food 51 for which it is desired to tune the package system. Such measurements can be performed using a network analyzer.

Second, the minimum circumference of the circular opening 71 is calculated according to the following formula:

$$C_{min} = \frac{\lambda_0}{2}\left[\frac{1}{\sqrt{E'}} + 1\right]K$$

where $\lambda_0$ is the wavelength of the microwave radiation in free space, expressed in inches, E′ is the dielectric constant which is measured for the food 51, K is a factor determined by the geometry of the opening 71 that is being tuned, and $C_{min}$ is the minimum circumference of the opening 71, expressed in inches.

For a circular opening 71, as illustrated in FIG. 1D, the K factor is equal to about 1.36. For a rectangular opening, the K factor is equal to about 0.88, and $C_{min}$ should be replaced by $L_{min}$, where $L_{min}$ is the smallest length of the rectangle, where the length is the longest dimension (as compared to the width).

The minimum circumference $C_{min}$ is believed to be the smallest size opening 71 which will allow a significant amount of microwave energy to propagate through the opening 71 to the food product 51 in the first mode of the field, illustrated schematically in FIG. 8A.

For a circular opening 71, the minimum diameter for the opening 71 may be determined by the formula:

$$D_{min} = \left[\frac{1}{\sqrt{E'}} + 1\right]\frac{2.45}{F}$$

where $D_{min}$ is the minimum diameter in inches for the opening 71, E' is the dielectric constant which is measured for the food 51, and F is the frequency of the microwave radiation in gigahertz. Where a microwave oven is used having a frequency of 2.45 GHz, the above equation simplifies to:

$$D_{min} = \left[\frac{1}{\sqrt{E'}} + 1\right]$$

The maximum circumference of a circular opening 71 may be calculated according to the following formula:

$$C_{max} = \frac{\lambda_0}{2}\left[\frac{1}{\sqrt{E'}} + 1\right]2K$$

where $\lambda_0$ is the wavelength of the microwave radiation in free space, expressed in inches, E' is the dielectric constant which is measured for the food 51, K is a factor determined by the geometry of the opening 71 that is being tuned, and $C_{max}$ is the maximum circumference of the opening 71, expressed in inches.

For a circular opening 71, as illustrated in FIG. 1D, the K factor is equal to about 1.36. The maximum circumference $C_{max}$ is believed to be the largest size opening 71 which will allow microwave energy to propagate through the opening 71 to the food product 51 only in the first mode of the field, illustrated schematically in FIG. 8A. Larger circumference openings 71 begin to allow microwave energy to propagate through the openings 71 to the food product 51 in the second mode of the field, illustrated schematically in FIG. 8B.

For a circular opening 71, the maximum diameter "D" may be determined by the following formula:

$$D_{max} = 2.15\left[\frac{1}{\sqrt{E'}} + 1\right]\frac{2.45}{F}$$

where $D_{max}$ is the maximum diameter for the circular opening 71, measured in inches, E' is the dielectric constant which is measured for the food 51, and F is the frequency of the microwave radiation in gigahertz. Where a microwave oven operating at a frequency of 2.45 GHz is used, the above equation simplifies to:

$$D_{max} = 2.15\left[\frac{1}{\sqrt{E'}} + 1\right]$$

The opening 71 should preferably have a diameter D which is greater than or equal to $D_{min}$, and which is less than or equal to $D_{max}$. In this range, the tuned aperture 71 is believed to operate in a region where the diameter falls between the dimensions which result in the condition shown in FIG. 8A, and the dimensions which result in the condition shown in FIG. 8B. This region of operation is desirable where the achievement of a uniform temperature profile in the food product 51 is desired.

The above equations are believed to be applicable generally to other shape openings 71 which are not necessarily circular. In such an example, "D" is taken to be the "size" of the opening 71. For a square opening 71, the size is considered to be the length or width. For a rectangular opening 71, the size is taken to be the length of the rectangle. For a hexagonal shaped opening 71, the size is taken to be the distance between parallel sides. For an oval shaped opening 71, the size "D" will be taken as the longest dimension of the oval. For other shape openings, the size "D" is taken as the longest dimension.

In the example of a package having a single tuned iris 71, as shown in FIG. 1D, if a uniformly heated hamburger 51 is desired, the tuned iris 71 will normally be constructed having a diameter which is slightly less than the diameter of the hamburger patty 51. If the hamburger patty 51 is made larger in diameter, the diameter of the opening 71 will be increased accordingly, until the diameter of the opening 71 reaches the value of $D_{max}$. If larger diameter hamburger patties 51 are desired, then a grid 52, as shown in FIG. 1A, would be preferred, instead of a single opening 71, as shown in FIG. 1D. There may be some instances where a temperature profile for the hamburger patty 51 having a center 60 which is heated more in relation to edges 59 is desirable. In such instances, an opening 71 having a diameter which is substantially less than the diameter of the hamburger patty 51 would be appropriate. In FIG. 1D, the conductive sheet 72 overlaps the edge 59 of the hamburger patty 51 by a distance "L" shown in FIG. 1D. The overlapped distance "L" may be referred to as the border for the opening 71.

Figure 33:
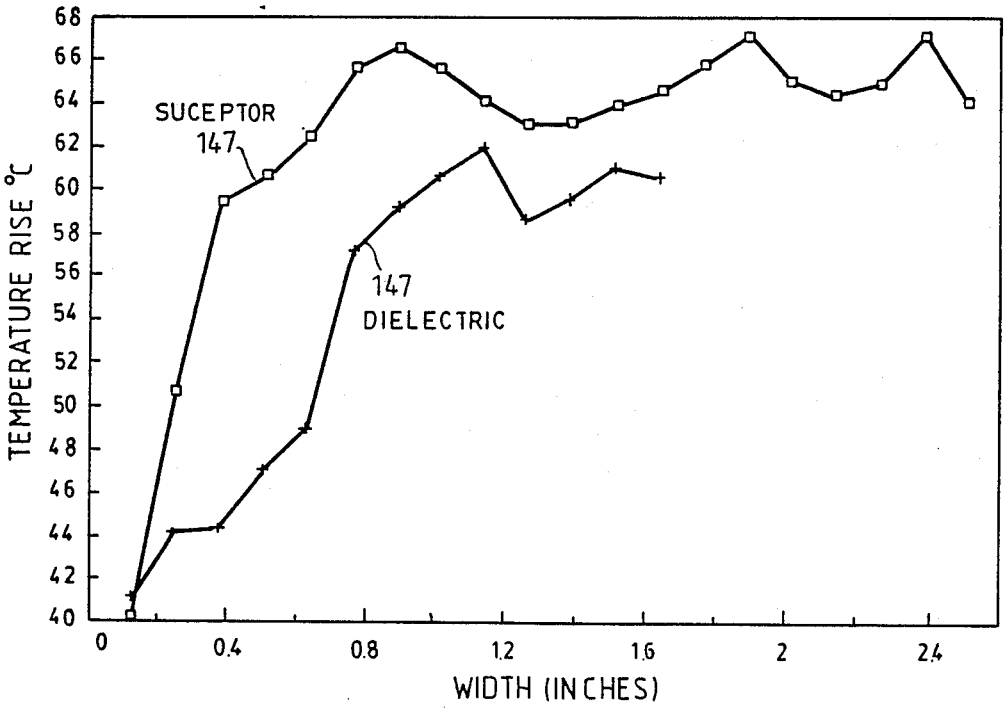
FIG. 33 is a graph depicting the effect of border width upon heating in a single rectangular opening.

The effect of the border around a single opening may be explained with reference to FIG. 33. FIG. 33 depicts experimental measurements for a single rectangular opening having various widths of border. A rectangular opening having a length of about 2 inches and a width of about ¼ inch was used in this example. Curve 146 depicts temperature measurements made for the rectangular opening in contact with a sheet of phenolic having a thickness of about ¼ inch. An infrared camera was used to measure the maximum temperature of the temperature rise in the rectangular opening. The experiment was run at low power in a variable power microwave oven. The significant information depicted in FIG. 33 is the relative difference between the temperatures which were measured.

FIG. 33 shows that, for border widths less than about ¾ inch, the amount of heating within the rectangular opening was adversely affected by the narrow border. It is believed that fringing fields around the outside edge of the border interfere with microwave energy propagating through the opening to reduce the heating effect of the microwaves upon the food product or dielectric substance.

Curve 147 shown in FIG. 33 was measured using a high resistivity susceptor next to the square opening, which was all spaced above the oven floor using a styrofoam spacer. It is believed that the rectangular opening was spaced a distance of about one-half wavelength from the reflective surface of the oven cavity.

Curve 147 depicted in FIG. 33 again shows a steady reduction in the temperature for border widths less than about ¾ inch. The reduction in heating becomes more dramatic, and curve 147 becomes steeper, for border widths less than about 0.4 inch.

For a single opening or iris 71, it is desirable to have a minimum border in order to avoid destructive interference and consequent reduction in heating. A border width of about 0.25 inch or greater is preferred. A border width of about 0.5 inch or greater is more preferred. A border width of about 0.75 inch or greater is even more preferred.

If the conductive sheet 72 is folded over and becomes part of a side wall, as shown in FIG. 1D, the length of the border is considered to include the portion of the conductive sheet which is folded over and electrically joined to the conductive sheet 72, for purposes of determining the width of the border.

For a circular opening 71 used in combination with a frozen hamburger patty 51 having a relative dielectric constant E′ of about 3.45, a preferred range for the size of the opening 71 is a diameter between about 1.5 inches and about 3.3 inches. The relative dielectric constant E′ for hamburger meat 51 which has been thawed has been measured to be about 32. For a thawed hamburger patty 51 having a relative dielectric constant E′ of about 32, the preferred size for the opening 71 would be within a range of diameters between about 1.2 inches and about 2.5 inches. The microwave package illustrated in FIG. 1D can be tuned and constructed to accommodate the transition in relative dielectric constant E′ which occurs in a food product 51 such as hamburger as it is heated from a frozen condition to a thawed condition. If the opening 71 is constructed to have a diameter between about 1.5 inches and about 2.5 inches, the opening 71 will continue to provide a uniform temperature profile as the hamburger meat 51 thaws and makes a transition in relative dielectric constant E′ from 3.45 to about 32. FIG. 7 shows that reasonable results and uniform temperature profile were achieved for an aperture 71 having a diameter between about 1.25 inches and about 3.25 inches.

Single Aperture Spaced From Food Product

Figure 9B:
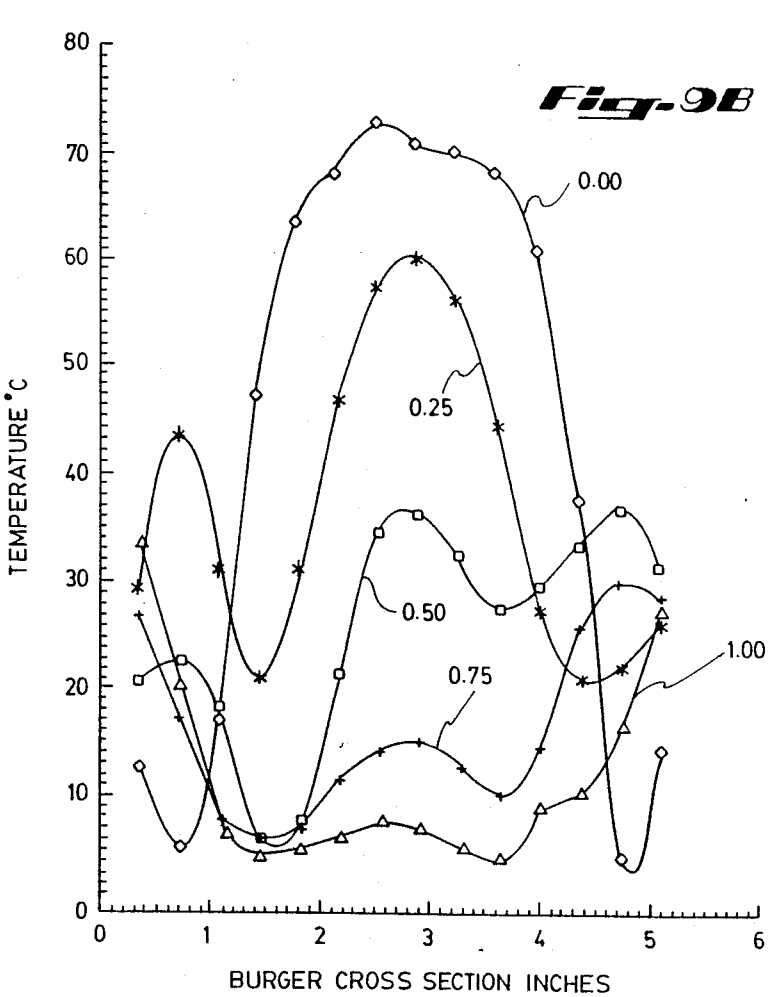
FIG. 9B is a graph showing the temperature profile for various spacings between the food product and an opening in a conductive sheet where a reflective surface is provided on the opposite side of the food product.

Referring to FIG. 9C, an opening or iris 137 may be spaced a distance "$H_X$" from the surface of the food product 51. In the illustrated example, a second iris or opening 138 is positioned below the food product 51 and spaced an equal distance "$H_X$" from the lower surface of the food product 51.

Figure 9A:
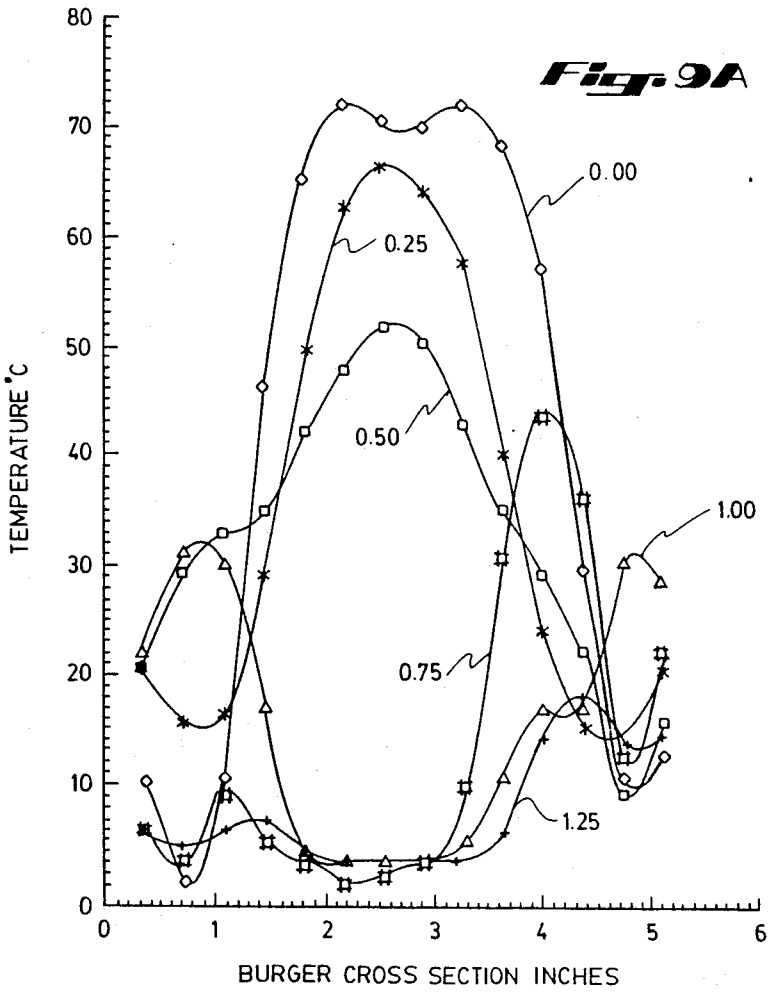
FIG. 9A is a graph depicting the variation in spacing between the food product and an opening in the conductive sheet.

The effect of spacing "$H_X$" upon temperature profile is shown by FIG. 9A. In this example, the temperature profile is graphically represented for several height "$H_X$" spacings. The spacing "$H_X$" between the opening 137 and the top surface of the food product 51 is identified as "height" in the graph. Spacings "$H_X$" between the food product 51 and both the top iris 137 and bottom iris 138 were equal in this example. For this particular example, the temperature performance of the package significantly deteriorated for spacings "$H_X$" of 0.75 inch and greater.

The measurements which are represented graphically in FIG. 9A were taken using an infrared camera. The upper iris 137 and the lower iris 138 each had a diameter of about 2.75 inches. The spacing "$H_X$" of the openings 137 and 138 from the food product 51, identified as "iris height" in FIG. 9A was varied from 0 to about 1.25 inches. Each curve in FIG. 9A represents a measured temperature profile for a cross-section laterally across the surface of the food product 51 for a particular spacing "$H_X$".

An experiment was also performed using a single iris 139 in combination with a package constructed in accordance with FIG. 9D. The single iris 139 was spaced from the surface of the food product 51 by a distance "$H_Y$". The package included a lower reflective surface 140 constructed of aluminum foil which was in contact with the lower surface of the food product 51.

Using an iris diameter of about 2.75 inches, temperature profiles were measured for various hamburger patties 51 heated in a microwave oven, using various iris spacings "$H_Y$". The results are depicted graphically in FIG. 9B. The temperature profile deteriorated significantly for iris heights "$H_Y$" of 0.5 inch or greater. Where a single opening or iris is used in accordance with the present invention, a spacing between the iris and the surface of the food product of 0.5 inch or less is preferred. A spacing between the iris and the food product of 0.25 inch or less is more preferred. Best results were obtained with a single opening in direct contact with the surface of the food product.

The diameter of the iris 137 is preferably between about 2.0 inches and about 4.3 inches. A more preferred size for the iris 137 is a diameter between about 2.5 inches to about 3.8 inches. The diameter of the iris 137 may be as small as 1.5 inches. As the diameter of the iris 137 is made smaller than about 2 inches, the amount of microwave energy which is allowed to pass through the iris 137 is believed to be reduced. If slower heating rates can be tolerated in a particular application, iris diameter less than about 2 inches may be used. Thus, in some applications, an iris 137 having a diameter between about 1.5 inches and about 4.3 inches may give useful results.

Figure 14A:
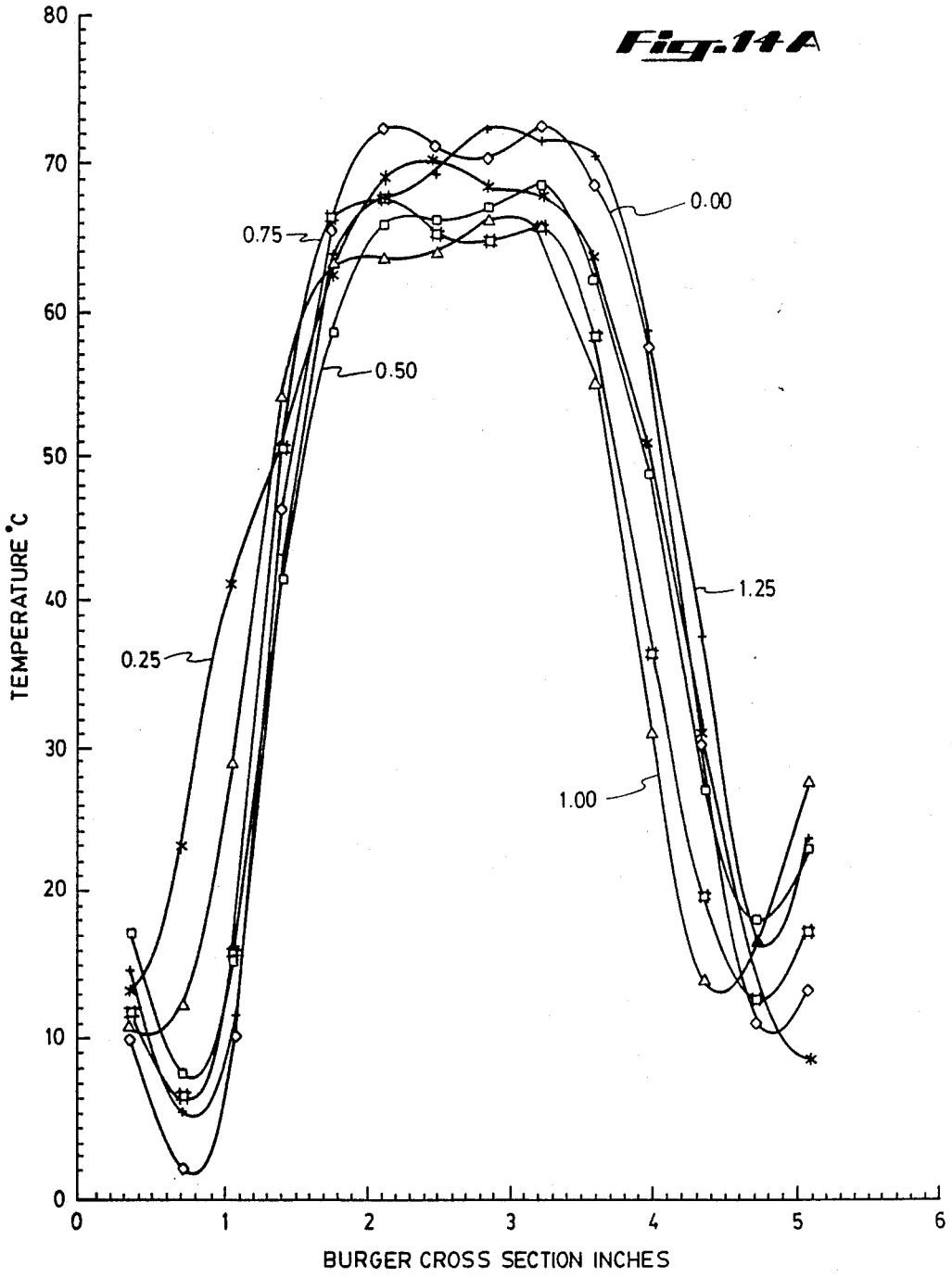
FIG. 14A is a graph depicting temperature profiles where a single opening is in contact with the food product and a second single opening is spaced various distances from the food product.

In the example described above with reference to FIG. 9C, both openings 137 and 138 were spaced from the food product 51 by a distance $H_X$. In an example illustrated in FIG. 14C, where one opening 141 is in contact with the surface of the food product 51, and the other opening 142 is spaced a distance "$H_A$" from the surface of the food product 51, the temperature profile was dominated by the opening 141 which was in contact with the food surface. This dominance is shown by FIG. 14A. In this figure, the temperature profile for a hamburger patty 51 is shown where one opening 141 was in contact with the surface of the hamburger patty 51, and a second opening 142 was spaced a distance "$H_A$" from the surface of the hamburger patty 51. This distance "$H_A$" is referred to as "height" in FIG. 14A. The "height" or spacing "$H_A$" of the opening 142 from the food product 51 had very little effect upon the temperature profile for this food product. Thus, in this example, the microwave package may be treated as though it were a contact iris example, such as is shown in FIG. 1D.

Figure 14B:
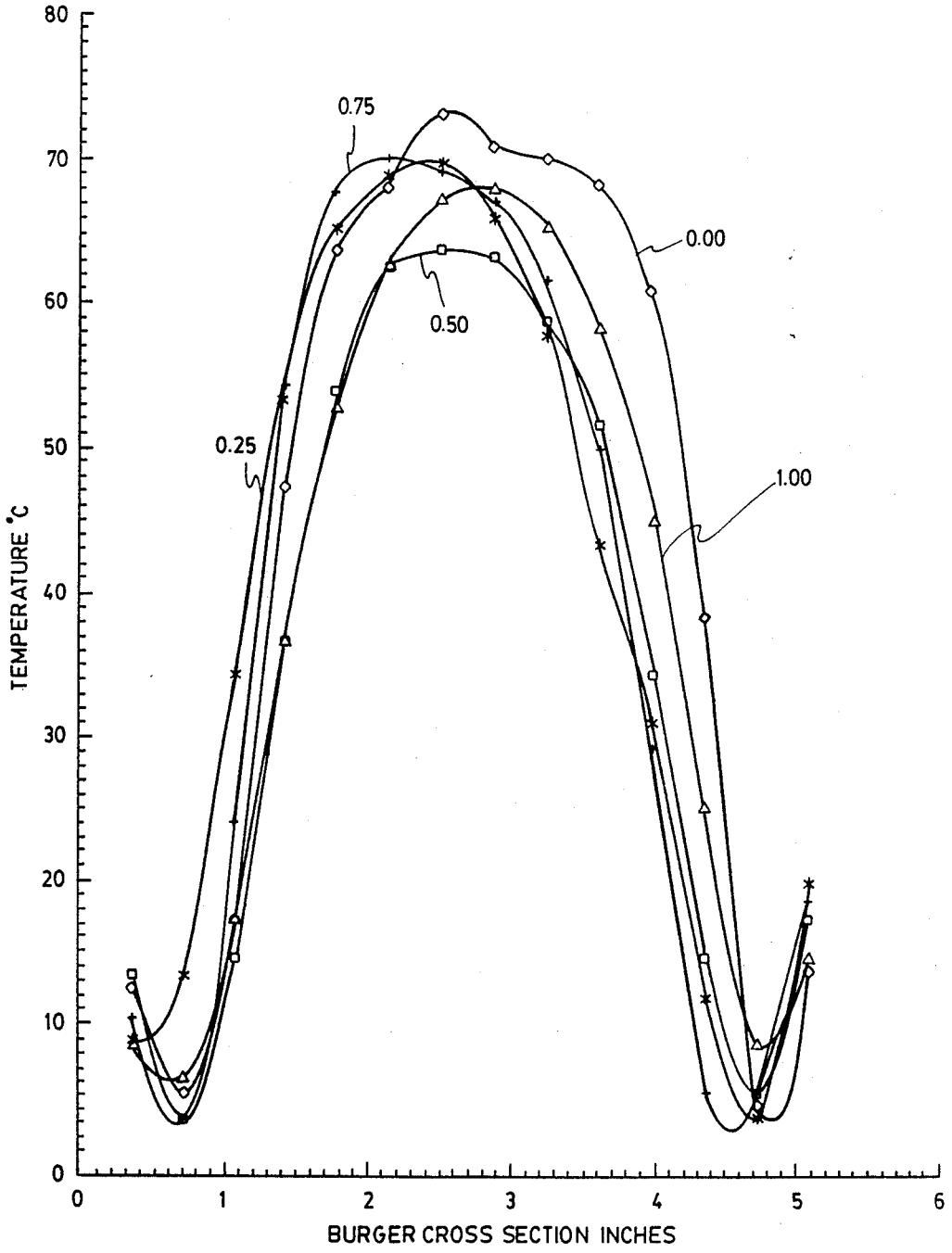
FIG. 14B is a graph showing temperature profiles where a single opening is in contact with the food product and a reflector is spaced various distances from the food product.
Figure 14C:
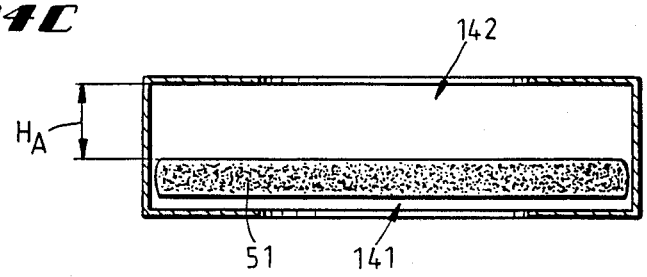
FIG. 14C is a cross-sectional drawing depicting a package having two openings therein, where one is in contact with the food product and the other is spaced various distances from the food product.
Figure 14D:
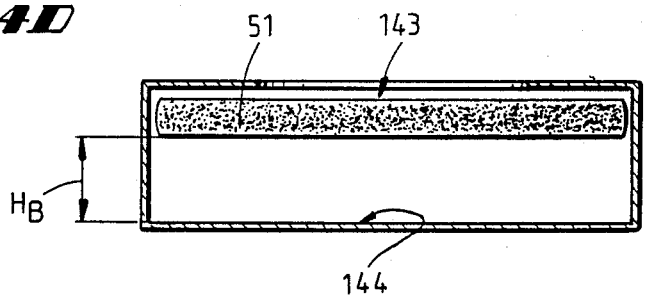
FIG. 14D is a cross-sectional cutaway view of a package having a single opening which is in contact with the food product and a reflective surface which is spaced various distances from the food product.

FIG. 14D illustrates an example where an opening 143 is in contact with the surface of the food product 51.

A reflective surface 144 is spaced a distance "$H_B$" from the lower surface of the food product 51. Where an opening 143 is in contact with the food product 51, the temperature performance of the system is dominated by such opening 143, and the spacing "$H_B$" of a reflective surface 144 from an opposing surface of the food product 51 has minimal effect upon the temperature profile. This is shown by the graph of FIG. 14B.

The temperature profile for a hamburger patty 51 was measured using an infrared camera. The opening 143 had a diameter of about 2.75 inches. The reflector surface 144 was spaced a distance "$H_B$" from the surface of the hamburger patty 51 which varied between 0 inch to 1.0 inch. The distance of the spacing "$H_B$" had minimal impact upon the temperature profile, as shown in FIG. 14B.

A minimum border should be provided around the single opening or iris in order to avoid destructive interference and consequent reduction in heating. The border is formed from a surface of conductive material, which is preferably generally opaque to microwave radiation. A border width of 0.25 inch or greater is preferred. A border width of 0.5 inch or greater is more preferred. A border width of 0.75 inch or greater is even more preferred.

Grid In Contact With Food Product

In addition to a single opening 71 in a conductive sheet 72, as shown in FIG. 1D, a grid 52 or 65 may be used in contact with the food product 51, as shown in FIGS. 1A and 1B. The design of a grid 52 in contact or immediately adjacent to a food product 51 uses a similar approach to that described above.

The preferred size of the openings 55 in the grid 52 is related to the change in wavelength that is believed to occur by virtue of the effect of the dielectric properties of the food product 51. The dielectric constant E′ may be measured for the food product 51. The wavelength of microwaves at the interface with the surface of the food product 51 and the grid 52 is related according to the following formula:

$$\frac{\lambda_0}{2}\left[\frac{1}{\sqrt{E'}}+1\right]=\lambda_E$$

where $\lambda_0$ is the wavelength of the microwaves in free space, expressed in inches, E′ is the dielectric constant of the food substance 51, and $\lambda_E$ is the effective wavelength of the microwaves at the interface where the grid 52 is located, expressed in inches. The effective wavelength $\lambda_E$ is then multiplied by a K factor which is dependent upon the geometry of the grid. The K factor for a grid with circular openings 55 is 1.36. The product of $\lambda_E$ times K is used to determine the operative circumference for a particular desired mode of field distribution.

For a grid 52 in contact with the surface of a food product 51, a preferred range for the size of the openings 55 in the grid 52 is between about 1.75 inches to about 0.75 inch, as adjusted to account for the dielectric properties of the food in accordance with the formula below. A more preferred range is between about 1.5 inches and about 1 inch, as adjusted. An especially preferred value is about 1.25 inches, as adjusted below. These preferred sizes for the openings 55 are substituted for the variable "D" in the following equation when the grid 52 is in contact with the food product 51, in order to provide an adjusted hole size "$D_C$":

$$D_C=\frac{D}{2}\left[\frac{1}{\sqrt{E'}}+1\right]\frac{2.45}{F}$$

where D is the hole size expressed above which is desired to be adjusted to account for the dielectric properties of the food, E′ is the relative dielectric constant of the food 51, F is the frequency of the microwave radiation in GHz, and $D_C$ is the size of the hole, as adjusted, expressed in inches. In the case of a circular hole, D is the diameter of the hole Where a microwave oven having a frequency F of 2.45 GHz is used, the above equation simplifies to:

$$D_C=\frac{D}{2}\left[\frac{1}{\sqrt{E'}}+1\right]$$

As stated above, a preferred range for the variable "D" in this equation is between about 1.75 inches to about 0.75 inch. A more preferred range for the variable "D" is from about 1.5 inches to about 1 inch. An especially preferred value for the variable "D" for the openings 55 is about 1.25 inches. As explained above, these ranges are adjusted in accordance with the relative dielectric loss factor E′ of the food product 51, to determine the size $D_C$ of the openings 55 in the grid 52. For example, for a food product having a relative dielectric constant E′ of 3.45, the range for D of about 1.75 inches to 0.75 inch adjusts to a range for the size $D_C$ for the holes from about 1.35 inches to about 0.58 inch. Similarly, for a food product 51 having a relative dielectric constant E′ of 3.45, a more preferred range for the adjusted size of the openings 55 would be from about 1.15 inches to about 0.77 inch, which may be rounded to 0.8 inch. (That is, the range 1.5 inches to 1 inch, when adjusted for an E′ equal to 3.45, becomes 1.15 inches to 0.77 inch.) An especially preferred size for the openings 55, for a food product whose relative dielectric constant E′ is 3.45, would be about 0.96 inch, which may be rounded to 1 inch.

Where the grid 52 has circular openings 55 in it, the size "$D_C$" would be the diameter of the openings 55. For a square opening in a grid, the size "$D_C$" would be the length of the square. For a rectangular size opening in a grid, the size "$D_C$" would be the length of the rectangle. For a hexagonal shaped opening in a grid, the size "$D_C$" would be the distance between parallel sides of the hexagon.

In the case of a grid 52, mutual lateral coupling between adjacent apertures 55 assists in producing a uniform temperature profile laterally across the food product 51. In other words, the temperature profile along a plane passing through the food product 51, and which is parallel to the plane of the conductive surface 52, will be made more uniform, or may otherwise be adjusted as desired.

In the example of a grid 52 in contact with a food product 51, the width "W" of the conductive sheet 52 between openings 55, i.e., the margin, should be made small to enhance mutual lateral coupling.

Figure 10B:
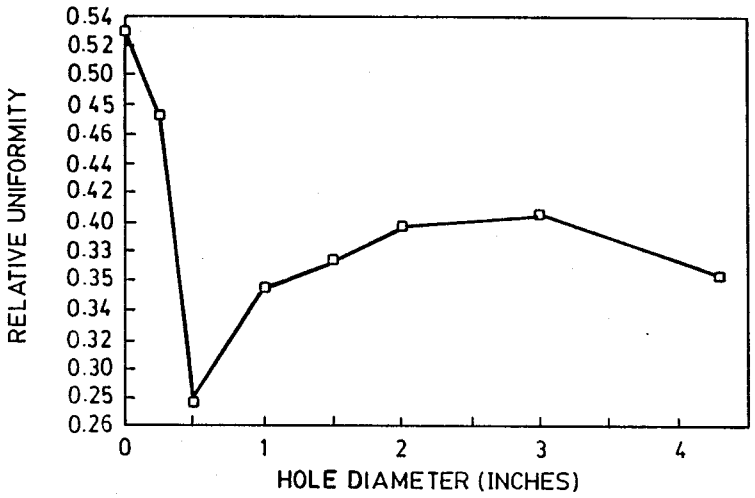
FIG. 10B is a graph depicting relative uniformity of heating as a function of hole diameter for a grid in contact with a dielectric substance.
Figure 10C:
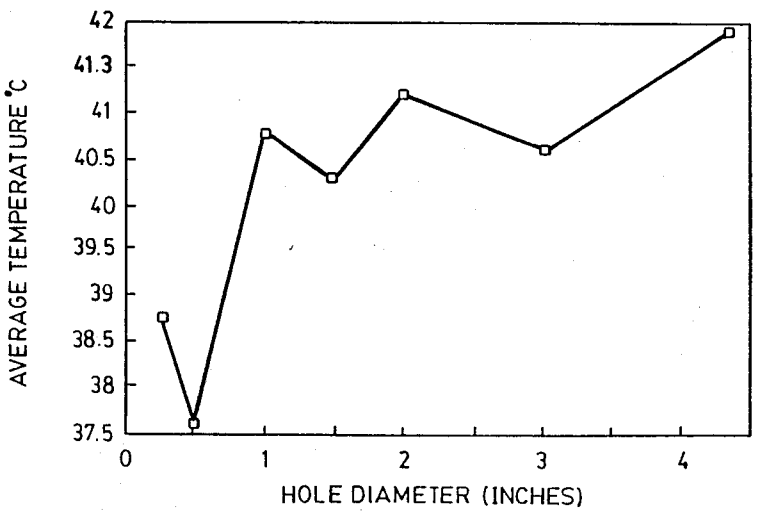
FIG. 10C is a graph depicting average temperature as a function of hole diameter for a grid in contact with a dielectric substance.
Figure 10A:
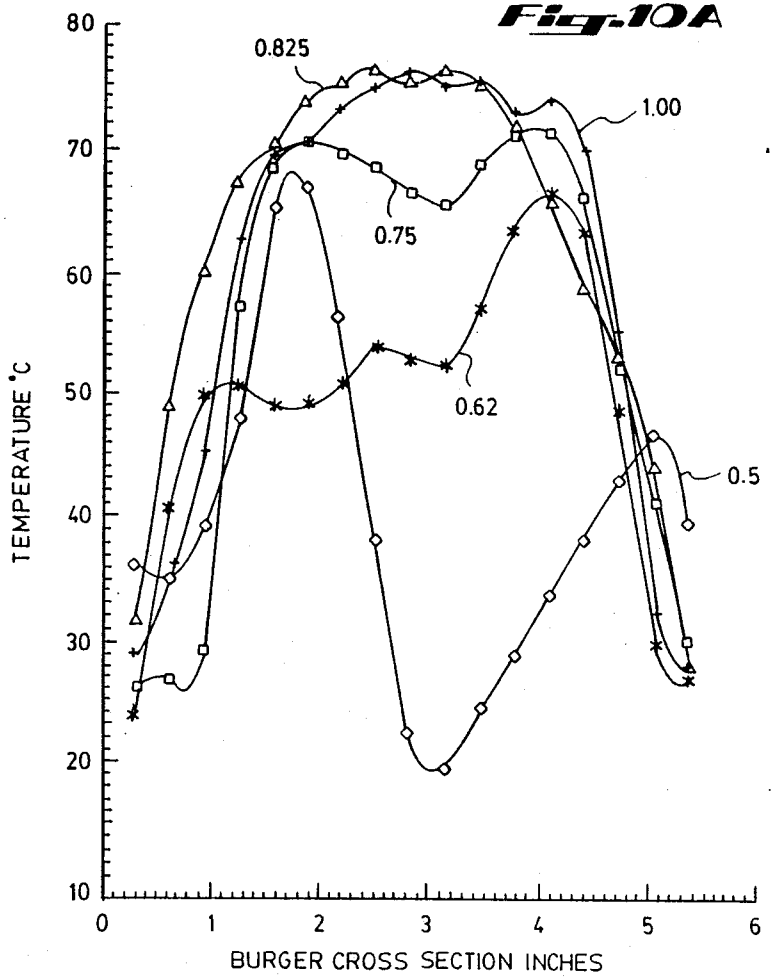
FIG. 10A is a graph depicting temperature profiles for grids in contact with a food product where the grids have various hole diameters.

FIG. 10A graphically depicts measurements of temperature profiles for grids 52 having various diameter holes 55. These measurements were taken using frozen hamburger meat 51 having the following dielectric properties: E′=3.42; E″=0.35. Where the diameter of the holes 55 is less than 0.5 inch, little heating will occur in the meat 51. For apertures 55 having a diameter of 0.5 inch, some heating occurred. FIG. 10A shows that the heating was not uniform for such small apertures 55, and a generally undesirable temperature profile resulted.

As shown in FIG. 10A, the temperature profile became more uniform as the size of the holes 55 was increased to 0.625 inch, and to 0.75 inch. Hole diameters of 0.875 inch gave the best temperature profile. It will be seen from FIG. 10A that the heating of the meat product 51 became more uniform as the holes 55 in the grid 52 were made larger. This will continue up to a point, until the optimum size holes are reached, and then the temperature profile will become less uniform. It is surprising that the temperature profile became more uniform as the size of the holes 55 was increased. Conventional wisdom would suggest that as hole size is made smaller, less microwave heating would occur and allow more time for thermal equilibrium to be reached through heat transfer in the food product 51. Thus, conventional wisdom would suggest that the temperature profile would become more uniform for smaller holes 55.

FIG. 10B shows a graph of experimental data taken using a grid in contact with a ½ inch thick square of rubber. The square of rubber was approximately 10 inches by 10 inches. The rubber had dielectric properties of: E′=12.8, E″=0.85. Rubber was selected because its dielectric properties are similar to some foods, and it can be conveniently tested repeatedly because its dielectric properties do not change significantly when it is heated and then cooled.

FIG. 10B depicts uniformity of heating as a function of the diameter of the openings in the grid. In this example, the openings in the grid were circular, and were arranged in a square lattice configuration.

In the example depicted in FIG. 10B, a hole diameter between about 0.5 inch and about 1 inch gave best results for the openings in the grid.

The vertical axis of the graph of FIG. 10B depicts "relatively uniformity". This value was calculated by dividing the standard deviation of the temperature measured across the entire surface of the 10 inch square sample, divided by the average temperature. The temperature across the entire surface of the sample was measured using an infrared camera.

FIG. 10C is a graph which depicts average temperature as a function of hole diameter for the same experiment which provided the data which is represented graphically in FIG. 10B. FIG. 10C shows that the average temperature generally increased for larger diameter openings in the grid.

Generally, the use of conductive side wall 54, as shown in FIG. 1A, instead of transparent side walls 69, as shown in FIG. 1B, is determined by the dielectric loss factor E″ of the food product 51. If the dielectric loss factor E″ is less than about 4, conductive side wall 54 may not be needed. Generally speaking, if the dielectric loss factor E″ of the food product 51 is greater than 4, conductive side wall 54 should be provided.

The use of a grid 52 instead of a single opening or iris 71 is particularly advantageous where the size of the food product 51 is such that it significantly exceeds the diameter of the maximum size of a single opening 71 which is desirable. A grid 52 can be used to create a uniform temperature profile or heating pattern when the required hole size 71 to expose the food product 51 to microwave radiation would be too large.

Grid Spaced From Food Product

FIG. 3 shows an alternative embodiment of the present invention. In this example, a food product 51 may rest upon a microwave transparent support 89. The microwave package 90 includes a first conductive sheet 91 and a second conductive sheet 92. The first conductive sheet 91 has tuned openings 93. Similarly, the second conductive sheet 92 has tuned openings 94. The first conductive sheet 91 and the second conductive sheet 92 may comprise grids.

The package 90 includes side shielding 95, which may be in the form of a large ring 95. Structural support for the package 90 may be provided by microwave transparent walls 96, and may be made from paper board. The support 89 may also be made from paper board.

The first grid 91 is spaced from the top surface of the food product 51 by a distance $H_1$. The second grid 92 is spaced from the bottom surface of the food product 51 by a distance $H_2$.

Figure 32A:
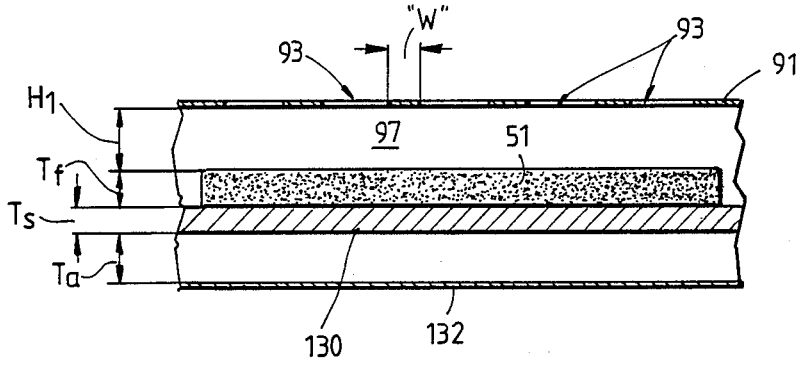
FIG. 32A is a cross-sectional side view of a food product and spaced grid supported by the floor of a microwave oven.

FIG. 32A shows an example of a single grid 91 spaced a distance "$H_1$" from the surface of the food product 51. This single grid example was used for the experiments discussed below.

The temperature profile for a grid 91 which is spaced from the surface of the food product 51 is a function of the diameter of the holes 93, and the spacing $H_1$ of the grid 91 from the food product 51. The interrelationship between these variables may be best understood with reference to FIG. 11A and FIG. 11B. FIG. 11A and FIG. 11B depict contour plots showing the relationship between grid height ($H_1$) and hole diameter of the holes 93 upon the temperature variability of the temperature profile of the food product 51. The greater the variability, the less uniform was the temperature profile.

In the example used for FIG. 11A and FIG. 11B, (see FIG. 32A), the food product 51 was a brownie. Brownies are particularly sensitive to overheating which occurs in a nonuniform microwave field having hot spots. The dehydration that results from a hot spot creates a hard texture after the brownies are cool. Pillsbury Microwave Brownie mix was used. In a 600 to 700 watt microwave oven, the recipe time was 4 minutes. A grid 91 was cut from aluminum foil laminated paper board. The paper board stock used was 0.18 inch SBS/0.0003 inch foil. The spacing of the grid 91 to the surface of the brownie 51 was controlled by expanded polystyrene spacing supports to hold up the grid 91. Expanded polystyrene was selected because its dielectric properties are not significantly different from air, and could be assumed to be transparent to microwaves for purposes of the experiment.

Hole diameters between about 0.75 inch and about 1.75 inches gave good results. A more preferred range of hole diameters was between about 1.0 inch and about 1.5 inches. A most preferred size for holes is about 1.25 inches. Of course, these dimensions are for a frequency of 2.45 GHz. The dimensions given herein, expressed in inches, would need to be scaled to account for changes in frequency.

A spacing $H_1$ of about $\frac{1}{4}\lambda$ is especially preferred, where $\lambda$ is the wavelength of the microwave radiation in the material between the grid 91 and the surface of the food product 51, which in this example is air. Of course, if some substance other than air occupies the space 97 inside the package 90, λ would represent the wavelength of the microwave radiation in that material. A spacing of about ¼λ is especially preferred because such a spacing $H_1$ is believed to be best for reducing the undesirable effects of any standing waves which may exist in the space 97 between the grid 91 and the food product 51. A spacing $H_1$ between about 0.15λ and about 0.35λ will give satisfactory results. A spacing $H_1$ between about 0.2λ and about 0.3λ is more preferred.

Good uniformity of heating can be achieved without sacrificing average temperature. A region of relative uniformity has been observed for a spacing distance $H_1$ within the ranges given above. The breadth of the range for the spacing distance $H_1$ is dependent upon other factors, such as the margin "W" between openings and the size of the openings.

For the commonly used microwave frequency of 2.54 GHz, a spacing $H_1$ within the range of about 0.25 inch to about 2.4 inches may give satisfactory results in practice. A more preferred region of uniformity in the microwave heating occurs with a grid spacing between about 0.6 inch to about 1.8 inches. An even more preferred range for the spacing H is between about 0.9 inch to range 1.5 inches. An especially preferred spacing $H_1$ between the grid and the surface of the food product is about 1.2 inches.

Referring to FIG. 32A, it will be seen that a portion of the conductive sheet 91 appears between the openings 93. This conductive material has a width or margin, indicated generally as "W" in FIG. 32A. In this example, the width "W" is considered to be the spacing between the openings 93, measured at the minimum distance between the openings 93. In the case of circular apertures 93, the width "W" is the narrowest, or minimal distance between the circular openings 93. This is shown more clearly in FIG. 1C.

The effect of varying the spacing of the openings 93, i.e., varying "W", is best explained with reference to FIGS. 15A, 15B, 16A and 16B.

Figure 15A:
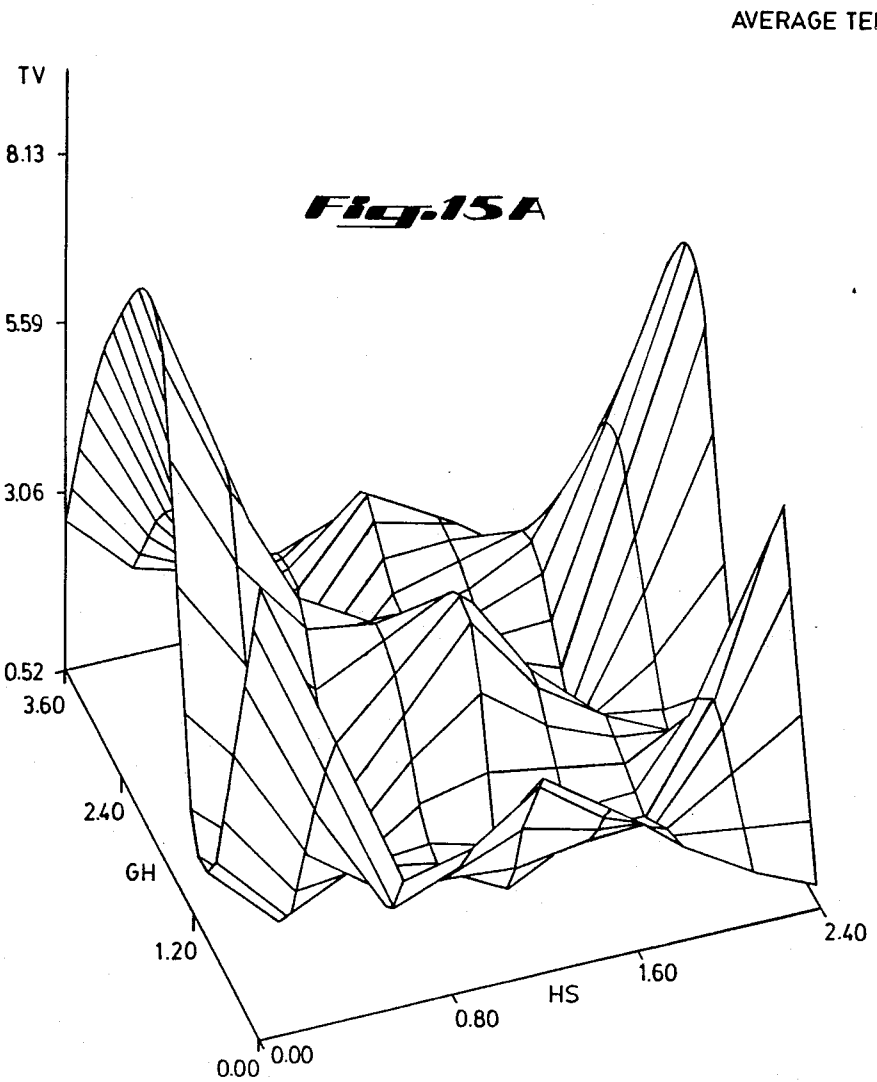
FIG. 15A is a contour plot depicting temperature variability in a heating profile as a function of hole spacing and grid spacing from the food product.

FIG. 15A is a three-dimensional contour plot showing the effect of spacing width "W" upon temperature variability in the temperature profile of a food product 51. A low temperature variation indicates more uniform heating of the food product 51. As shown in FIG. 15A, the best uniformity of heating occurred for spacing widths "W" between holes 93 between about 0.6 inch to about 1.8 inches. Within this range, average temperature has been found to be relatively independent of grid height spacing "$H_1$". In FIG. 15A, the hole spacing width "W" is plotted on the axis labeled "HS". The grid height spacing "$H_1$" is shown plotted on the axis labeled "GH". The temperature variability is shown plotted on the vertical axis labeled "TV".

Figure 15B:
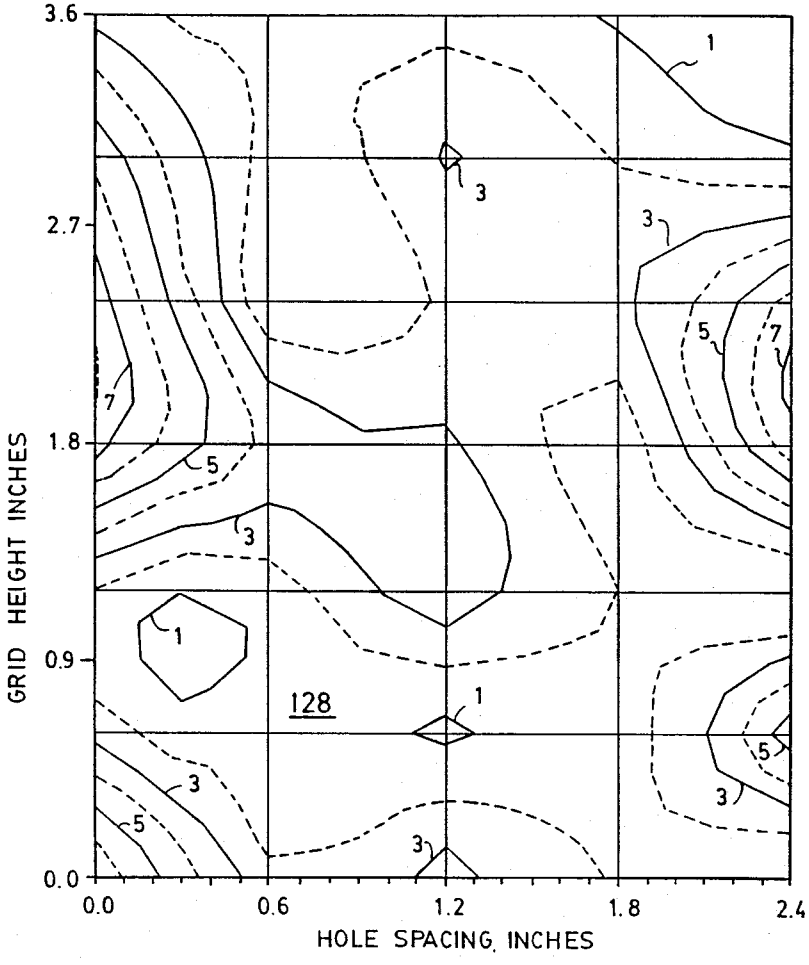
FIG. 15B is a two-dimensional contour plot similar to FIG. 15A.

FIG. 15B is a two-dimensional contour plot similar to FIG. 15A. In these examples, the temperature profile of a brownie was used to develop the data which is plotted in the graphs.

While temperature variability is an important consideration, average temperature is also a relevant consideration. For example, if little or no heating occurs in the food product 51, then the temperature variability could appear to be very good but the results would be unsatisfactory. In other words, it is desirable to achieve good temperature uniformity without sacrificing average temperature.

Figure 16A:
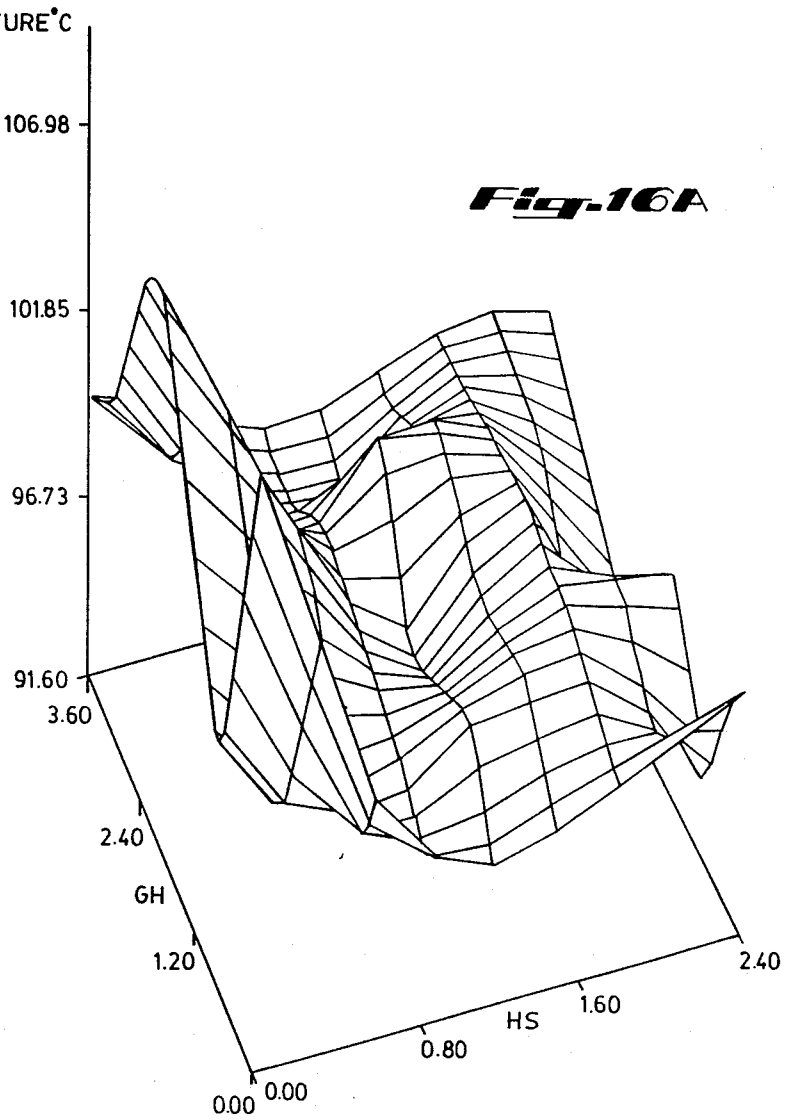
FIG. 16A is a contour plot depicting average temperature as a function of hole spacing and grid spacing from the food product.

FIG. 16A is a three-dimensional contour plot showing the average temperature as a function of the hole spacing width "W", and the grid spacing from the surface of the food product "$H_1$". In FIG. 16A, the width "W" is shown plotted on the axis which is labeled "HS". The grid spacing "$H_1$" is shown plotted on the axis labeled "GH". The average temperature is shown plotted on the vertical axis. Satisfactory average temperatures do occur within the preferred range from about 0.6 inch to about 1.8 inches.

Figure 16B:
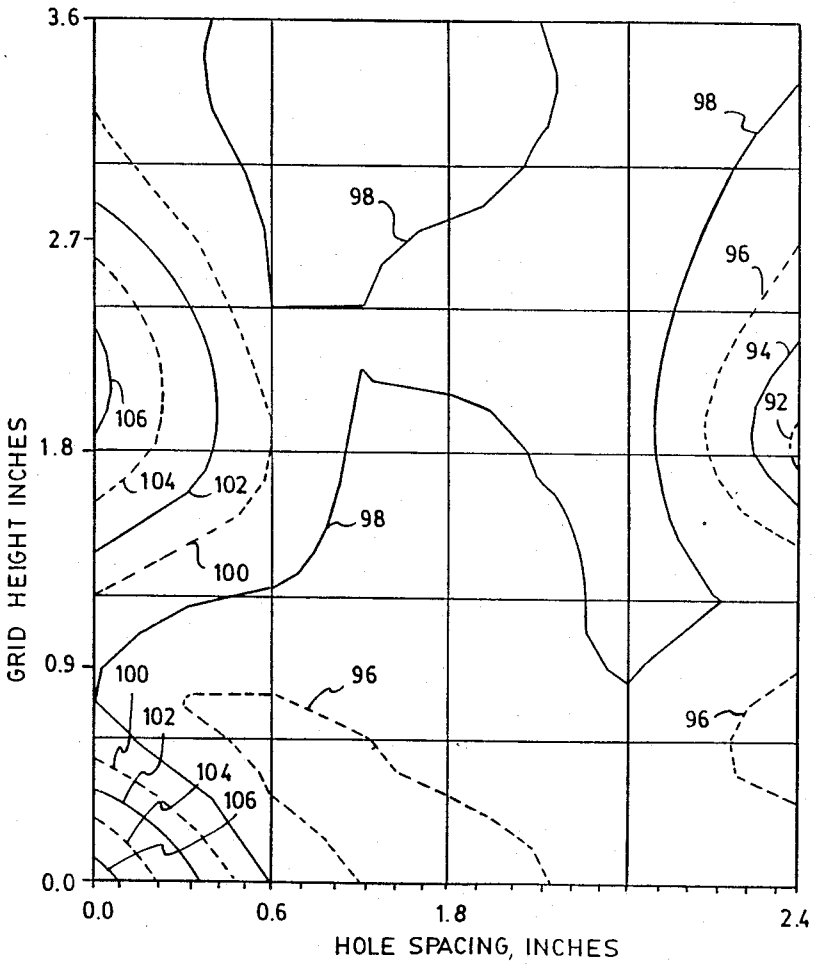
FIG. 16B is a two-dimensional contour plot similar to FIG. 16A.

FIG. 16B is a two-dimensional contour plot similar to FIG. 16A.

The width "W" between the holes 93 may be used to compensate for effects of changes in the dielectric constant of the food product 51 during heating. Margins or widths W in the range of about 0.6 inch to about 1.8 inches are preferred. If the openings 93 are spaced too closely together (i.e., W is too small), the grid spacing height $H_1$ becomes critical, in the sense that only a very narrow range of grid height spacing $H_1$ will provide better uniformity. By moving the openings 93 apart to a 0.6 inch to 1.8 inch spacing, the region of uniformity is widened to a more acceptable degree. If a grid spacing "$H_1$" is selected corresponding to ¼ wavelength plus or minus 25%, the range of suitable margins or widths "W" may be broadened to about 0.125 inch to about 2.4 inches. That is, the margin width "W" may be so broadened for grid spacing "$H_1$" between about 0.9 inch to about 1.5 inches.

It is important to appreciate that improved temperature uniformity is not achieved simply by reducing heating of the food product. The relationship between average temperature and temperature variability is not a simple one. This can best be explained by a comparison between FIG. 16B and FIG. 15B. For example, for a hole spacing "W" greater than 1.8 inches, the grid height "$H_1$" begins to significantly affect the average temperature, as shown in FIG. 16B. FIG. 15B shows that for hole spacing "W" greater than 1.8 inches, the grid height also significantly affects the temperature variability. However, a comparison of FIG. 16B with FIG. 15B shows that the average temperature may decrease while the corresponding temperature variability increases.

Figure 17B:
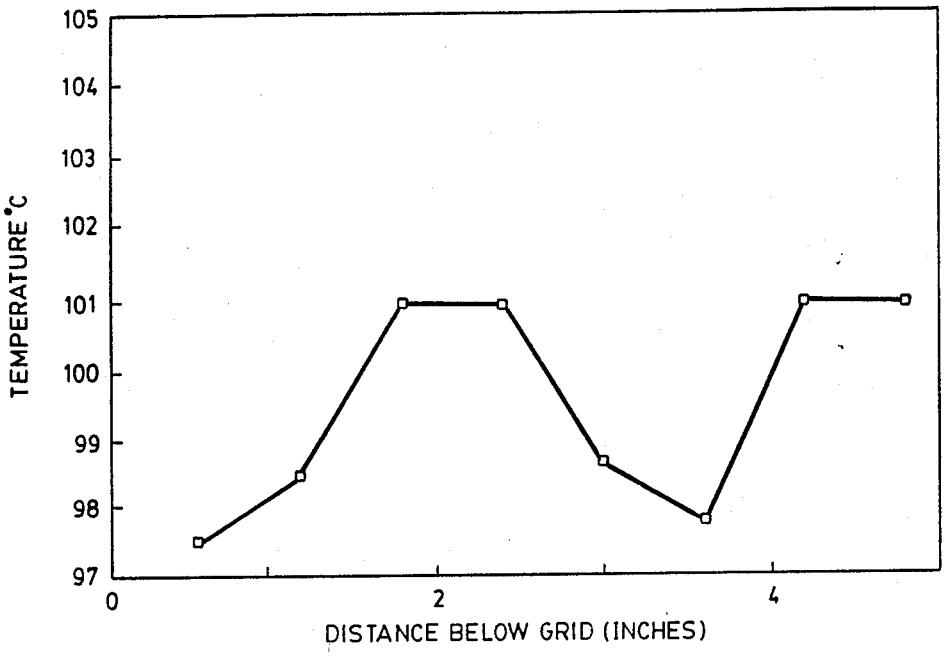
FIG. 17B is a graph depicting average temperature as a function of spacing between a grid and the surface of a food product measured experimentally.
Figure 17A:
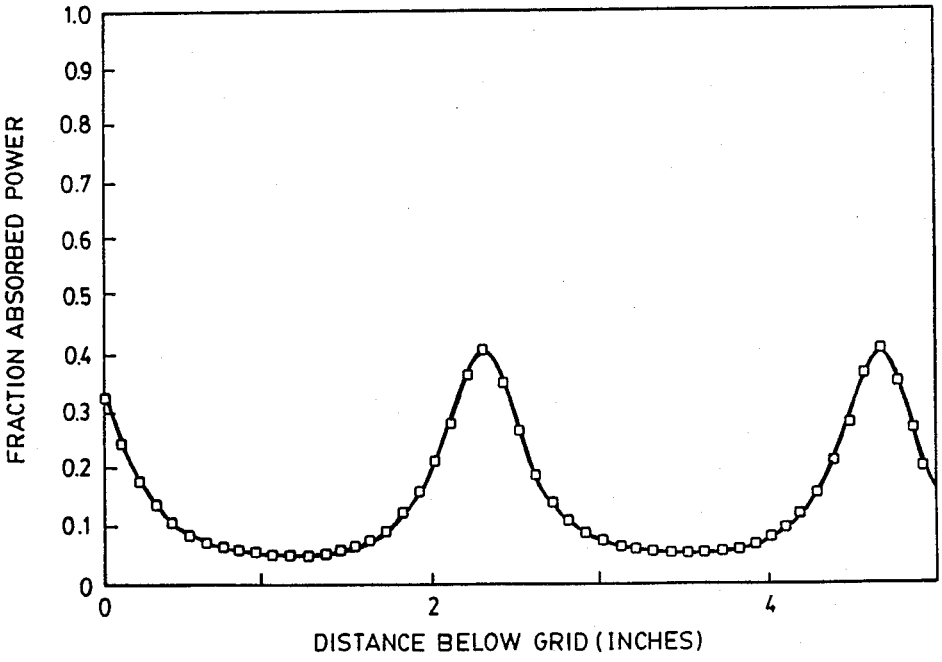
FIG. 17A is a graph depicting fraction absorbed power as a function of spacing between a grid and the surface of a food product, as predicted by a mathematical model.

An explanation of the width or margin "W" between holes 93, and the effect that it has upon the region of uniformity, can best be understood with reference to FIG. 17A. FIG. 17A is a graph depicting spacing of the grid versus the fraction of the microwave power which is absorbed by a food product, which in this case is a brownie. The Chen model was used in conjunction with a transmission line analysis in order to mathematically predict the values which are plotted in FIG. 17A. The Chen model is described in more detail in application Ser. No. 119,381, filed Nov. 10, 1987, the entire disclosure of which is incorporated herein by reference. It is sufficient for the present discussion to observe that peaks in absorption occur at spacings "$H_1$" between a grid and the surface of the food product which roughly correspond with ½λ or multiples thereof, where λ is the wavelength of the microwave radiation. These peaks in absorption are believed to correspond with conditions of high standing wave ratios. The absorption peaks which are predicted by the mathematical model shown in FIG. 17A agree closely with experimental results, which are plotted in the graph of FIG. 17B.

In the experimental example which formed the basis for the graph of FIG. 17B, brownies were heated in a microwave oven using a grid spaced various distances from the surface of the brownie. The grid had 1 inch diameter circular openings in a square lattice configuration. The brownies were heated at full power for 4 minutes, then removed from the oven. The temperature of the top surface of the brownies, i.e., the surface facing the grid, was measured using an infrared camera. The average temperature on the surface of the brownie was computed by measuring the temperature of the entire surface of the brownie, and then computing an average using computer software which is identified more fully in application Ser. No. 119,381, filed Nov. 10, 1987.

The temperature of the brownie measured experimentally showed peaks in average temperature which generally corresponded with the peaks which were mathematically predicted, and depicted in FIG. 17A. The data plotted in FIG. 17B corresponds with the data which is plotted in the contour plots of FIGS. 16A and 16B. For example, in FIG. 16A, if a vertical plane is taken which passes through the "HS" axis at a point corresponding to a hole spacing of $\frac{1}{8}$ inch, the inner section of that plane with the contour which is plotted in FIG. 16A would generally correspond with the curve which is plotted in FIG. 17B. The curve of FIG. 17B may also be shown to correspond with the contour plot of FIG. 16B.

Figure 17C:
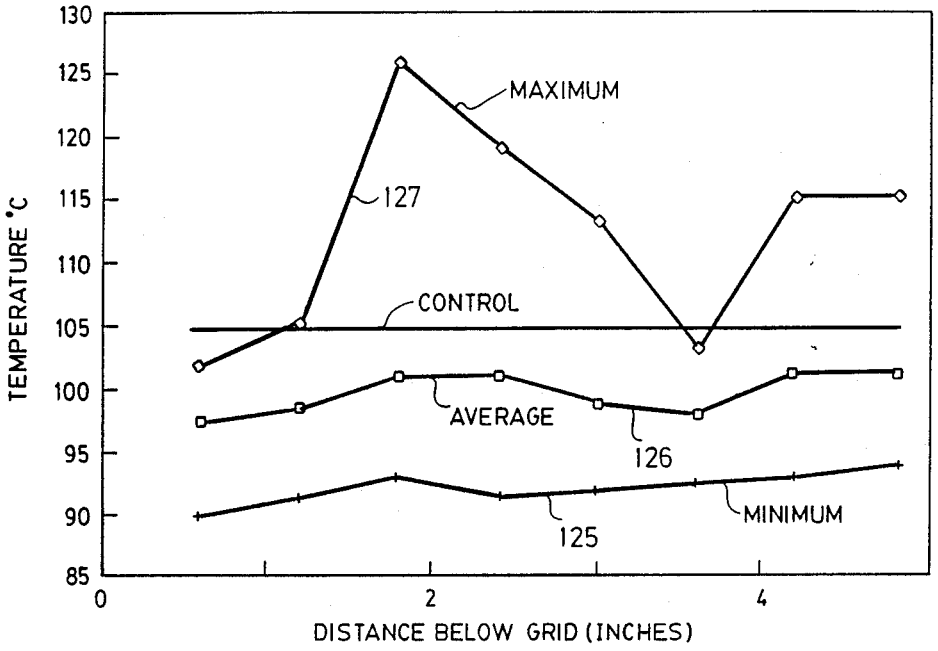
FIG. 17C is a graph which depicts maximum, minimum and average temperatures measured for various spacings between a grid and the surface of a food product.

A spacing "$H_1$" between the grid and the surface of the food product which corresponds with $\frac{1}{2}\lambda$, or multiples thereof, should be avoided. The reason that such spacing should be avoided can best be explained with reference to FIG. 17C. FIG. 17C graphically depicts experimental measurements upon the heating effect of microwaves on a brownie food product. The horizontal axis represents the spacing distance "$H_1$" between the surface of the brownie and the grid. The vertical axis represents temperatures which were measured using an infrared camera. Curve 125 depicts the minimum temperature which was measured on the surface of the brownie after microwave heating for various spacings between the grid and the food product. Curve 126 represents the average temperature measured for various spacings between the grid and the food product. Curve 127 represents the maximum temperature which was measured for various spacings between the grid and the food product.

From FIG. 17C, it will be seen that high maximum temperatures were observed for spacings between the grid and the food product which corresponded with the regions of maximum absorption predicted in FIG. 17A. That is, regions which correspond with spacings between the food product and the grid which are $\frac{1}{2}\lambda$, or multiples thereof. Significantly, the variability in the temperature increased in such regions. In other words, the uniformity of heating was adversely affected for spacings between the grid and food product which corresponded with the regions of maximum absorption predicted in FIG. 17A. If uniformity of heating is desired, the regions corresponding with spacings between the grid and food product which does not correspond with the peak absorption regions would be preferred. That is, a spacing between the grid and food product generally corresponding with a spacing of $\frac{1}{4}\lambda$ would be preferred, because this would correspond with a position on the curve of FIG. 17A which would be midway between two peaks. Odd multiples of $\frac{1}{4}\lambda$ would also be preferred.

The spacing or margins "W" between openings in a grid may be used to reduce the adverse effect of standing waves, which is predicted by FIG. 17A, upon the uniformity of heating. In addition, the size of the openings in the grid may also be adjusted to reduce the adverse effect upon uniformity of heating which may occur due to the standing wave effect. This may best be explained with reference to FIG. 18A and FIG. 18B.

Figure 18A:
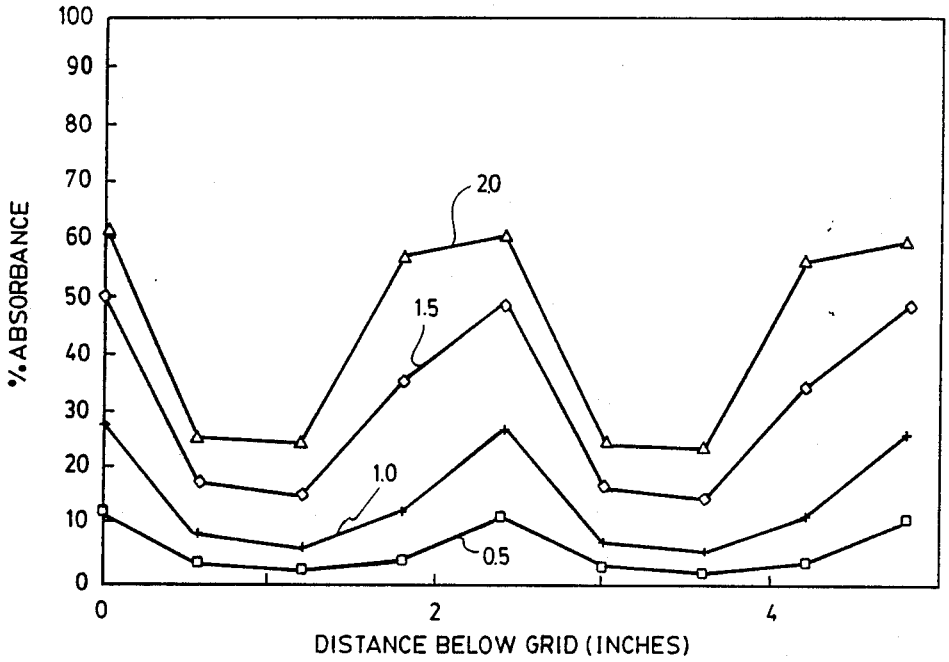
FIG. 18A is a graph showing percentage power absorbed as a function of the distance between a grid and the food product for grids having various size holes as predicted by a mathematical model.

FIG. 18A is a graph which depicts the percentage microwave power which is absorbed as a function of the distance "$H_1$" between the grid and the food product for various sizes of openings in the grid. In this example, the spacing or margin "W" between openings in the grid was 0.1 inch.

From FIG. 18A, it will be seen that the peaks in absorption may be reduced by using a grid having smaller size holes. However, a limit is reached where if the size of the openings in the grid are made too small, insufficient microwave energy will penetrate the grid to effectively heat the food product. If the size of the openings in the grid are made too small, the openings will not interact sufficiently with the microwave field. For this reason, a hole size of about one inch is preferred, because it reduces the peaks in absorption which occur for spacings "$H_1$" of multiples of one-half wavelength, and openings of such size allow sufficient microwave energy to penetrate the grid.

Figure 18B:
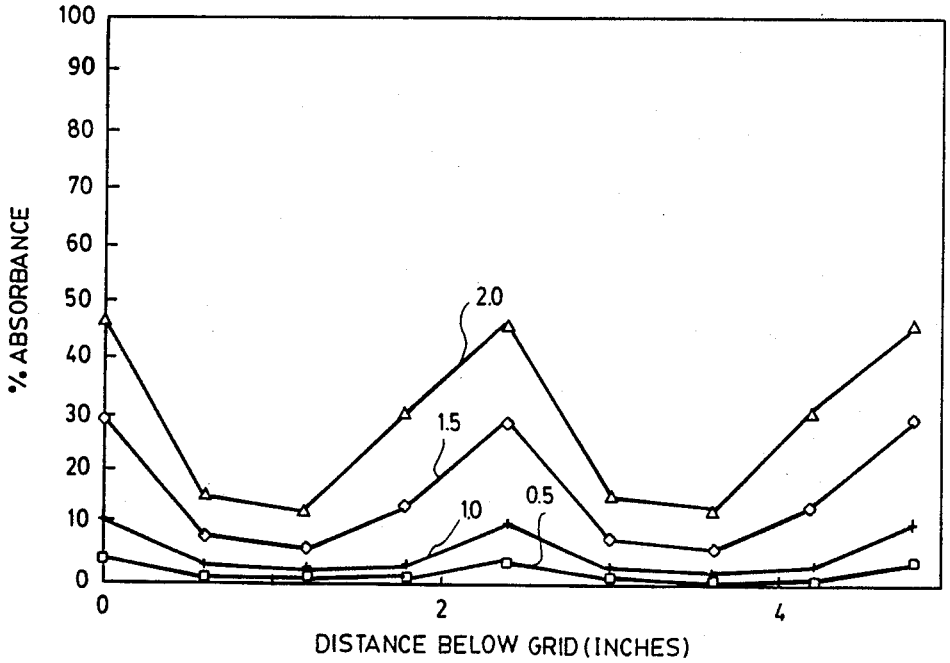
FIG. 18B is a graph similar to FIG. 18A, where the openings in the grids were spaced further apart.

The effect of increased spacing or margins "W" between holes may be seen by comparing the results of FIG. 18B to those plotted in FIG. 18A. FIG. 18B shows that the family of curves plotted for various size openings in the grid show an overall reduction in peaks where the spacing or margins "W" between openings is increased to 0.5 inch.

The spacing "W" between openings in the grid, and the height or spacing "$H_1$" between the grid and the food product may be thought of as being interrelated factors in the design of a microwave package. One factor may be adjusted to provide greater tolerance in the effect upon the performance of the overall microwave package when the other factor is varied. In other words, if the height "$H_1$" of the grid from the surface of the food product is at a distance corresponding to $\frac{1}{4}\lambda$, the margin "W" between holes is less critical. If a spacing "W" between openings is selected within the preferred range described herein, the height "$H_1$" between the grid and the surface of the food product becomes less critical.

Similarly, the size of the openings in the grid is interrelated with these two factors. If the size of the openings is selected, for example, a preferred size of one inch, the height "$H_1$" and the spacing width "W" will be less critical. The preferred region for microwave package design is shown in FIG. 15B and indicated generally by the reference numeral 128. The selection of hole size has been previously described, with a hole size of about one inch being especially preferred. Therefore, operating in the region generally indicated by reference numeral 128 in FIG. 15B is preferred because it provides a region for a microwave package design which exhibits significant tolerance for variation in dimensions without adversely affecting the performance of microwave heating upon the food product, especially when uniformity of heating is an important performance factor. In other words, operation in the region generally corresponding with reference numeral 128 in FIG. 15B provides the ability to design a package to provide a predetermined temperature profile in a food product during microwave heating which will be reproducible from one food product to the next where the dimensions of the microwave package components are allowed to vary within a range of tolerances necessary to provide for mass production of such a product.

The above-discussed design parameters of spacing "W" between openings in the grid, size "D" of the openings in the grid, the height "$H_1$" between the grid and the surface of the food product are all interrelated. In order to achieve the advantages of the present invention, it is important to select an appropriate combination of these parameters. Each of these design parameters affects the electrical impedance presented by the grid at the particular microwave frequency of interest. Therefore, the combined effect of these design parameters may be considered together by relating them to the electrical impedance of the grid.

Figure 38:
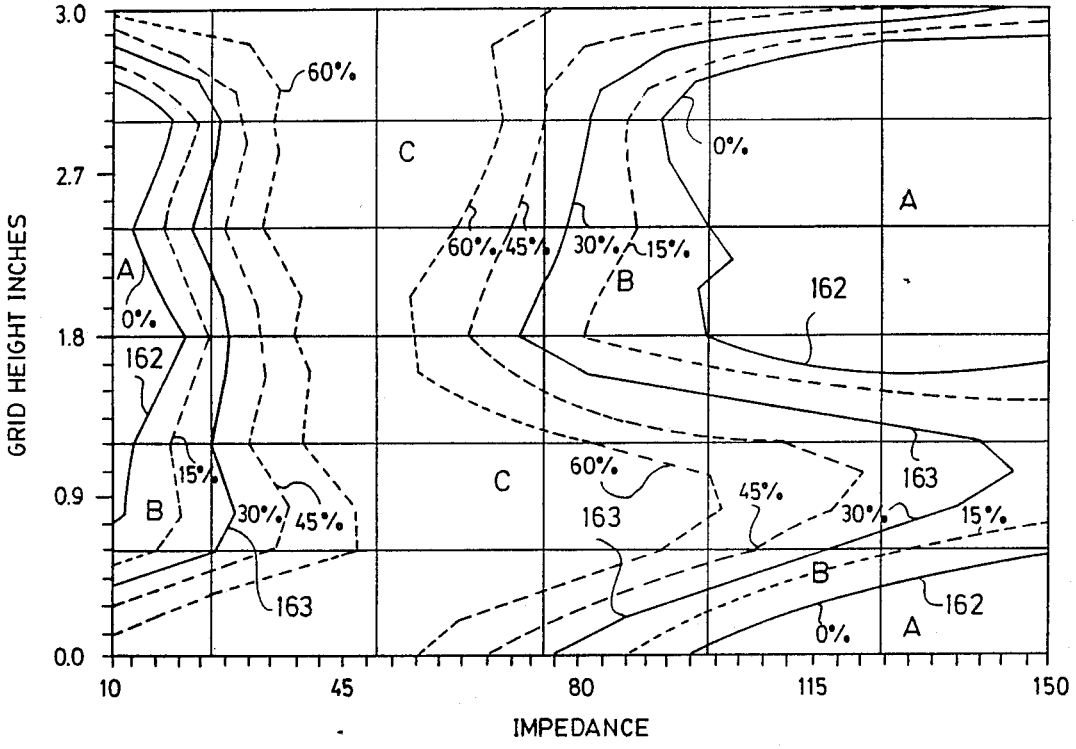
FIG. 38 is a graph showing contour lines having substantially the same temperature uniformity for various grid impedances and grid spacings from the food product.

This may be further understood with reference to FIG. 38. FIG. 38 is a graph which was produced using the data which is presented in FIG. 11B and FIG. 15B. The hole diameter information, hole spacing information, and grid height information in FIG. 11B and FIG. 15B were used to compute an impedance for the grid which is represented on the horizontal axis of FIG. 38. The vertical axis of FIG. 38 represents grid height. The curves shown in FIG. 38 are contour lines which represent points which had the same measured temperature uniformity, or temperature variation.

The curve identified with reference numeral 162 in FIG. 38 represents points which had a temperature uniformity which was about the same as a food product cooked without using the present invention. Curve 162 defines regions "A" shown in FIG. 38 which have temperature uniformity which is worse than the control example of a food product which was cooked in a microwave oven where the food product was placed in the microwave oven and cooked by itself without the use of any other utensil or structure other than a microwave transparent pan to support the food product during cooking.

Curve 163 shown in FIG. 38 represents points which had a temperature uniformity that was approximately 30% better than the control example. Curve 163, in combination with curve 162, defines regions "B" shown in FIG. 38 which had temperature uniformity better than the control example, up to an improvement of about 30%. Curve 163 defines a region "C" of preferred operation, which is shown in FIG. 38. In region "C", temperature uniformity was more than about 30% better than the control example.

For a given grid geometry having openings of virtually any shape and spacing, an impedance for the grid may be measured or calculated. A combination of impedance and grid height "$H_1$" falling in regions "B" and "C" of FIG. 38 are preferred in accordance with the present invention. A combination of impedance and grid height "$H_1$" which falls in region "C" of FIG. 38 is even more preferred. Thus, unusual shaped openings in the grid may be used, and spacings which may be difficult to define can be employed, where the combination produces an impedance which preferably falls in area "C" of FIG. 38.

Within the range of preferred hole sizes and hole spacings, increasing hole size or reducing hole spacing will generally tend to increase impedance.

FIG. 38 provides a useful means for adjusting grid height to provide optimum operation of the present invention given unusual hole shapes, spacings, or grid geometries.

For grid heights "$H_1$" which are less than 0.25 inch, the dielectric properties of the food product can significantly affect performance. The shape of the curves 162 and 163 will be affected by the dielectric properties of the food product for grid heights "$H_1$" which are less than about 0.25 inch. If the food product has a low dielectric loss factor E" which is less than about 0.2, it may be necessary to tune the microwave heating system according to the present invention in order to minimize the adverse effects of standing wave patterns. This is explained more fully below with reference to FIG. 32A.

Where the food product 51 is spaced more than 0.25 inch from the grid 91, the microwave package system should be considered as a spaced grid 91. Otherwise, the grid 91 should be treated as a contact grid, and the discussion in connection with FIGS. 1A and 1B would be applicable. For a spaced grid 91, the spacing $H_1$ will be more critical for low loss foods, that is where the dielectric loss factor E" is less than 0.2. The problem of standing waves can also be substantial when the dielectric loss factor E" is less than about 0.8, but it is not as important a consideration as when E" is less than about 0.2. If E" is less than about 0.2, reflections from the oven cavity floor become an important consideration, and the package 90 must be tuned to account for such reflections. The dielectric constant E' should be measured, and the package 90 tuned to handle standing waves under such circumstances.

This may best be understood with reference to FIG. 32A. FIG. 32A depicts a food product 51 resting on a microwave oven shelf 130. Spaced a height "$H_1$" about the food 51 is a grid 91 constructed in accordance with the present invention. The microwave oven has a reflective floor 132 which forms the bottom part of the microwave oven cavity.

In the operation of a typical microwave oven, microwave energy is reflected from the microwave oven reflective floor 132, the microwave oven shelf 130 being essentially transparent to microwave radiation. The microwave energy reflected from the reflective surface 132 may establish standing wave patterns within the microwave oven cavity. To analyze the effect of such standing wave patterns upon the performance of the present invention, it is appropriate to consider that the food 51 has a thickness "$T_F$", the oven shelf 130 has a thickness "$T_S$", and the reflective floor 132 of the oven is spaced a distance "$T_A$" from the bottom of the oven shelf 130. In the present invention, the grid 91 is preferably spaced a height "$H_1$" which is $\frac{1}{4}\lambda$ from the surface of the food 51, where $\lambda$ is the wavelength of the microwave radiation. The total electrical distance in wavelengths "$H_\lambda$" between the reflective surface 132 and the grid 91 may be determined by considering the following relationship:

$$H_\lambda = \frac{H_1}{\lambda_0} + \frac{T_F}{\lambda_F} + \frac{T_S}{\lambda_S} + \frac{T_A}{\lambda_0}$$

where $H_1$ is the height of the grid 91 from the surface of the food 51, $T_F$, $T_S$ and $T_A$ are the thicknesses of the food 51, the shelf 130, and the space between the oven shelf and the reflective surface 132, respectively, and $\lambda_0$, $\lambda_F$ and $\lambda_S$ are the wavelength of the microwave radiation in air, the food 51, and the shelf 130, respectively. For example, the wavelength of microwaves in the food 51 may be determined by measuring the relative dielectric constant E' of the food 51, and then calculating $\lambda_F$ based upon the following formula:

$$\lambda_F = \frac{\lambda_0}{\sqrt{E'}}$$

It is desirable to avoid an $H_\lambda$ which is a multiple of one-half. That is, in the operation of the grid 91, it is desirable to position the grid 91 where it is not at a distance equivalent to ½ wavelength from the reflective surface 132 of the oven cavity. If such a condition occurs, the food 51 may be spaced a distance from the oven shelf 130, while maintaining a spacing of $\frac{1}{4}\lambda_0$ from the surface of the food 51.

Figure 32B:
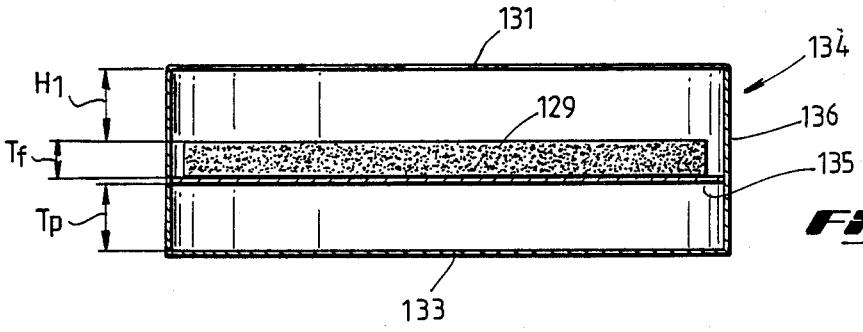
FIG. 32B is a cross-sectional side view of a food package having a reflective surface spaced a predetermined distance from the grid.

The thickness $T_S$ of the oven shelf 130 and the spacing $T_A$ between the oven shelf 130 and the reflective surface 132 may vary between different models of microwave ovens. FIG. 32B illustrates an embodiment of the present invention which is relatively insensitive to variations in the thickness $T_S$ of the oven shelf 130 and the spacing $T_A$ between the oven shelf 130 and the reflective surface 132. In the embodiment shown in FIG. 32B, a conductive reflector 133 is provided along the bottom of microwave package 134. Food supporting structure 135 is provided in the package 134 which comprises a shelf, preferably made from microwave transparent material such as paper board, to provide a predetermined spacing $T_P$ between the food product 129 and the reflector 133.

The package shown in FIG. 32B provides a means for controlling the phase relationship between reflected microwave energy at the location of the grid 131. The microwave package 134 also includes conductive side walls 136. Conductive side walls 136 are preferred in order to reduce interference caused by microwave energy which would otherwise enter through the sides of the package 134. However, the microwave package 134 shown in FIG. 32B is a more expensive alternative in microwave packaging. Some trade-offs must be made between performance and cost.

Conductive side walls 95 are generally believed to be required where the dielectric loss factor E″ of the food product is greater than 4, and where the lateral dimensions of the food product (i.e., the length and width) are greater than or equal to about 5 inches by about 5 inches. The dielectric loss factor E″ of greater than about 4 is for those products that have that value sometime during exposure to microwave radiation and preferably for a substantial portion of the period of exposure to microwave radiation. For products having a dielectric loss factor E″ of less than about 4 during exposure to microwave radiation and preferably for a substantial portion of the period of exposure to microwave radiation, then the conductive side walls can be eliminated.

In a preferred embodiment where the grid 91 is spaced from the adjacent surface of the food product 51, the grid area should be greater than or equal to the area of the opposing surface of the food product 51. That is, the grid 91 should cover an area which is generally parallel to, and at least coextensive with, the adjacent opposing surface of the food product 51, which is desired to be heated. Preferably, the peripheral edges 57 of the grid are coextensive or extend beyond the peripheral edges of the food.

Figure 12:
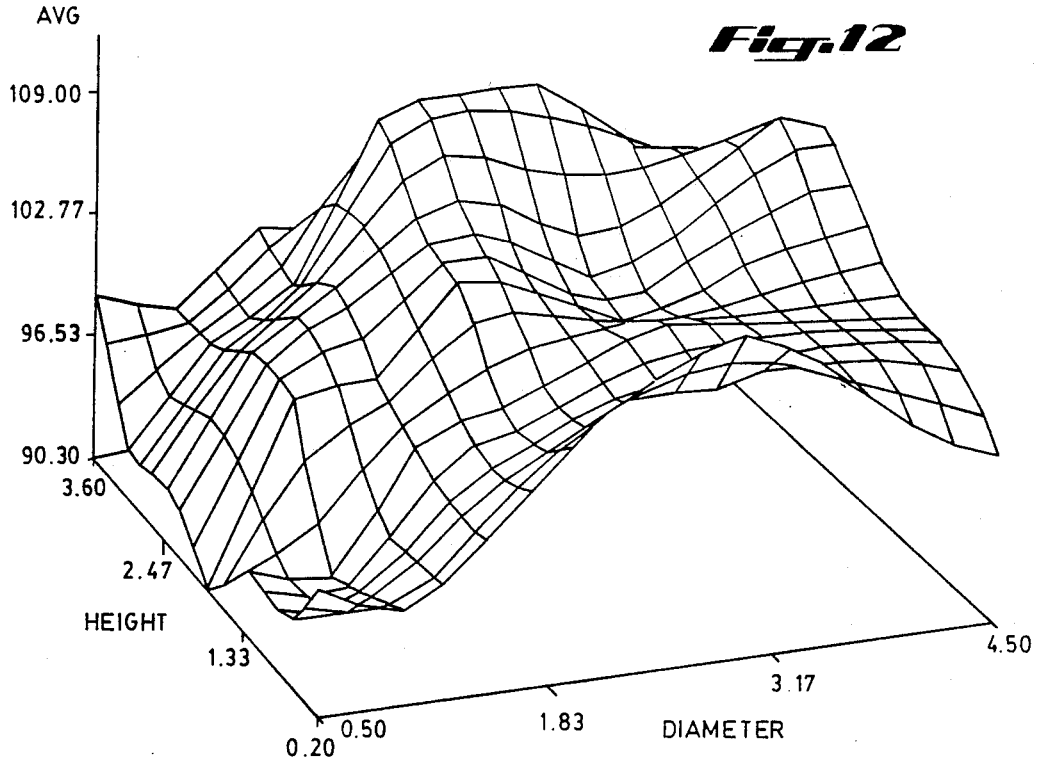
FIG. 12 is a contour plot depicting average temperature as a function of hole diameter and grid spacing from the food product.
Figure 13:
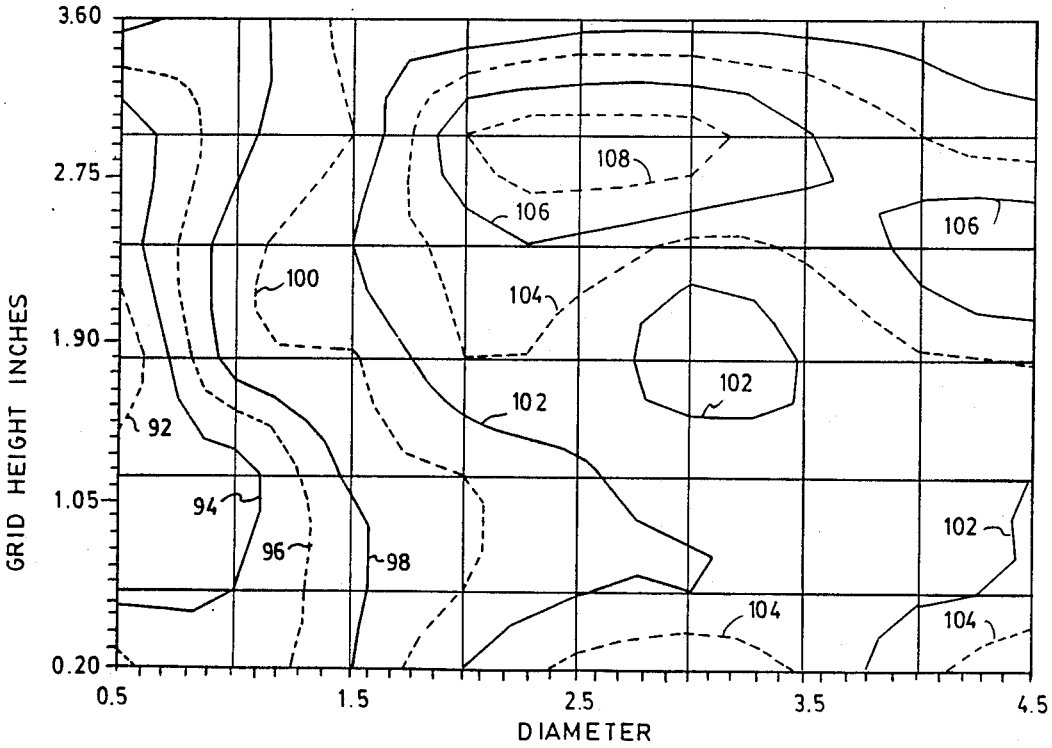
FIG. 13 is a two-dimensional contour plot similar to FIG. 12.

The average temperature reached by the food product 51 is also a function of grid spacing $H_1$ and the diameter of the holes 93 in the grid 91. This relationship is illustrated by FIGS. 12 and 13. Thus, temperature variability is not the sole design consideration. Average temperature is a relevant consideration. With the present invention, low temperature variability may be achieved while maintaining high heating rates. In specific cases, heating rates can be increased while at the same time improving temperature variability (i.e., uniformity).

Temperature profile uniformity is improved through the use of conductive side walls 95 in foods having a dielectric loss factor greater than 4. Cook time may be shortened by using only a top grid 91, without any bottom grid 92 or a reflective bottom surface . In practice, uniformity was still good without using bottom grid 92 shown in FIG. 3.

Grid Structure

A grid suitable for use in conjunction with the present invention preferably is made from aluminum foil. The grid should be conductive, and is preferably metallic. Other metals may also be used for the grid, including stainless steel, copper, cold rolled steel, and even silver. Metals and alloys which may be suitable for the grid are listed in Table I.

The grid preferably has a surface resistivity of ten ohms per square or less. The grid more preferably is made from a material which has a bulk resistivity of 100 microhms/cm or less (measured at 20° C). The grid even more preferably is made from a material which has a bulk resistivity of about 70 microhms/cm or less. The grid is most preferably made from a material having a bulk resistivity of about 20 microhms/cm or less. The grid is preferably constructed of a good conductor material which has a bulk conductivity of about $3.5 \times 10^5$ Siemens/cm or greater.

TABLE I

PROPERTIES OF METALS AS CONDUCTORS

| Metal | Conductivity Siemens/cm | Resistivity microhms/cm 20° C. |
|---|---|---|
| Aluminum | $3.54 \times 10^5$ | 2.824 |
| Brass | $1.43 \times 10^5$ | 7 |
| Copper: annealed | $5.8 \times 10^5$ | 1.7241 |
| hard-drawn | $5.65 \times 10^5$ | 1.771 |
| Gold | $4.1 \times 10^5$ | 2.44 |
| Iron, 99 98% pure | $1 \times 10^5$ | 10 |
| Nichrome TM | $1 \times 10^4$ | 100 |
| Nickel | $1.28 \times 10^5$ | 7.8 |
| Phosphor bronze | $1.28 \times 10^5$ | 7.8 |
| Platinum | $1 \times 10^5$ | 10 |
| Silver | $6.3 \times 10^5$ | 1.59 |
| Steel, E, B, B | $9.6 \times 10^4$ | 10.4 |
| Steel, B, B | $8.4 \times 10^4$ | 11.9 |
| Steel, Siemens-Martin | $5.6 \times 10^4$ | 18 |
| Steel, manganese | $1.43 \times 10^4$ | 70 |
| Tin | $8.7 \times 10^4$ | 11.5 |
| Zinc | $1.72 \times 10^5$ | 5.8 |

The grid comprises a conductive surface which is electrically continuous and which surrounded a plurality of transmissive areas forming the apertures or openings in the grid. In a preferred embodiment, the conductive surface is planar, and is positioned parallel to an opposing surface of the food product. Alternatively, the conductive surface may be non-planar, but is preferably spaced equidistant from, or a generally uniform distance from, the opposing surface of the food product. The relevant surface of the food product will generally be the adjacent surface of the food.

The transmissive areas defining the apertures or holes in the grid are preferably essentially microwave transparent. Preferably, the transmissive areas have a dielectric loss factor E" which is less than about 0.01. Preferably, the transmissive areas defining the holes in the grid comprise air spaces. Air has a dielectric loss factor E" less than 0.001. If the transmissive areas are filled with a dielectric material other than air, the ranges for the preferred hole sizes may be shifted. The ranges should be adjusted in accordance with the formula:

$$D_H = \frac{D}{\sqrt{E'}} \quad \frac{2.45}{F}$$

where $D_H$ is the adjusted size for the preferred range expressed in inches (which has been adjusted to account for the dielectric properties of the material in the transmissive area), E' is the relative dielectric constant of the material in the transmissive area of the openings in the grid, F is the frequency of the microwave radiation in gigahertz, and D is the preferred hole size which is desired to be adjusted to account for the dielectric properties of the material in the transmissive area.

If a dielectric material is placed on one side of the grid, and substantially in contact with the surface of the grid, the dielectric material will have an effect upon the hole size $D_H$, just as is the case when the grid is placed in contact with a food product. The ranges for the preferred hole sizes may be shifted, and must be adjusted in accordance with the following formula:

$$D_H = \frac{D}{2}\left[\frac{1}{\sqrt{E'}} + 1\right] \frac{2.45}{F}$$

where $D_H$ is the adjusted size for the preferred range of hole size, expressed in inches (which has been adjusted to account for the dielectric properties of the material immediately adjacent to one side of the grid), E' is the relative dielectric constant of the material which is immediately adjacent to the grid, F is the frequency of the microwave radiation in gigahertz, and D is the preferred hole size which is desired to be adjusted to account for the dielectric properties of the material which is immediately next to the grid.

Figure 39:
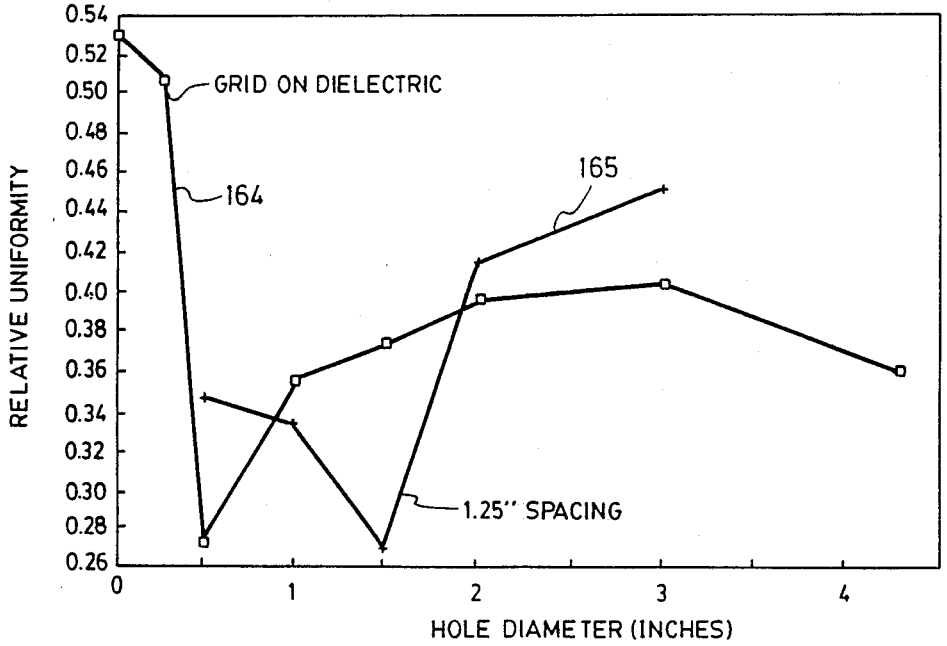
FIG. 39 is a graph which includes the data plotted in FIG. 10B, and compares it with the relative uniformity of heating as a function of hole diameter for a grid which was spaced a distance from the same dielectric substance.

The effect of a dielectric material in contact with one surface of the grid is demonstrated by the experimental data which is shown in the graph of FIG. 39. Curve 164 plots the same data which is shown in FIG. 10B. In that example, rubber was placed in contact with the grid, and the relative temperature uniformity was measured for various diameter holes in the grid.

Curve 165 represents an experiment using the same rubber which was spaced a height "$H_1$" of about 1.25 inches from the grid.

FIG. 39 demonstrates that the preferred range of hole diameters is shifted when a dielectric substance is placed in contact with, or in close proximity to, the grid. When the dielectric rubber material was placed in contact with the grid used to generate the data in FIG. 39, the preferred hole size shifted to a smaller size hole.

The transmissive areas defining the holes or openings in the grid can be vapor permeable.

The grid is preferably dimensionally stable. A flexible grid which is allowed to flex or assume random or uncontrolled spacings from the surface of the food product is undesirable. Haphazard spacing of the grid from the food surface can defeat the performance of the present invention. The temperature profile which is achieved in the food product is based upon a combination of several factors, including hole size "D", the width of the margin "W" between holes, and spacing "$H_1$" of the grid from the surface of the food product, among other factors. The interrelationship of these factors requires each to be maintained within certain ranges in order to achieve the advantages of the present invention. If the spacing "$H_1$" of the grid from the surface of the food product is allowed to vary haphazardly, this factor may be allowed to move outside a range which is required for the present invention. In view of the interrelationship of these factors, dimensional stability including controlled spacing of the grid from the surface of the food product is preferred, and in some instances may be required.

Where openings in the grid have some shape other than a circle, the openings may be described as having a distance between opposing sides which may vary. The maximum distance between opposing sides of the opening may be considered for purposes of the present discussion as a "Y" dimension. A distance between opposing sides which is orthogonal to the Y dimension may be considered as the "X" dimension for purposes of the present discussion. It is preferred that the distance measured along the Y dimension and the X dimension be substantially equal. This avoids susceptibility of the openings to localized polarization of the microwave field. In some instances, susceptibility to polarization may be undesirable and may result in a degradation in the reproducibility of uniform cooking, particularly where a food product is designed to be heated in a large variety of microwave ovens and oven models.

If the X dimension and the Y dimension are not substantially equal, the ratio of the distance between the Y dimension and the X dimension may be referred to as the "aspect ratio" of the opening. It is preferred that the aspect ratio be 2:1 or less. It is more preferred that the aspect ratio be 1.5:1 or less. It is even more preferred that the aspect ratio be 1.1:1 or less.

Grid Lattice Configuration

The grid may have openings arranged in a square lattice configuration, or rectangular lattice configuration, as shown in FIG. 1C. Alternatively, the grid may have openings arranged in a staggered lattice, or equilateral triangular lattice, configuration. Comparable results have been obtained using both lattice configurations. Other grid configurations will also work. For example, a circular array of openings which are aligned radially may be used. For uniform heating, a regular arrangement of equal size openings which are equally spaced from each other is preferred. Any regular repeating pattern may be used. However, in instances where nonuniform heating is desired, irregular arrays using variable sized openings which may be spaced variable distances from each other can be used.

Grid Border Width

Referring to FIG. 1C, the grid 52 has a border "B" around the outer perimeter of the grid 52. The width of this border "B" has an effect upon the temperature profile of the food product 51 associated with the grid 52. This can best be explained with reference to FIG. 24 and FIG. 25.

Figure 24:
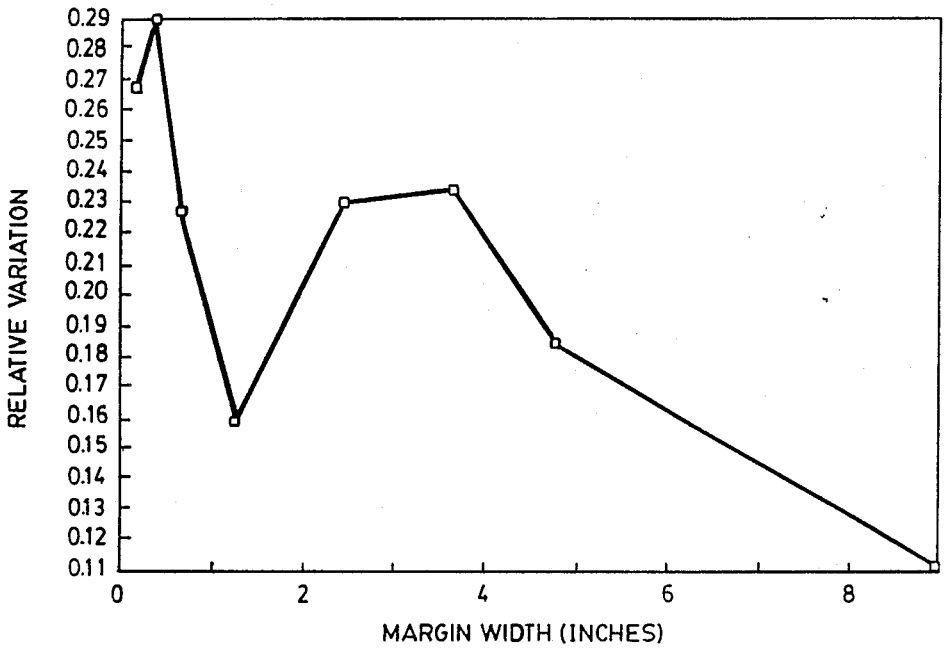
FIG. 24 is a graph depicting temperature variability as a function of the width of the margin of the grid.

FIG. 24 represents experimental results upon the relative uniformity of heating for a high resistivity susceptor heated in a microwave oven with a grid 52 having various width borders "B". A susceptor was used in order to map the electric field strength around the grid 52. A susceptor having a high resistivity was selected to minimize interaction with the grid's electric field. In this experiment, the grid 52 had openings 55 which were about one inch in diameter. A spacing "W" of about ⅛ inch was provided between openings 55. The grid 52 was constructed from aluminum foil laminated to paper board. The relative variation of temperature in the temperature profile of the food product 51 varied with the width of the border "B". The variation is believed to correlate with the wavelength of the microwave radiation in the microwave oven. The preferred width for the border "B" is about ½λ, where λ is the wavelength of the microwave radiation. At a microwave oven frequency of 2.45 GHz, a border "B" of 1.2 inches is most especially preferred. In FIG. 24, the uniformity of the temperature profile in the grid 52 is best at a border width "B" of about 1.2 inches, or borders "B" which are greater than about 5 inches. A border width "B" greater than 5 inches may be impractical for many microwave packages.

Figure 25:
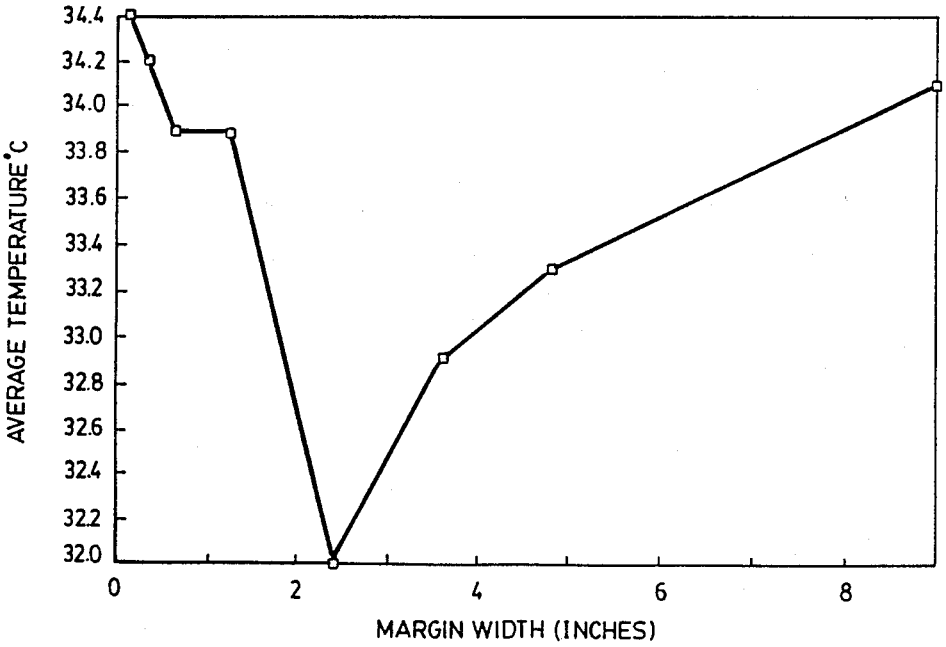
FIG. 25 is a graph depicting average temperature as a function of the width of the margin of the grid.

FIG. 25 shows that at a preferred border width "B" of about 1.2 inches, the average temperature remains satisfactory.

FIGS. 24 and 25 show that a border width "B" of about ½λ, in this example about 2.4 inches, should be avoided. When the border width "B" approaches ½λ, the relative variation, or nonuniformity, of the temperature profile increases, and the average temperature decreases. The simultaneous occurrence of both of these effects is undesirable for most applications.

A border width "B" of 0.5 inch or greater may give useful results in many applications. A border width "B" of about 0.5 inch to about 1.8 inches is preferred. A border width "B" of about 0.9 inch to about 1.4 inches is more preferred. A border width "B" of about 1.0 inch to about 1.3 inches is even more preferred. A border width "B" of about 1.1 inches to about 1.25 inches is even more preferred.

It is desirable to have a border "B" which is at least about ⅛ inch, or 0.125 inch, and is considered to be a minimum which must be provided in the grid 52. A grid 52 with a narrower border exhibits intensified heating in the area of the openings 55 near the outer edge 57 of the grid 52. In most applications, this is undesirable. The minimum border "B" of about ⅛ inch is dictated in part because smaller border widths are impractical due to the difficulty of manufacturing a practical grid 52 which would maintain its mechanical integrity without conductivity breaks along the edge 57 of the grid 52. A border width "B" less than 0.5 inch is not preferred unless it is desirable to intensify the temperature profile of the outer edge 59 of the food product 51. A border "B" which is less than 0.5 inch will tend to interfere with heating near the edge 57 of the grid, and may intensify the heating of the openings 55 closest to the edge 57. It is conceivable that a grid 52 may be constructed having no border, i.e., the width "B" would be equal to zero. In this case, the grid could be constructed so that the outermost edge of the grid cut through a row of openings. Intensified heating in the area of the openings near the outer edge of the grid would result in such a case.

In some applications where larger size packages are practical, a border width "B" which is about 4 inches or greater may provide satisfactory results. In such an application, a border width "B" which is 5 inches or more would be more preferred. In such an application, a border width "B" greater than or equal to 6 inches would be even more preferred.

The border width "B" should be measured between the edge 57 of the grid 52 and the closest edge of an opening 55, as shown in FIG. 1C. In some applications, it may be desirable to have different border widths "B" for different edges 57 of the grid 52. For example, if it is desirable to emphasize heating along one edge 57 of the grid 52, the border "B" may be made narrow along that edge, as compared to other edges of the grid. Thus, the border "B" along one edge of the grid would have a narrower effective width than other edges of the grid. If the edge 57 of the grid 52 is folded over, for example, as shown in FIG. 34E, the border width "B" is treated as including the conductive side walls.

Variable Size Openings In A Grid

The size of the openings 93 may be varied across the area of the grid 91. For example, openings 93 in the center of the grid 91 may be larger than openings 93 around the edges of the grid 91. This use of graduated sized openings 93 may be used, for example, to increase heating in the center of the food product 51. This technique may be further used to adjust the temperature profile of the food product 51. This technique may be used where a grid 52 is in contact with a food product 51, as shown in FIG. 1A, and may be used where a grid 91 is spaced a distance from a food product 51, as shown in FIG. 32A.

Figure 26:
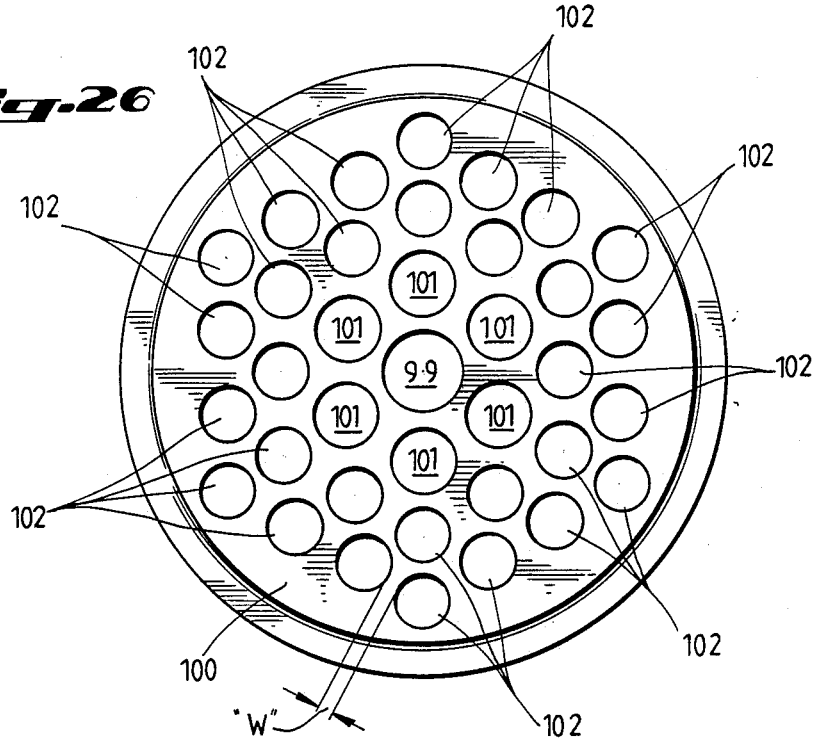
FIG. 26 is a top view of a grid having larger openings in the center surrounded by smaller openings.

Similarly, in the embodiment illustrated in FIG. 1A, the size of the openings 55 in the grid 52 may be varied across the area of the grid 52. This is illustrated in FIG. 26. In this example, larger openings 99 are provided in the grid 100. The larger openings 99 are provided in the center of the grid 100. Immediately adjacent thereto, and surrounding the center area of the larger openings 99, is a ring of medium openings 101. Immediately adjacent to the area defined by the medium openings 101 is provided a plurality of smaller openings 102, which are arranged in a generally ring-shaped region surrounding the area of the medium openings 101.

In the example illustrated in FIG. 26, the larger opening 99 in the center of the grid 100 had a diameter of about 0.75 inch. The ring of medium openings 101 surrounding the center opening 99 had a diameter of about 0.625 inch. The plurality of smaller openings 102 each had a diameter of about 0.5 inch. The openings 99, 101 and 102 had a spacing W which was intended to remain roughly constant between the openings, and which ranged from about 0.1 inch to about 0.2 inch.

Figure 27:
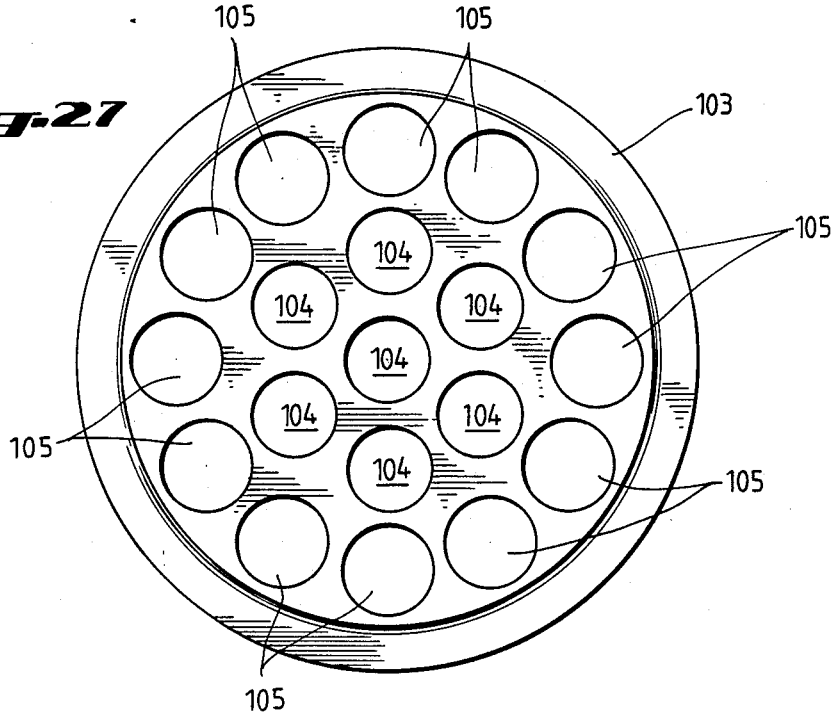
FIG. 27 is a top view of a grid having smaller openings in the center surrounded by larger openings.

FIG. 27 illustrates an example of a grid 103 having larger holes 105 around the outside of the grid 103. Smaller openings 104 are provided in the region of the center of the grid 103. In the illustrated example shown in FIG. 27, the larger openings 105 around the outside of the grid 103 have a diameter of about ⅞ inch or 0.875 inch. The smaller openings 104 in the region of the center of the grid 103 have a diameter of about 0.75 inch.

Figure 28:
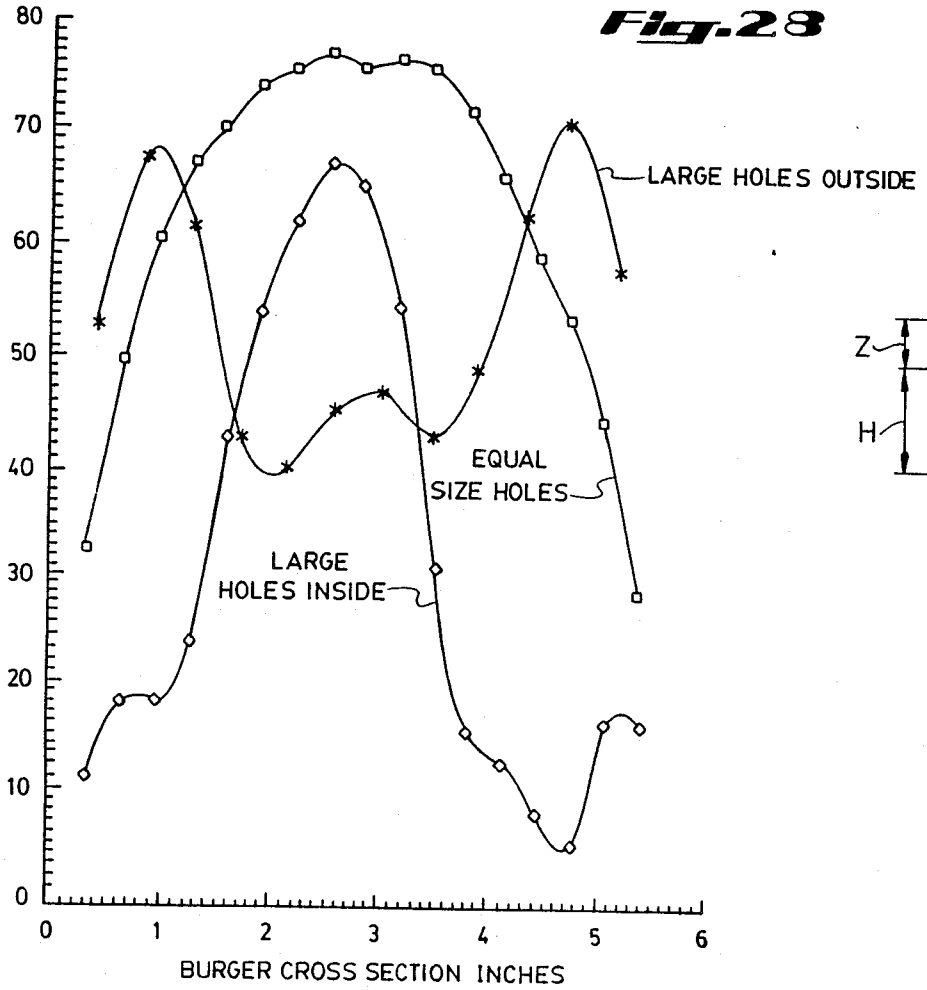
FIG. 28 is a graph depicting the heating profile for food products heated in a microwave oven using a grid constructed in accordance with FIG. 26, a grid constructed in accordance with FIG. 27, and a grid having equal size openings.

The grid 100 shown in FIG. 26 was placed adjacent to, or in contact with, hamburger meat 51, as shown in FIG. 1A, and exposed to microwave radiation. The temperature profile was measured, and is shown in FIG. 28. The curve marked "Large Holes Inside" depicts the temperature profile measured for the examples using the grid 100 shown in FIG. 26. Similarly, the grid shown in FIG. 27 was used in connection with a hamburger patty 51, and the combination was heated in a microwave oven. The temperature profile which resulted is depicted in FIG. 28 by the curve labeled "Large Holes Outside." FIG. 28 compares the two temperature profiles produced using the grid 100 shown in FIG. 26, and the grid 103 shown in FIG. 27, with a grid 52 having equal size openings 55. The temperature profile for the grid 52 having equal size openings 55 is plotted in FIG. 28 in the curve which is labeled "Equal Size Holes."

FIG. 28 demonstrates that the temperature profile which is established in the food product 51 may be adjusted by changing the relative size of the openings 55 in the grid 52. By making larger holes 99 and 101 in the center of the grid 100, the temperature profile of the center 60 of the food product 51 may be increased, while the temperature profile of the edges 59 of the food product 51 may be decreased, relative to each other. Conversely, by providing larger holes 105 around the outer portion of the grid 103, and by providing smaller holes 104 in the center region of the grid 103, the temperature profile of the food product 51 may be adjusted in the opposite direction. The temperature of the center 60 of the food product 51 may be reduced, and the temperature of the edges 59 of the food product 51 may be increased, relative to each other.

It will be appreciated that the apertures 99, 101 and 102 in the grid 100 shown in FIG. 26 are arranged in a triangular lattice configuration, or staggered lattice configuration. The openings 104 and 105 in the grid 103 are similarly arranged in a triangular lattice configuration, or staggered lattice configuration. Comparable results may be obtained using a square lattice configuration.

Achieving Consumer Tolerance

A basic goal in the design of a combination package and food system for use in consumer microwave ovens, is to have the product perform acceptably in all consumer ovens. A number of variables are beyond the control of the manufacturer of the microwaveable food product. These factors include the uniformity of the field in the oven cavity, wattage of the microwave oven, the feed mechanism of the oven, the size of the oven cavity, and the relative location of the shelf in the microwave oven with respect to the microwave oven cavity. "Consumer tolerance" is intended to refer to the ability of a package and food system to produce acceptable results in most if not all consumer microwave ovens, in view of the lack of control over the above-described variables. The present invention achieves significant advances in consumer tolerance.

One of the basic problems which must be faced in mass producing foods to be heated in microwave ovens by consumers is that many microwave oven models do not have uniform field strength within the oven cavity. Manufacturers have used different techniques in an effort to achieve uniform field strength, including various methods of feeding microwave energy into the oven cavity, various oven cavity designs, mode stirrers, and product turntables, in an effort to provide more uniform heating of food products. Designing a product for microwave preparation in various consumer ovens is difficult because of the range of oven designs which currently exist. The present invention provides a means for designing a microwave package which provides uniformity of heating and reproducible results, relatively independent of oven design.

Nonuniform heating can sometimes be most significant in low power compact ovens. Foods such as brownies, which are sensitive to hot spots and cold spots which may be present in a nonuniform electromagnetic field, often produce unsatisfactory results in such microwave ovens.

A set of six low power compact ovens were tested with brownies heated using a grid constructed from 1 inch diameter holes having a spacing of 1⅛ inches between the centers of the holes. In this example, the holes were circular, and were arranged in a square lattice configuration. Conductive side walls were also provided around the brownies.

Table II is a summary of the results.

TABLE II

| | | Effect of Grid in Compact Ovens | | | | |
|---|---|---|---|---|---|---|
| | | | Temp. Variability | | Hardness Score | |
| Oven | Power | Feed Mechanism | w/o grid | w/grid | w/o grid | w/grid |
| Penney's | 500 W | Top stirrer | 2.6 | 1.8 | 11.5 | 9 |
| K-Mart | 550 W | Top turntable | 3.6 | 2.6 | 19.5 | 4 |
| Quasar | 425 W | Bottom rotating horn | 2.2 | 1.2 | 8.5 | 3 |
| Kenmore | 400 W | Top, no stirrer | 1.6 | 1.8 | 2.5 | 2.5 |
| Sharp ½ pt | 400 W | Top, with stirrer | 3.0 | 1.6 | 12.5 | .5 |
| Emerson | 400 W | Top direct, no stirrer | 6.2 | 2.4 | 9.5 | 5 |
| Average | | | 3.2 | 1.9 | 10.7 | 3.3 |

Figure 19:
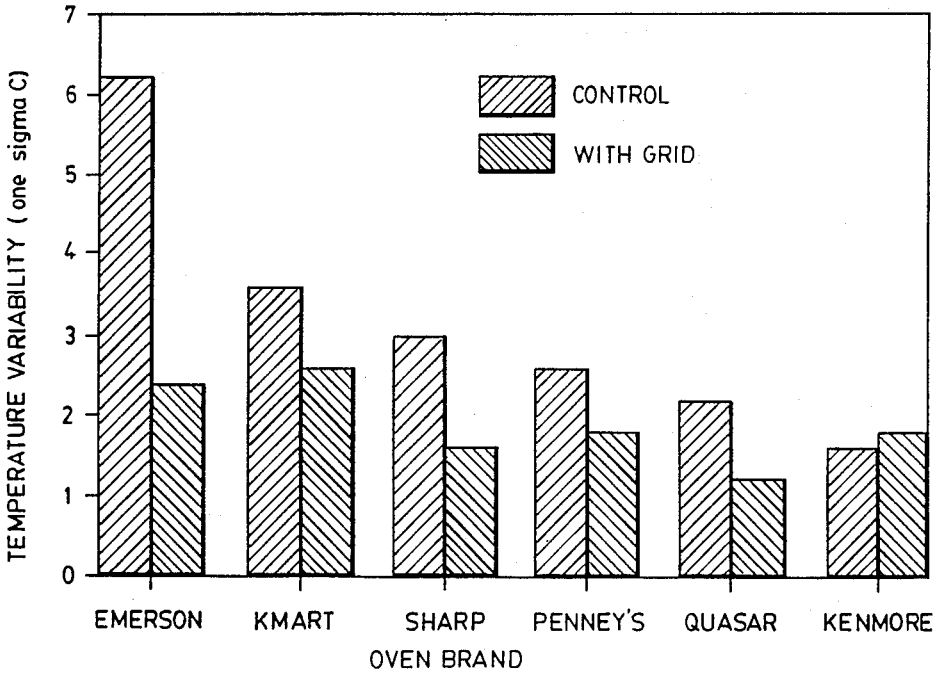
FIG. 19 is a bar graph comparing the temperature variability of heating in several microwave oven models, comparing brownies cooked with and without using a package constructed in accordance with the present invention.

Each observation shown in Table II is an average of two experimental measurements. The column in Table II labeled "Temp. Variability" is the standard deviation of the temperature variation measured across the surface of the brownies. The relevant surface is the opposing surface of the brownies facing the grid. The hardness score was assigned by a panel of tasters. The results of the temperature variability measurements, which are a measure of the uniformity of heating of the brownies, are shown graphically in FIG. 19.

On average, the grid and conductive ring combination constructed in accordance with the present invention provided a 41% uniformity improvement in heating, and far fewer hard spots in the brownies, than was the case with brownies cooked without utilizing a grid/ring combination. The most significant improvement occurred in microwave ovens which had the poorest uniformity without the grid/ring combination of the present invention.

Criticality Of Heating Time

The present invention may also be used to reduce the criticality of the microwave heating time required for a particular food product. If the length of time is small between the point in time when a product is undercooked and the point in time when a product is overcooked, the microwave heating time is said to be "critical." This "window" of time should preferably be as broad as possible. "Cook tolerance" may be defined as the breadth of the time window when baking a product in a microwave oven during which the product has an acceptable quality. Because of the differences in microwave oven design and power capabilities of various microwave ovens, microwave recipe directions are extremely difficult to specify. In particular, microwave brownies have a very narrow cook tolerance, but require microwave heating times from 3.5 to 4.5 minutes, depending on the power of the microwave oven. Microwave brownies are adequately cooked when wet batter spots disappear, and are overcooked when hard spots begin to form in the brownies. In a nonuniform microwave oven, inadequately cooked wet batter spots and overcooked hard spots may coexist in a single pan of brownie mix prepared in a microwave oven.

FIG. 20 is a graph depicting the results of an experiment performed on brownies where the microwave cook time was varied from 2.5 minutes to 8 minutes in ½ minute increments. Temperature uniformity, hardness scores and raw scores were evaluated with and without a grid/ring constructed in accordance with the present invention. A relatively nonuniform field microwave oven was used. The grid/ring employed was a grid having 1 inch diameter circular holes, with a spacing of 1½ inch between the centers of the holes. The grid consisted of a 7×7 hole array which was the same size as the pan used to heat the brownies. FIG. 20 shows the increase in hardness scores with cook time. At 4.5 minutes, the hardness score was 19 for the control brownies cooked without using a grid/ring package. With the grid/ring package, a hardness score of 19 was not reached until 5.75 minutes of microwave cooking. Raw spots disappeared in both microwave brownies after cooking for 4 minutes. In this example, the grid/ring package in accordance with the present invention provided a cook tolerance window which was 3.5 times broader.

Embodiment Useful In A Commercial Fast Food Establishment

Figure 30A:
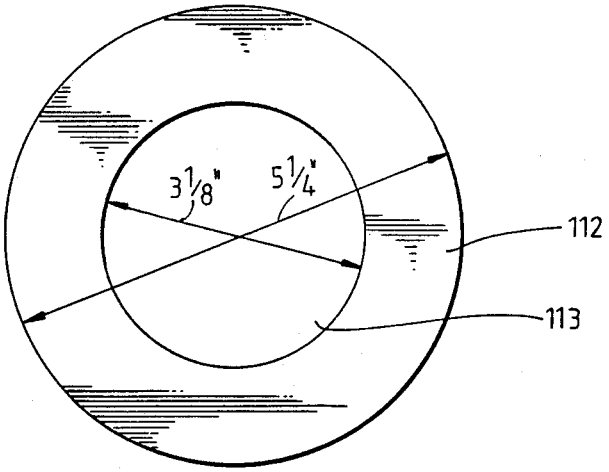
FIG. 30A is a top view of the conductive sheet used with the top of the container shown in FIG. 29.
Figure 30B:
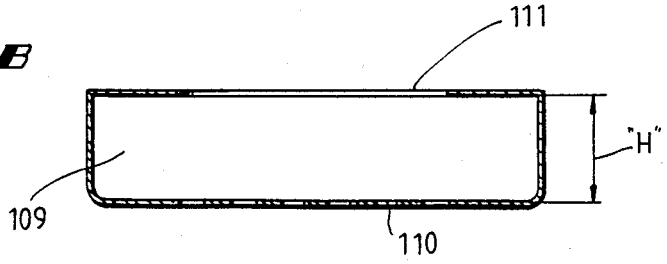
FIG. 30B is a cross-sectional side view of the conductive ring shown in FIG. 29.
Figure 29:
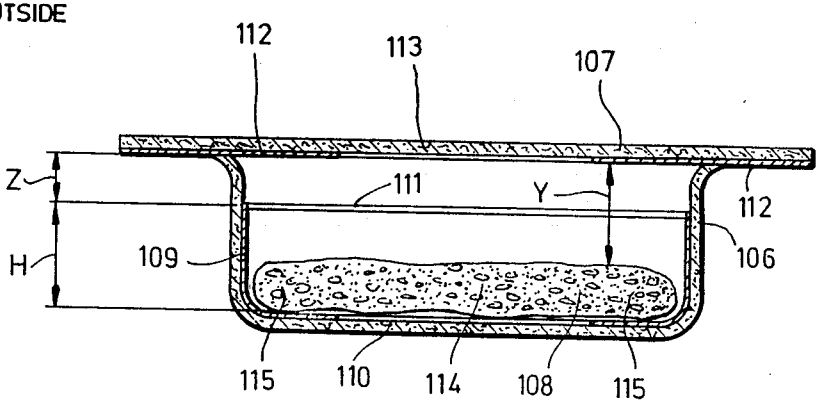
FIG. 29 is a cross-sectional side view of an embodiment of the invention having particularly useful application is a commercial fast food establishment.

An advantageous application of the present invention is shown in the embodiment illustrated in FIG. 29, FIG. 30A and FIG. 30B. This embodiment is particularly useful in connection with the heating of meat such as hamburger patties in a commercial fast food establishment.

In this example, a conventional preexisting infrared heating device may be available. Hamburger patties are conveniently stored in a frozen condition at about −5° F. Hamburger patties are removed from refrigerated storage and placed upon a moving belt, which conveys the hamburger patties through a flame broiler. The temperature of the infrared heater, the length of travel through the flame broiler, and the time of exposure have all been adjusted to properly cook a standard size hamburger patty. In this example, a standard size hamburger patty was about ⅜ inch thick, and about 4.625 inches in diameter. Once the conventional cooking device had been optimized for properly cooking standard size hamburger patties, re-adjustment of the device was impractical. For example, an oven temperature of about 1000° F. and a cook time of about 90 seconds may properly heat a hamburger patty which is only about ⅜ inch thick (e.g., 155° F.±10° F.), but would produce unsatisfactory results in a significantly thicker hamburger patty.

It became desirable to provide a choice of larger hamburgers for consumers. However, in a commercial fast food establishment, hamburger patties are stored in a frozen condition at about −5° F. When a customer order is received, the hamburger meat must be brought from a frozen condition to a fully cooked condition within a few minutes, preferably less than three minutes, so that it may be quickly served to the customer. One important feature of a commercial fast food establishment is that the establishment must quickly provide food on demand. In order to cook a hamburger patty which is ¾ inch thick, about 4.625 inches in diameter, and weighs about 167–169 grams, some means was needed to provide for the proper cooking of such a substantially thicker frozen hamburger patty without requiring significant investment in new equipment or redesign of the conventional cooking device.

A predetermined temperature profile may be established in the ¾ inch thick hamburger patty using the present invention, so that when the resulting ¾ inch thick preheated hamburger patty is then inserted into the preexisting conventional flame broiler, the thicker hamburger patty will emerge from the end of the cooker in a properly cooked condition. A differentially heated temperature profile was needed having a cold periphery and evenly warm interior, in order to achieve optimum performance in combination with a flame broiler. This may be accomplished by using the microwave cooking package illustrated in FIG. 29, FIG. 30A and FIG. 30B.

Referring to FIG. 29, the microwave cooking package comprises a plastic bowl 106 with a plastic top 107 sealingly engaged therewith. The plastic bowl 106 is generally cylindrical in shape, has a circular cross-section and has a diameter of about 4.75 inches. The bowl 106 is adapted to receive a hamburger patty 108. The hamburger patty 108 is about ¾ inch thick, and has a diameter of about 4.625 inches.

The plastic bowl 106 is provided with a circular conductive ring 109 which encircles the sides of the hamburger patty 108. The conductive ring 109 may be formed as an insert to the bowl 106, and is preferably made of aluminum.

The conductive ring 109 is shown more particularly in FIG. 30B. The conductive ring 109 has an aperture 110 in the bottom of the conductive ring 109. The top 111 of the conductive ring 109 is open. In other words, the opening 111 in the top of the conductive ring 109 is equal to the diameter of the conductive ring 109. The conductive ring 109 preferably has a wall thickness of about 1/16 inch. The height "H" of the ring 109 is preferably about 1⅜ inches (1.375 inches). The opening 110 in the bottom of the conductive ring 109 preferably has a diameter of about 3⅛ inches. The diameter of the conductive ring is about 4.75 inches.

The plastic top 107 for the bowl 106 is provided with a conductive sheet 112 bonded thereto. The conductive sheet 112 is shown more clearly in FIG. 30A. The conductive sheet 112 is generally planar, and has an aperture 113 in the center thereof. The aperture 113 preferably has a diameter of about 3⅛ inches. The total diameter of the conductive sheet 112 shown in FIG. 30A is preferably about 5¼ inches.

Referring to FIG. 29, the conductive sheet 112 is preferably spaced a distance "Y" from the surface of the hamburger patty 108 of about 1 inch. The planar conductive sheet 112 is preferably oriented in a plane substantially parallel to the surface of the hamburger patty 108. In the illustrated example, the aperture 110 in the bottom of the conductive ring 190 is aligned concentrically with the aperture 113 in the conductive sheet 112. In the illustrated example, a gap shown as "Z" in FIG. 29 is provided between the conductive ring 109 and the conductive sheet 112. Because the bowl 106 is generally transparent to microwave radiation, the gap "Z" provided in the microwave package allows some microwave radiation to enter during microwave heating.

In this example, it is desirable to adjust the temperature profile of the hamburger patty 108 so that the hamburger patty is warmer in the center 114 than in the sides 115. A center temperature of about 110° F. to about 120° F., and side temperatures of about 80° F. to about 90° F., are desirable for the microwave heating step in order to achieve good results in the subsequent broiler heating step. This emphasis of heating of the center 114 of the relatively thick hamburger patty 108 during microwave preheating is desirable in order to result in even heating of the hamburger patty 108 after it emerges from the conventional flame broiler cooking device.

Table III summarizes temperature measurements taken for a number of hamburger patties which were measured experimentally. In the example summarized in Table II, hamburger patties 108 were removed from a freezer. The temperature in the center and left side and right side were measured. The hamburger patty was then placed inside the plastic container 106, the lid 107 was closed thereon, and the container placed into a microwave oven. A Litton Model FS-14EVP microwave oven (power output 1400 watts) was used.

TABLE III

| | WITH CONDUCTIVE SHEETS | | | NO CONDUCTIVE SHEETS | | |
|---|---|---|---|---|---|---|
| | Side | Center | Side | Side | Center | Side |
| Initial Temp. | 2 | 2 | 2 | 2 | 2 | 2 |
| St. Dev.: | — | — | — | — | — | — |
| Microwave Temp. | 88.0 | 116.9 | 89.8 | 165.5 | 71.5 | 170.9 |
| St. Dev.: | 11.7 | 9.7 | 10.8 | 20.0 | 14.6 | 20.6 |
| Broiler Temp. | 151.1 | 159.3 | 160.3 | 168.4 | 111.5 | 154.6 |
| St. Dev.: | 7.9 | 10.9 | 14.4 | 14.7 | 10.9 | 21.4 |

The hamburger patty was exposed to microwave radiation at full power for one minute. In this example, the hamburger patties were heated with the combination of the conductive sheet 112 and conductive ring 109, and were also heated using the plastic bowl 106 and plastic top 107 without any conductive sheets 112 or 109 therein. At the conclusion of the microwave heating step, the plastic bowl 106 was opened, the hamburger patty removed, and the temperature measured again for the center, the right side and the left side.

After microwave heating, the hamburger patties were placed in the conventional flame broiler cooking device. When the hamburger patty exited the flame broiler cooking device, an operator would wait one minute and then take the temperature of the center, left side and right side of the hamburger patty. The results summarized in Table III under the column labeled "WITH CONDUCTIVE SHEETS" represent an average of 76 measurements made using 76 hamburger patties. The standard deviation for each averaged measurement is provided. The results summarized in Table III under the column labeled "NO CONDUCTIVE SHEETS" represent the average of 25 measurements made upon 25 hamburger patties.

As shown in Table III, the temperature of the center 114 of the hamburger patty 108, in the example which did not use the conductive sheets 112 and 109, was too low as compared with the temperature of the sides 115. This underheating of the center 114 resulted in an undesirably low temperature for the center 114 when the hamburger patty 108 emerged from the conventional flame broiler device. The center 114 was inadequately heated, resulting in a very poor product.

Using the present invention, Table III shows that the temperature profile of the hamburger patty 108 was adjusted to provide for substantially more heating of the center 114 as compared with the sides 115 of the hamburger patty 108 during microwave heating. A hamburger patty 108 which was heated to provide such a predetermined temperature profile then emerged from the conventional flame broiler device with a relatively uniform temperature. The center 114 was adequately heated.

Thus, it will be appreciated that the present invention may be utilized to adjust the temperature profile of a food product. Such an adjustment may provide for a nonuniform temperature profile which emphasizes heating of the center of the food product, or the edges of the food product, or some other specific area of the food product relative to another area. This may be desirable, particularly where microwave heating is just one portion of the total heating operation, for example, where microwave heating is followed by a conventional heating step. The combination of microwave heating utilizing the present invention with a conventional heating step can provide significant advantages, such as the rapid preparation of food with very satisfactory results. The temperature profile of the food product as it emerges from the microwave heating step can be adjusted to provide a desired final temperature profile upon completion of the conventional heating step. Combination heating may also include a process where microwave heating and conventional heating occur simultaneously.

A presently preferred embodiment of the apparatus for prewarming the hamburger patty 108 would use a plastic top 107 without a conductive top 112. Otherwise, the presently preferred embodiment would be the same as that described above with reference to FIG. 29 and FIG. 30B.

The conductive sheet 112 may be replaced by a grid. Similarly, a grid may be substituted for the aperture 110. The grid may also assume alternative embodiments from the grids illustrated above, while still benefiting from the advantages of the present invention. While the previous discussion of grids has primarily been directed to an embodiment utilizing circular openings in the grids, the openings may also be hexagonal, square, rectangular or other shapes. Using hexagonal shaped openings in the grid, it was surprisingly discovered that more heating occurred for a grid with hexagonal openings which actually had less percentage open area than a grid with circular openings which was used for comparison. Graduated size openings may similarly be used with hexagonal shaped openings in the grid. For heating hamburgers, graduated size hexagonal openings in a grid where larger openings are provided in the center of the grid have produced results which are generally satisfactory for the commercial fast food establishment example described above with reference to FIG. 29, FIG. 30A and FIG. 30B. An example of a preferred hexagonal grid 116 is shown in FIG. 31.

Figure 31A:
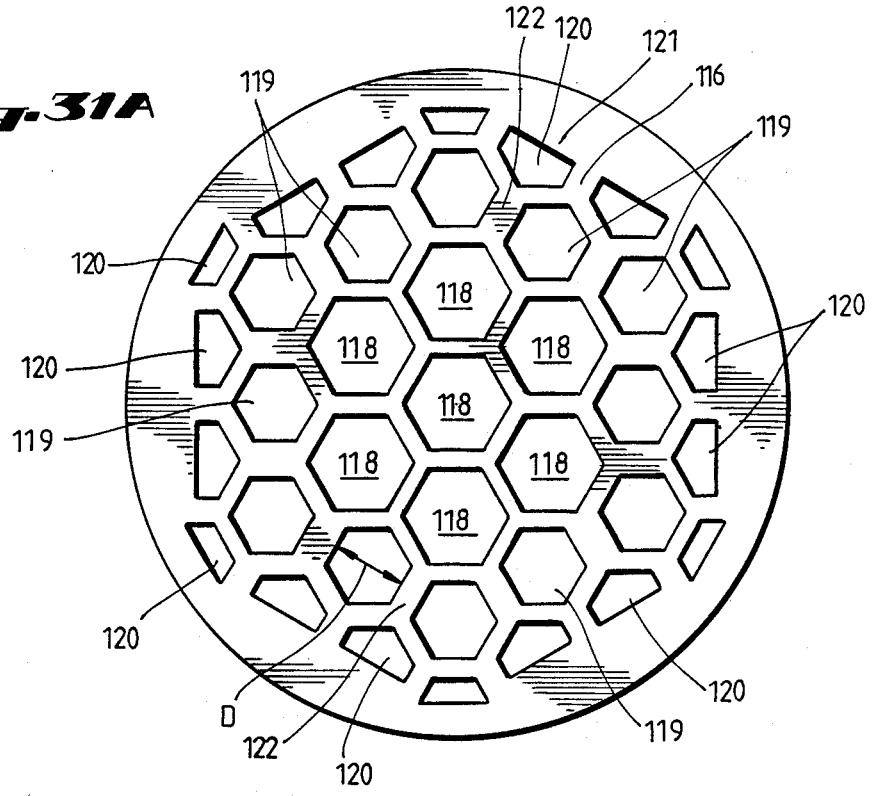
FIG. 31A shows a top view of a preferred grid having hexagonal shaped openings therein.

In this example, the top conductive sheet 112 and aperture 113 were replaced with a grid 116 constructed in accordance with FIG. 31A. The bottom aperture 110 was replaced with a grid 117 constructed in accordance with FIG. 31B. In this example, an emphasis of the heating of the center 114 of the hamburger patty 108 was desired for the reasons described above. Therefore, the grid 116 had a center area having a plurality of larger openings 118 surrounded by an outer area having smaller hexagonal openings 119. Partial hexagonal openings 120 are provided in the area immediately adjacent to the border 121 of the grid 116. The hexagonal openings 118, 119 and 120 are cut in a sheet of aluminum foil, which forms conductive margins 122.

The hexagonal openings 118, 119 and 120 have a size which may be characterized as the distance "D" between opposing parallel sides of the hexagonal opening, as shown in FIG. 31A.

In the preferred example shown in FIG. 31A, the larger hexagonal tuned openings 118 preferably have a size of about 0.75 inch. The smaller hexagonal tuned openings 119 preferably have a size of about ⅝ inch, or 0.625 inch. The partial hexagonal openings 120 are the same size as the small hexagonal openings 119, with the exception that the openings 120 are only partial, or truncated, hexagonal shapes.

The larger hexagonal tuned openings 118 are positioned in a plane parallel to and over an area corresponding to the area of the food product 108, the heating of which is desired to be emphasized. The smaller size tuned hexagonal openings 119 are positioned in a plane substantially parallel and over an area corresponding to the area of the surface of the food product 108, the heating of which is desired to be less emphasized as compared to the area covered by the larger hexagonal opening 118.

Figure 31B:
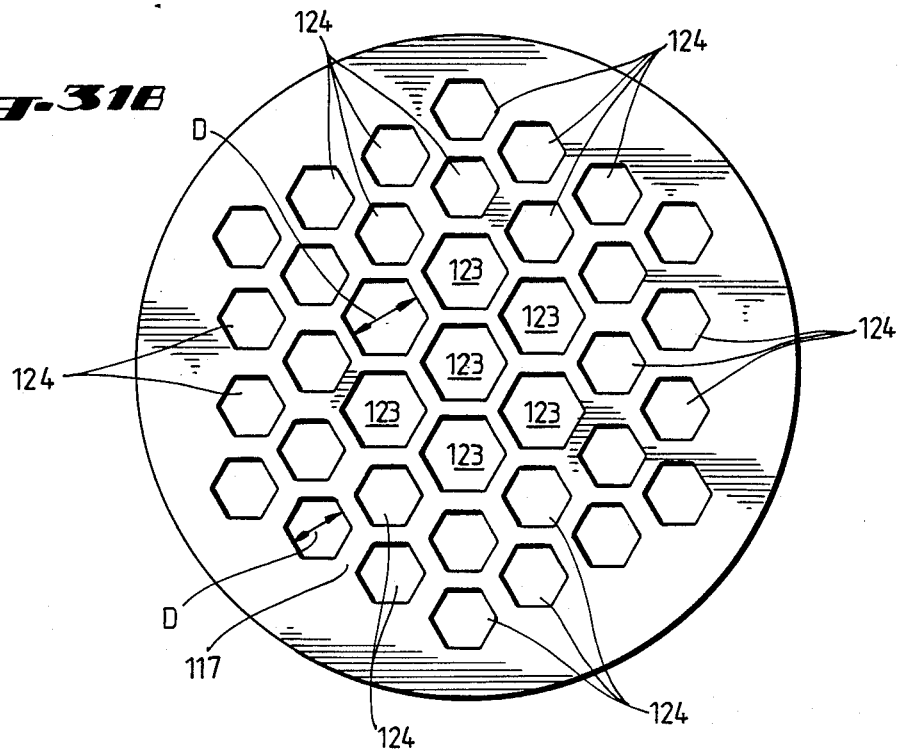
FIG. 31B shows a top view of an alternative embodiment of a grid having hexagonal shaped openings therein.

FIG. 31B shows a preferred grid configuration for heating the food product 108 shown in FIG. 29 which is used to replaced the aperture 110 in the bottom of the bowl apparatus 106. The grid 117 similarly has larger tuned hexagonal openings 123 in the center region surrounded by smaller tuned hexagonal openings 124.

Conductive Ring

FIG. 4 illustrates a technique for adjusting the temperature profile of a food product 51 when overheating of the outer edges 59 of the food product 51 is a problem. Edge overheating can be a problem with food products 51 having a high dielectric loss factor E″.

In the illustrated example, a conductive ring 98 is placed around the food product 51. The conductive ring 98 is preferably immediately adjacent to and in contact with the outer edge 59 of the food product 51. The conductive ring 98 provides a boundary condition which is believed to have an effect upon the microwave field in the microwave oven. The conductive ring 98 reduces the edge heating of the food product 51.

While the conductive ring 98 illustrated in FIG. 4 is round, the term "conductive ring" as used herein is not limited to round structures. Any conductive surface which is provided adjacent to and in close proximity with an outer edge 59 of a food product 51 may function as a conductive ring in accordance with the present invention. Preferably, the conductive surface surrounding the food product forms an electrically continuous loop around the food product. However, the loop formed by the "conductive ring" need not be circular. Conductive side walls may form a "conductive ring" which when viewed in a direction transverse to the direction of propagation of the microwave radiation may be square in shape, or may have some other configuration. Thus, the term "conductive ring" is not limited to circular structures.

A conductive ring may also be used in combination with a grid or iris. It is preferred that the conductive ring should extend from the plane of the grid or iris to the plane of the surface which is opposite the surface which opposes the grid, or is adjacent to the grid. The spacing of the conductive ring from the edges of the food product should preferably be about 0.75 inch or less. It is more preferred that the conductive ring be in contact with, or closely adjacent to, the edge of the food product.

Dielectric Properties Of Food

Figure 21A:
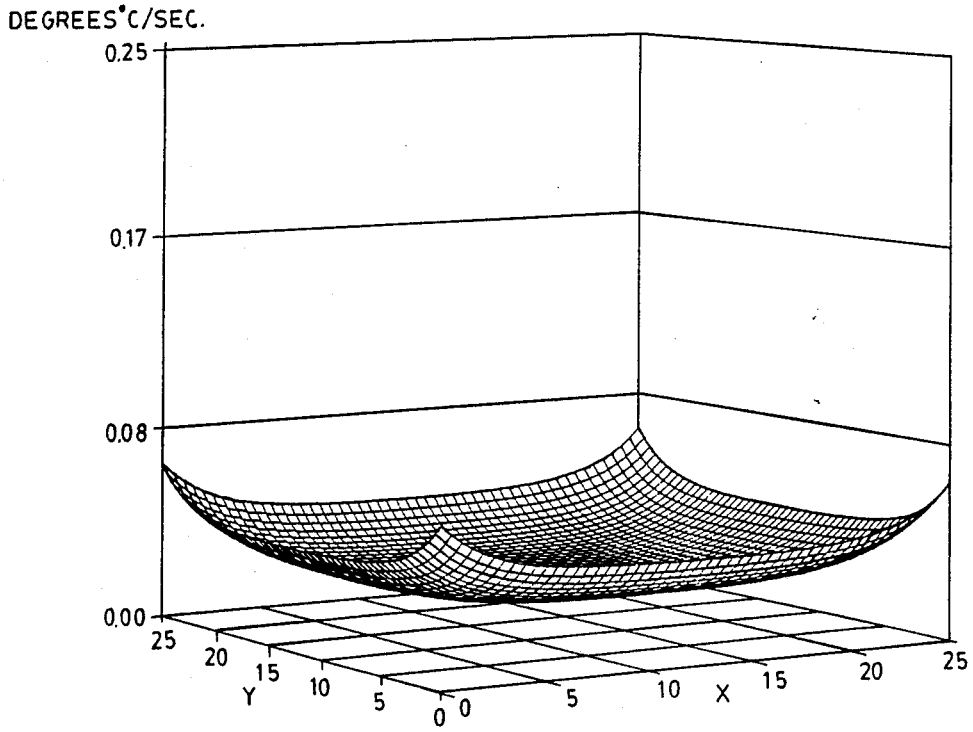
FIG. 21A is a three-dimensional contour plot showing a computer simulation for microwave heating of a food product having a dielectric loss factor E″ of 1.8.
Figure 21B:
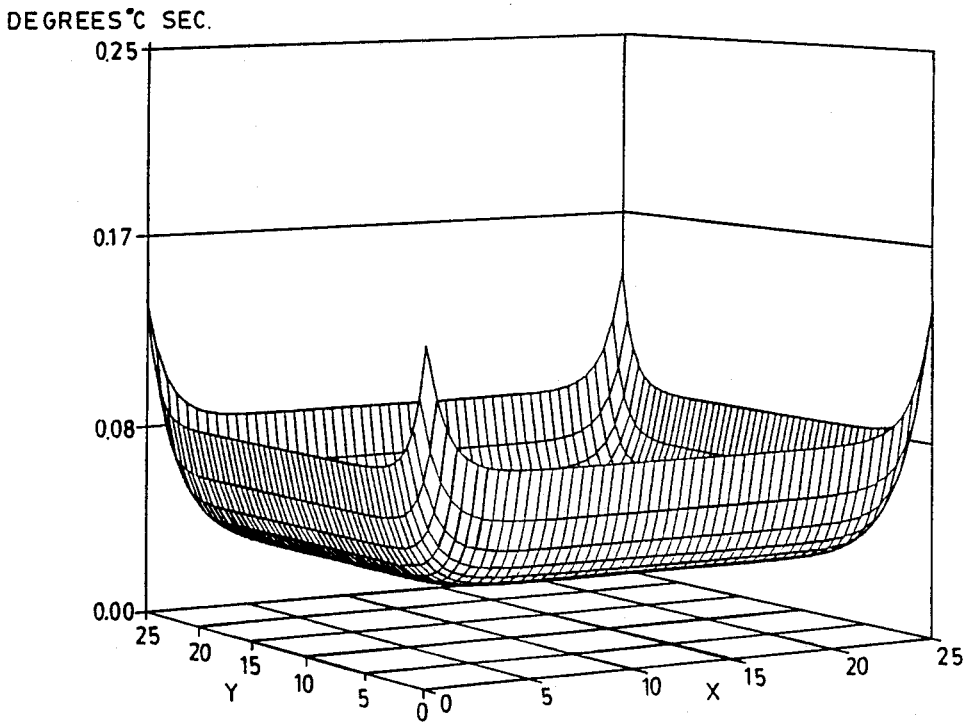
FIG. 21B is a three-dimensional contour plot similar to FIG. 21A, where the dielectric loss factor E″ is 4.1.
Figure 21C:
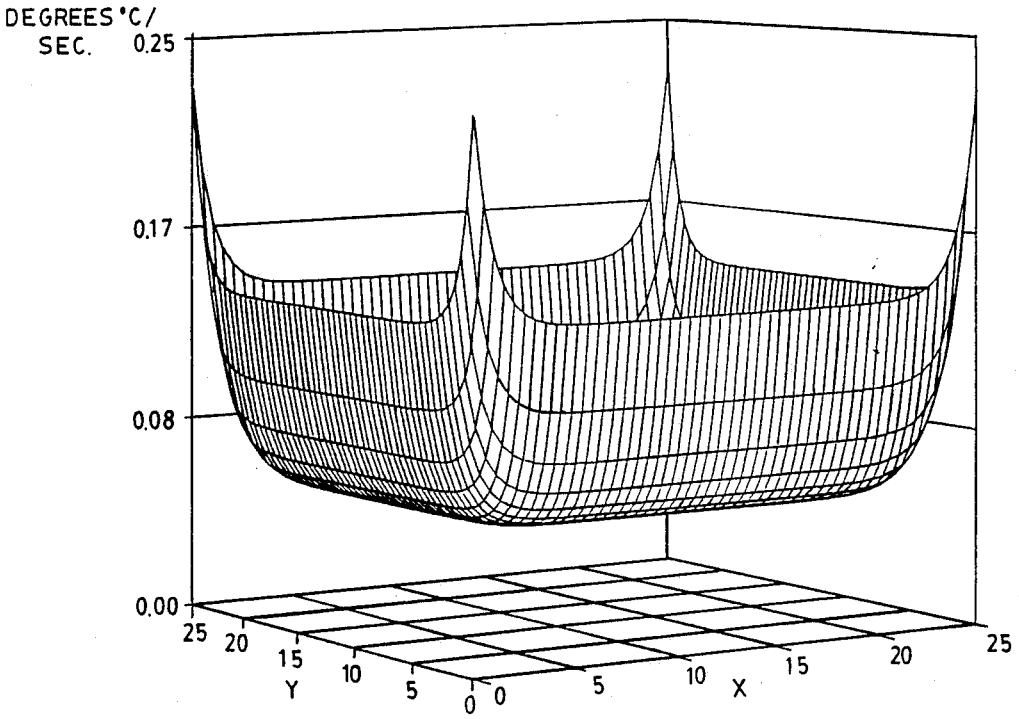
FIG. 21C is a three-dimensional contour plot similar to FIGS. 21A and 21B, where the dielectric loss factor E″ is 9.2.

FIGS. 21A, 21B and 21C illustrate the effect that the dielectric loss factor E″ has upon the tendency of a food product to suffer from the problem of edge heating. FIG. 21A is a three-dimensional graph showing the rate of heating of a food product across a planar surface. In FIG. 21A, the dielectric loss factor E″ is 1.8. While the rate of heating around the edges of the food product is somewhat faster than the center, the food product tends to heat somewhat uniformly over its surface.

FIG. 21B is a graph similar to that shown in FIG. 21A, but in this example, the dielectric loss factor E″ is 4.1. The rate of heating around the edges is much faster than in the center. The problem of edge heating is even more significant in the example shown in FIG. 21C, where the dielectric loss factor E″ is 9.2. The graphs of FIGS. 21A, 21B and 21C were produced using a computer simulation. However, the results tend to agree with experimental observations.

Figure 22B:
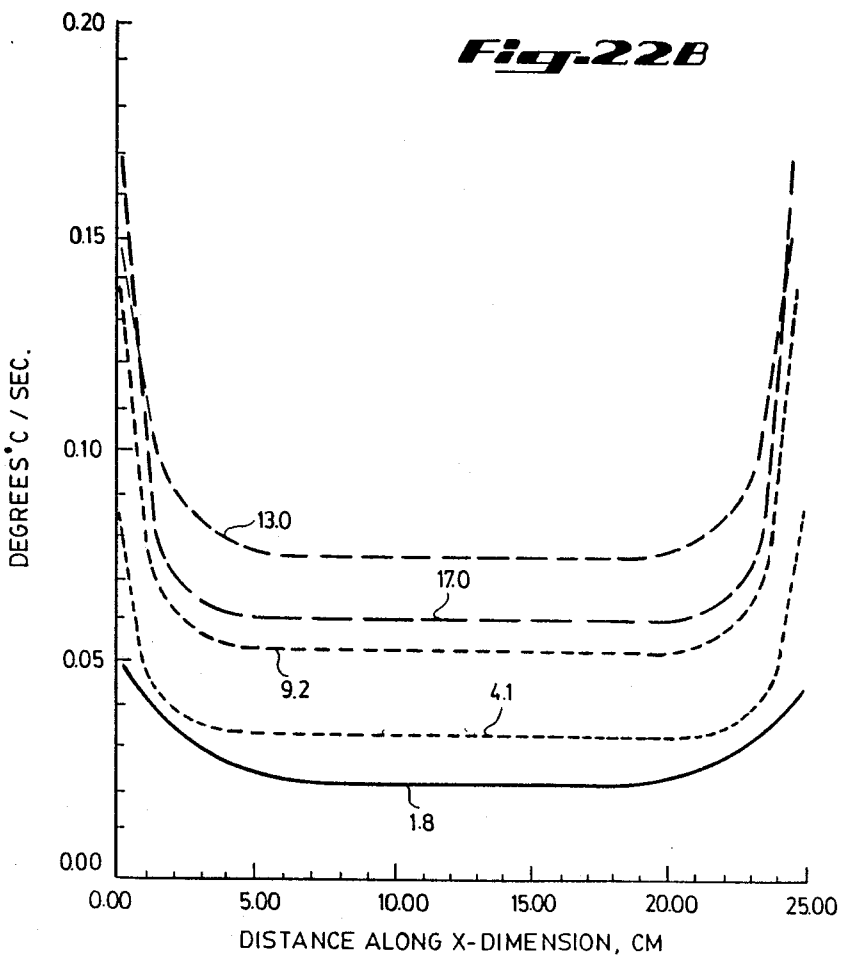
FIG. 22B is a graph depicting rate of heating through the center of a cross-section of various samples of food products having different dielectric loss factors.
Figure 22A:
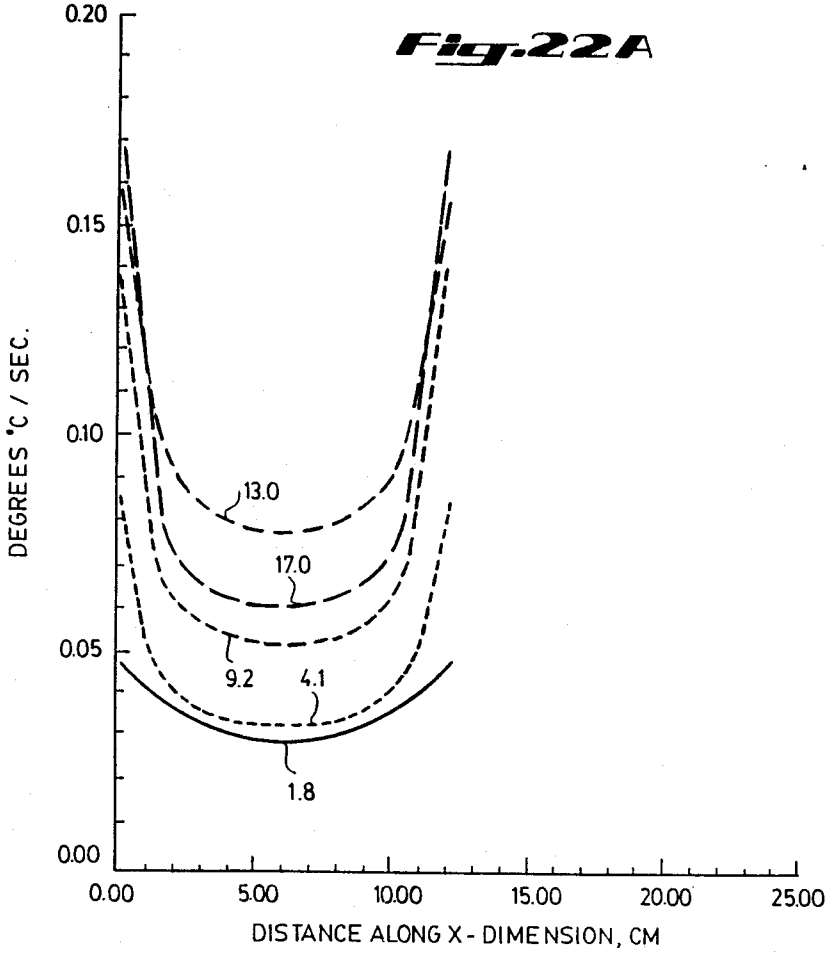

FIG. 22A shows the results of a mathematical model predicting heating rate for five different substances having different dielectric loss factors E″. The following substances were used:

TABLE IV

| | E″ | E′ |
|---|---|---|
| Mashed potatoes | 17 | 60.6 |
| Agar | 13 | 75 |
| Fudge sauce | 9.2 | 18.0 |
| Peanut butter | 4.1 | 3.1 |
| Cooked brownies | 1.8 | 5.6 |

FIG. 22A is a graph representing the predicted rate of heating for these substances for a square slab having a width of about 5 inches. FIG. 22B is a similar graph where the square slabs had a width of about 10 inches. This mathematical calculation predicts that edge heating will be more of a problem for substances which have a higher dielectric loss factor.

Figure 23B:
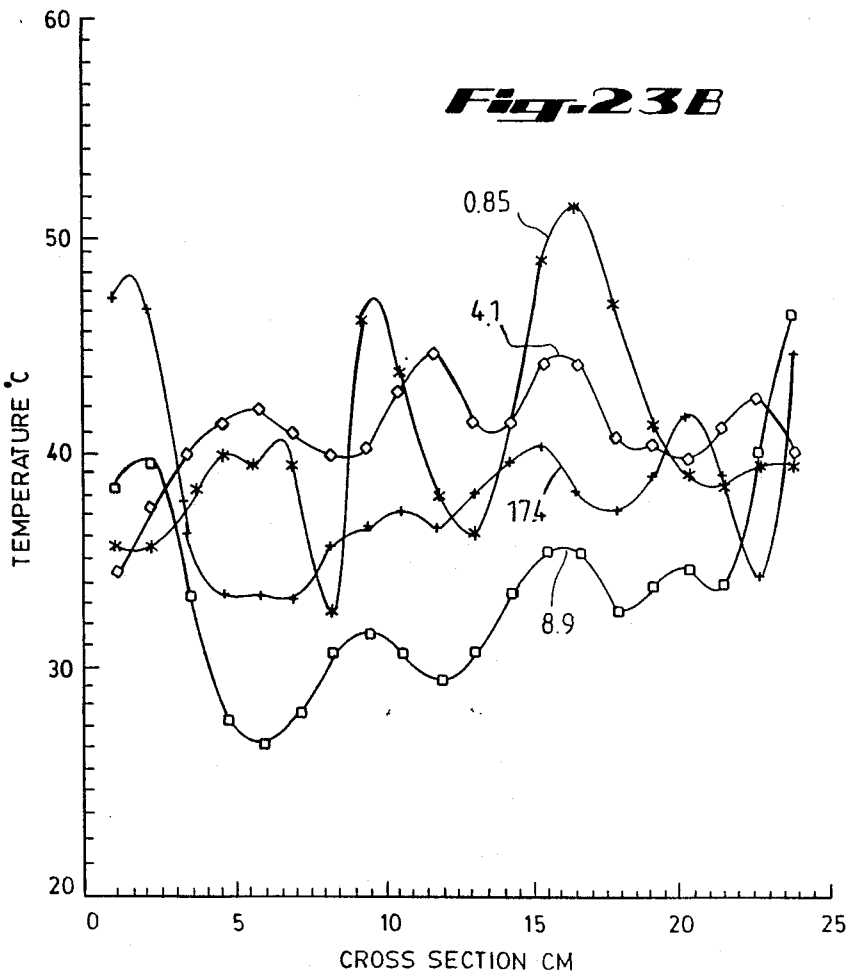
FIG. 23B is a graph similar to FIG. 23A for larger size samples.
Figure 23A:
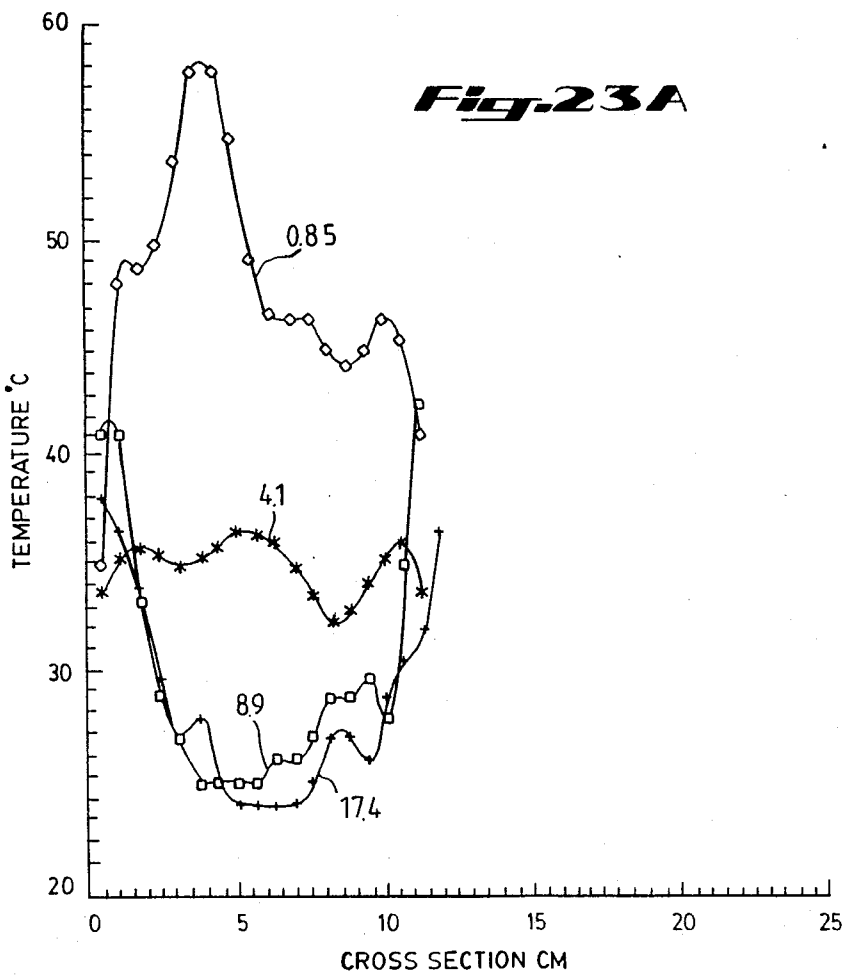
FIG. 23A is a graph showing temperature profiles measured for various samples of material having different dielectric loss factors.

FIG. 23A represents experimental measurements taken in a microwave oven for squares of various substances having a width of about 5 inches, or 12.7 centimeters. The curve labeled E″ equals 0.85 represents temperature measurements for a sample of black rubber after heating in a microwave oven. The heating time was 45 seconds for all samples. The curve labeled 4.1 represents measurements for a sample of peanut butter. The curve labeled 8.9 represents measurements for a sample of fudge sauce. The curve labeled 17.4 represents measurements for a sample of mashed potatoes.

The dielectric constant E′ for the black rubber sample was measured to be about 12.7.

FIG. 23 graphically represents measurements taken for a similar experiment where the samples which were heated were 10 inch squares, or 25.4 centimeter squares.

FIG. 23A and FIG. 23B show that the heating effects due to hot spots in the microwave oven tended to predominate for a dielectric loss factor E″ less than or equal to about 4. For dielectric loss factors greater than about 4, edge heating effects tended to predominate the heating of the samples. For this reason, conductive side walls are preferred for the microwave heating of food products having a dielectric loss factor E″ which is greater than 4, if uniformity of heating is desired.

Alternative Embodiments

Figure 2:
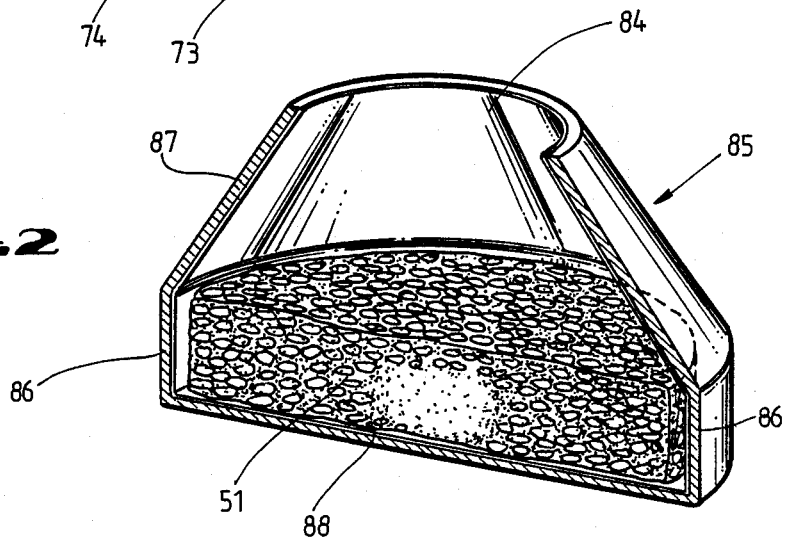
FIG. 2 is a cross-sectional perspective view of another embodiment of the present invention.

FIG. 2 illustrates an alternative embodiment of the invention that may be utilized when the food product 51 is larger than the maximum size which is desirable for a single opening 71. In this example, an opening 84 is provided in a microwave package 85. The package 85 includes conductive side walls 86 which are integrally joined with a generally cone-shaped guide 87. The cone-shaped guide 87 is composed of conductive material, and provides a transition from the opening 84 to the food product 51. The purpose of the cone-shaped guide 87 is to inhibit mode conversion to higher order waveguide modes which would then impinge upon the surface of the food product 51. If the opening 84 is made too large, the field inside the opening 84 will become sufficiently complex to result in a nonuniform temperature heating profile in the food product 51. However, if the opening 84 has a diameter less than $D_{max}$, a simpler mode field is believed to exist within the opening 84. The gradual transition provided by the cone-shaped guide 87 allows this simpler mode microwave field to propagate to the larger surface of the food product 51 without mode conversion (i.e., making a transition to more complex electromagnetic fields).

In the illustrated example, the bottom 88 of the package 85 is a conductive sheet. Alternatively, the bottom 88 could include a grid having tuned apertures therein, or a single tuned opening in a conductive sheet. Alternatively, the bottom 88 could be replaced by a similar opening 84 and cone-shaped guide to thereby provide openings 84 both above and below the food product 51. The plane of the opening 84 should be substantially parallel with the plane formed by the top surface of the food product 51. The wall 87 should provide a smooth transition from the opening 84 to the side walls 86. For example, the side wall 87 should not make an abrupt transition in shape when going from a plane transverse to the direction of propagation of the electromagnetic energy from the opening 84 to the food product 51 to the next succeeding transverse plane. The composite structure may be viewed as a circular waveguide, and the objective of the smooth transition provided by the walls 87 is to avoid propagation of microwave energy in higher order modes of field distribution.

FIG. 34A illustrates another alternative embodiment of the invention. A food product 148 is provided with a conductive sheet 150 having a single iris or opening 149 therein on both the top and bottom of the food product 148.

Yet another alternative embodiment of the invention is shown in FIG. 34B, where a food product 148 is provided with a single conductive sheet 150 having an opening 149 therein. In this example, the conductive sheet 150 and opening 149 are provided on top of the food product 148. Alternatively, the conductive sheet 150 and opening 149 could be provided on the bottom of the food product 148.

FIG. 34C shows yet another alternative embodiment of the present invention having a food product 148 enclosed within a conductive sheet 150 having a single opening 149 therein. A reflective surface 151 is provided on the bottom of the apparatus.

FIG. 34D illustrates an alternative embodiment having a single opening 149 provided in the bottom of a conductive sheet 150. Conductive side walls 152 are provided in this example.

FIG. 34E illustrates a grid 153 which has been found to yield particularly good results in combination with Pillsbury Microwave Brownie mix. The openings 154 in the grid all have a diameter of about 1 inch. A margin width "W" between openings 154 of about $\frac{1}{8}$ inch is provided. A border "B" of about 2 inches is provided. In this example, the border "B" includes portions of the conductive sheet 153 which are folded over to form side walls for the package. A spacing of about $1\frac{7}{8}$ inches off of the oven floor is provided by folding over the sides of the conductive sheet 153 shown in FIG. 34E. A pan of brownie mix is then placed under this apparatus and the entire system is exposed to microwave radiation.

Figure 35A:
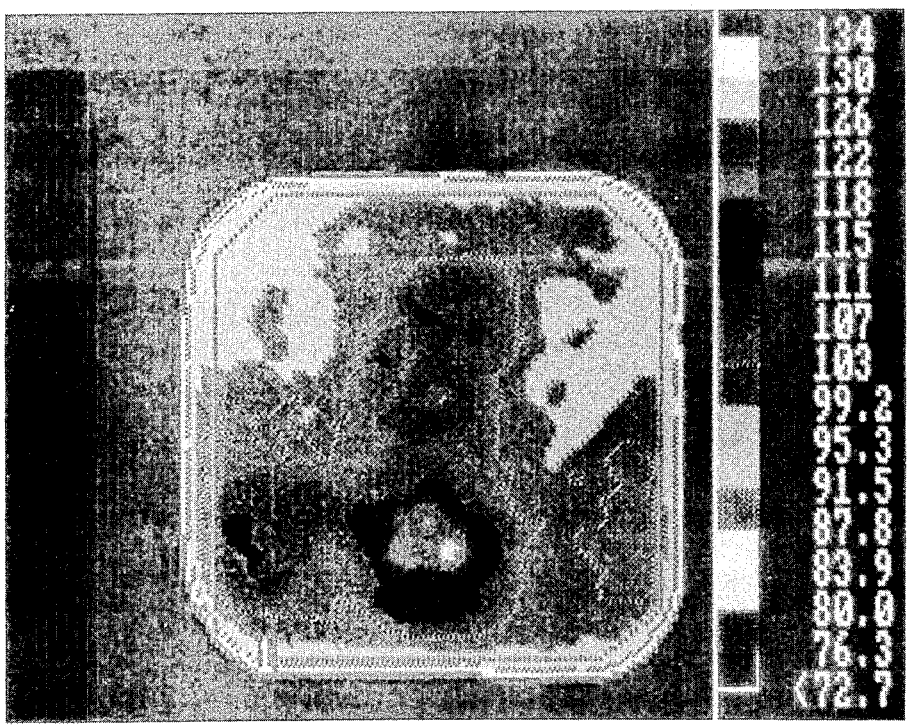
FIG. 35A is a black and white copy of a color image taken with an infrared camera showing the heating of brownies in a microwave oven without using the present invention.

FIG. 35A is a black and white copy of a color image formed by an infrared camera showing the heating of brownies which were cooked without using the present invention. A hot spot in the lower center portion of the brownies is apparent. FIG. 35C represents a graph showing temperature isotherms taken from the image shown in FIG. 35A. FIG. 35C clearly shows the nonuniform heating which was experienced. Each contour level represents a difference of about 4° C.

Figure 35B:
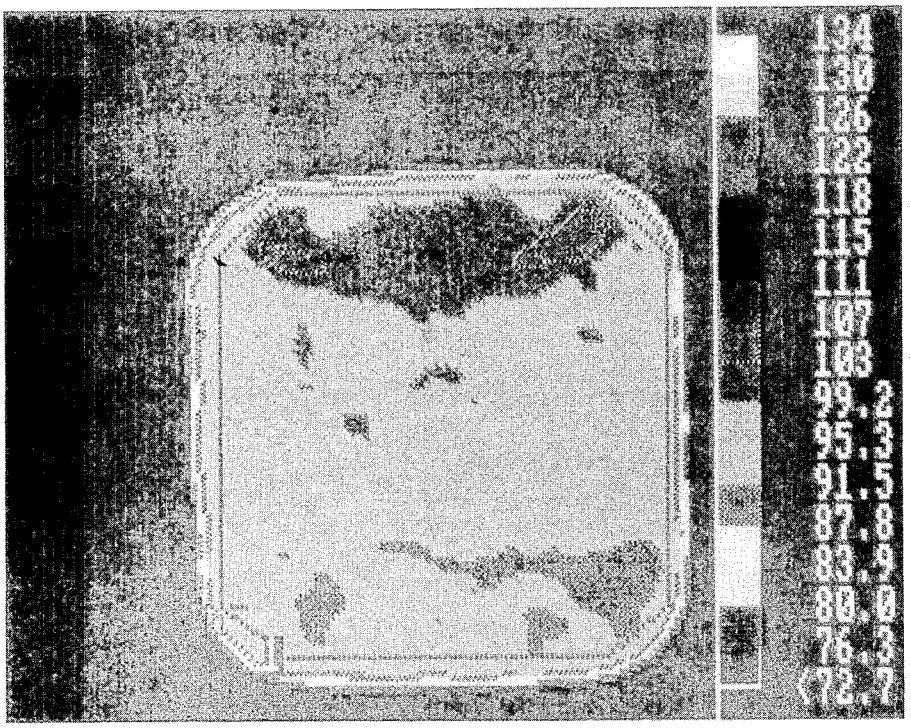
FIG. 35B is a black and white copy of a color image taken with an infrared camera showing the heating of brownies in a microwave oven using a grid in accordance with the present invention.
Figure 35C:
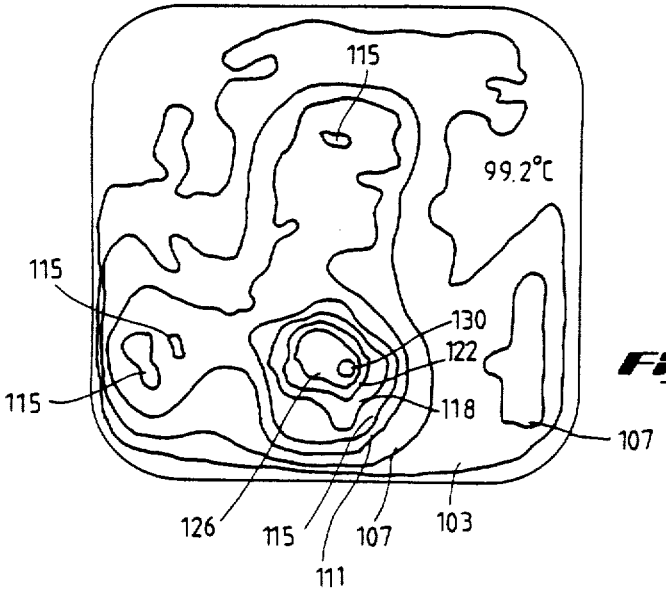
FIG. 35C is a contour plot showing isotherms which graphically illustrate the temperatures shown in the infrared image of FIG. 35A.
Figure 35D:
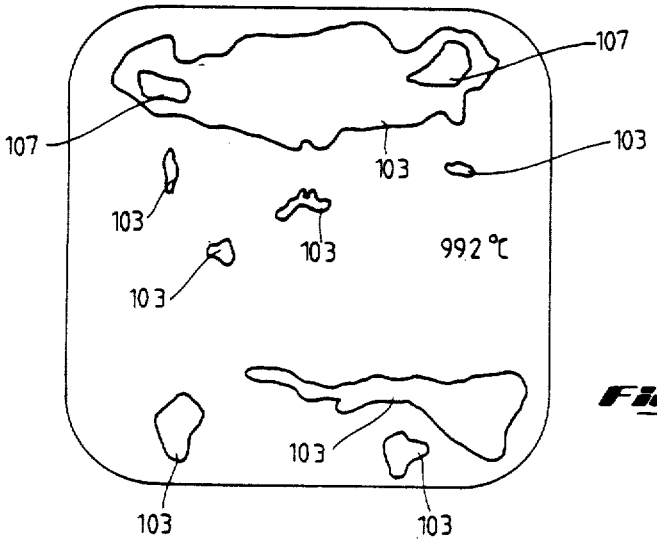
FIG. 35D is a graph showing isotherms which graphically illustrate the temperatures measured in the infrared image of FIG. 35B.

FIG. 35B is a black and white copy of a color image produced by the same infrared camera showing the heating effect upon brownies cooked using the embodiment of the present invention shown in FIG. 34E. Much more uniform heating was measured in the example shown in FIG. 35B. FIG. 35D shows a graph representing temperature isobars taken from the infrared image depicted in FIG. 35B. The uniformity of heating is clearly apparent from FIG. 35D. Thus, the present invention produced significantly more uniform heating under identical heating conditions than was the case with brownies cooked without using a grid.

Figure 36:
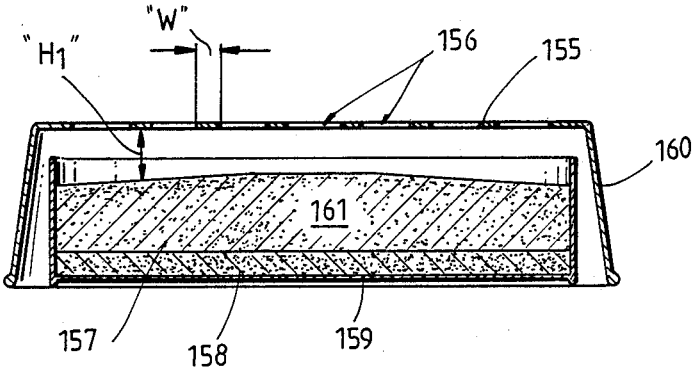
FIG. 36 is an illustration of yet another alternative embodiment of the invention for use in connection with a layered food product.

FIG. 36 illustrates an alternative embodiment of the invention having a food product 161 which comprises a first layer of food substance 157 and a second layer of food substance 158. The first layer of food 157 in this example is Pillsbury Microwave Double Lemon Supreme cake mix. The second layer 158 is a lemon filling which provides the cake topping when the cake 161 is inverted and removed from its cooking pan 159. The cooking pan 159 is a plastic pan which is essentially transparent to microwave radiation.

In accordance with the present invention, an apparatus comprising a grid 155 and conductive side walls 160 are provided for microwave heating of the food product 161. The apparatus in this example is made from a Wrinkle Wall aluminum foil pie tin which was inverted over the cake 161 as shown in FIG. 36. The grid 155 was formed by cutting circular openings 156 in the bottom of the pan. The openings 156 have a diameter of about 1 inch, and a margin spacing "W" between holes of about 0.6 inch. The grid 155 was initially spaced a height "$H_1$" above the top surface of the food product 167 of about 1.25 inches. Of course, during microwave heating, the cake mix 157 would rise. This would have the effect of reducing the spacing "$H_1$" between the top surface of the first layer 157 and the grid 155.

In this example, the microwave cook time was increased from about 7 minutes to about 9 minutes using the apparatus in accordance with the present invention. However, an improved food product 161 resulted which had improved symmetry in the shape of the food product 161 after cooking (i.e., the cake 161 rose more evenly), an increased volume in the final cooked cake 161 was observed (i.e., the cake rose more), and the apparatus eliminated a raw spot which otherwise resulted in the center of the filling 158.

The first layer 157 initially has a high moisture content. The frosting layer 158 initially has a lower moisture content, but a higher viscosity. The dielectric loss factor E″ for the first layer 157 is initially higher than the dielectric loss factor E″ for the frosting layer 158. The dielectric loss factor E″ for the first layer 157 changes during microwave heating, and eventually becomes lower than the dielectric loss factor E″ of the frosting layer 158. This example demonstrated the utility of the present invention for use in conjunction with food products which have multiple layers, where each layer has a different dielectric loss factor E″. The present invention is mos tuseful for food products comprising a plurality of layers, where such layers extend in lateral planes which are generally parallel to the plane of the grid, and where such layers have a predetermined thickness.

The present invention has been found particularly useful with certain types of food products. One group can be defined as those that have an irreversible change due to heating of the food product. An example of this would be cake batter or meat. Another group of products includes those that go through a phase transition, for example, from a frozen condition to a thawed condition. This results in a positive slope between E″ (the effective dielectric loss factor) and temperature, i.e., there is a large change in the dielectrics due to heating. An example of this would be brownies where localized heating can evaporate the water, increasing the sugar concentration and forming a hard spot. Another group includes products that expand during heating and have a structure set from the heat. Examples of these can be cake batters, muffin batters, doughs, etc. Another group includes products that have a structure set during cooking. An example of such products would be ground meat and brownie batter. Another group includes foods which can easily lose water during heating. Porous products are particularly subject to such water loss which can change the dielectrics and cause significant textural problems.

As discussed above, the present invention is particularly useful for those products which exhibit a large change in dielectrics due to heating. This can result from a phase transition or a loss of moisture. Such products are those which have a change from heating in the E″ value of greater than about two times, preferably greater than about four times, and most preferably greater than about eight times.

Figure 37:
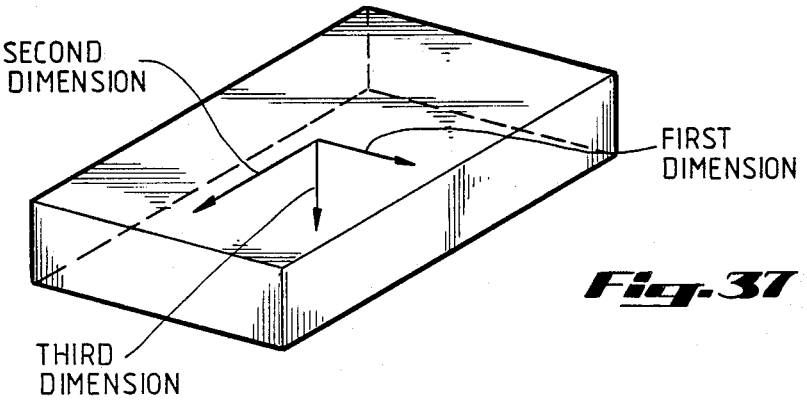
FIG. 37 is a perspective view schematically illustrating a three-dimensional food product.

The products used with the present invention can be characterized as three-dimensional products. As seen in FIG. 37, the three-dimensional food can be defined as having three orthogonal dimensions in a rectangular coordinate system. The major two (first and second) of these dimensions of the food product (i.e., length and width) are larger than the third dimension (i.e., thickness). The two major dimensions generally define the plane of the food surface adjacent to the grid and facing the grid. This may be referred to as a "major surface" of the food product. The third dimension is generally normal to the grid. The food surface parallel to the third dimension may be referred to as a "minor surface" of the food product. It is preferred that the two major dimensions (length and width) are at least two times, preferably three times, and more preferably four times the third minor dimension (thickness).

The invention is also particularly useful with foods of larger sizes. It is to be understood that a plurality of discrete food pieces can be positioned close together wherein the microwave oven essentially views the discrete food products as one food product. The given dimensions can be applied to the composite of the discrete products. An example of this would be the heating of a plurality of fish sticks. The preferred minimum food size should be where a major dimension (length/width) is about 2 inches and the minor dimension (thickness) is about ¼ inch.

The grid is preferably substantially uniformly spaced from the opposing major surface of the food. It is also preferred to have a major portion of the food product immediately under and in corresponding relation to the transmissive areas and conductive sheets surrounding the transmissive areas. Preferably, the major surface of the food should not protrude beyond an operative area of the grid defined by the area of the grid having openings therein by an amount more than the width of the margins "W" between the openings.

As used herein, the term "temperature profile" is used to refer to the range of temperatures along a lateral cross-section of the food product, taken along a surface of the food product which is facing the grid or tuned aperture.

The term "tuned aperture" or "tuned opening" is used herein to refer to a microwave transmissive area surrounded by a conductive surface whose dimensions, geometry, spacing from the food product, and other parameters which are described above as affecting the performance of the present invention are selected to allow the total system, including the food product, to operate within the region defined by the present invention. In the operation of the present invention, the combination of several factors are important in order to achieve desired predetermined temperature profiles, and in a preferred application of the present invention, temperature uniformity during microwave heating. Thus, it is the combination of all factors as defined herein which contribute to the construction of a "tuned aperture" or "tuned opening."

The extent of conductive surface around the edges of the grid that is in the plane of the grid preferably should not overlap the major surface of the food by a distance greater than the center to center distance between openings in the grid.

It has been found that the present invention can be practiced with the use of a single i.e., only one, grid which can be positioned either less than about 0.25 or greater than about 0.25 inch from the food product as above described.

SUMMARY OF THE ADVANTAGES OF THE INVENTION

A microwave food package constructed in accordance with the present invention provides a means for adjusting the temperature profile of food products during microwave heating. Using a conductive sheet with one or more tuned apertures therein, the uniformity of the temperature profile may be adjusted. The present invention may be utilized to eliminate overcooked and undercooked areas in a food product.

The present invention may also be used to widen the "window" of time during which a food product is properly cooked in a microwave oven. In other words, the present invention may be used to lessen the criticality of cooking time, so that the same food product may be cooked in a number of different models of microwave ovens with satisfactory results.

The present invention minimizes the problem of "thermal runaway", and enables food products to be heated by microwave radiation which significantly change their dielectric properties during microwave heating. For example, frozen meat may have dielectric properties which change dramatically as the meat thaws. The heating of such food products is sensitive to changes in dielectric properties of the food during heating. The present invention provides for uniform heating of the food product in spite of the significant changes in dielectric properties which occur during heating and thawing.

The present invention may be used in combination with conventional cooking mechanisms, such as infrared heating, to rapidly produce pleasant tasting foods. The present invention can be used in connection with a preheating step to establish a predetermined temperature profile in a food product prior to final heating by conventional means. This feature is particularly advantageous when attempting to heat large frozen meat products using conventional pre-existing heating apparatus which has been optimized for a significantly smaller size meat product. This has particularly advantageous application in commercial fast food establishments, because it permits the establishment to offer a variety of hamburger sizes for consumers.

Using the present invention, the penetration of microwave heating can be adjusted both axially and radially in a food product to establish a desired temperature profile in the food product prior to conventional heating by infrared energy. The result is a much more rapidly cooked food product, which may take difficult to prepare foods such as meat from a frozen condition to a fully cooked condition in a time period of about 3–4 minutes. This can be done with frozen hamburger patties which are about 4.75 inches in diameter and about 0.75 inch thick.

The above disclosure has been directed to a preferred embodiment of the present invention. The invention may be embodied in a number of alternative embodiments other than those illustrated and described above. A person skilled in the art will be able to conceive of a number of modifications to the above described embodiments after having the benefit of the above disclosure and having the benefit of the teachings herein. The full scope of the invention shall be determined by a proper interpretation of the claims, and shall not be unnecessarily limited to the specific embodiments described above.

What is claimed is:

1. An apparatus for adjusting the temperature profile of a food product to be heated by microwave radiation having a frequency of 2.45 GHz comprising:

a food product to be heated by microwave radiation;

a conductive grid, the grid comprising a conductive surface surrounding a plurality of tuned openings, the grid having a plurality of tuned openings of a size between 0.75 inch and 1.75 inches, the openings being spaced apart a distance between 0.6 inch and 1.8 inches, the grid being spaced a distance from a first opposing surface of the food product between 0.25 inch and 2.4 inches;

a conductive ring, the conductive ring being in close proximity to a second surface of the food product; and, the grid and ring being mutually cooperable to provide a predetermined temperature profile representative of heating of the food product when the food product is exposed to microwave radiation.

2. An apparatus for adjusting the temperature profile of a food product to be heated by microwave radiation, comprising:

a food product to be heated by microwave radiation having a dielectric constant E';

a conductive sheet having a tuned opening located in close proximity to an opposing surface of the food product, the opening having a minimum size $D_{min}$ of:

$$D_{min} = \frac{D}{2}\left(\frac{1}{E'} + 1\right)\frac{2.45}{F}$$

where $D_{min}$ is the minimum size of the opening expressed in inches, D is equal to 0.75 inch, E' is the dielectric constant of the food product, and F is the frequency of the microwave radiation expressed in gigahertz;

the opening having a maximum size $D_{max}$ of:

$$D_{max} = \frac{D}{2}\left(\frac{1}{E'} + 1\right)\frac{2.45}{F}$$

where $D_{max}$ is the maximum size of the opening expressed in inches, D is equal to 1.75 inches, E' is the dielectric constant of the food product, and F is the frequency of the microwave radiation expressed in gigahertz;

the conductive sheet surrounding the opening defining a conductive border having a minimum width of 0.25 inch; and, the conductive sheet and tuned opening being mutually cooperative to provide a predetermined temperature profile for the food product during microwave heating.

3. An apparatus for adjusting the temperature profile of a food product to be heated by microwave radiation at a frequency of 2.45 GHz comprising:

a food product to be heated by microwave radiation;

a conductive grid, the grid comprising a conductive surface surrounding a plurality of tuned openings, the grid having a plurality of tuned openings of a size between 0.75 inch and 1.75 inches, the openings being spaced apart a distance between 0.6 inch and 1.8 inches, the grid being spaced a distance from a first opposing surface of the food product between 0.25 inch and 2.4 inches; and, the grid being operable to provide a predetermined temperature profile representative of heating of the food product when the food product is exposed to microwave radiation.

4. The apparatus according to claim 3, wherein:
the size of the openings in the grid are between 1 inch and 1.5 inches.

5. The apparatus according to claim 4, wherein:
the grid is spaced a distance from the food product between 0.6 inch to 1.8 inches.

6. The apparatus according to claim 5, further comprising:
a conductive side wall encircling a second surface of the food product, the conductive side wall being in close proximity to the second surface of the food product.

7. The apparatus according to claim 5, wherein:
the grid has a conductive border width greater than or equal to 0.5 inch.

8. The apparatus according to claim 4, wherein:
the grid is spaced a distance from the food product between 0.9 inch and 1.5 inches.

9. The apparatus according to claim 8, wherein:
the openings are spaced apart a distance between 0.125 inch and 2.4 inches.

10. The apparatus according to claim 9, further comprising:
a conductive side wall encircling a second surface of the food product, the conductive side wall being in close proximity to the second surface of the food product.

11. The apparatus according to claim 8, wherein:
the food product has a dielectric loss factor E″, measured prior to microwave heating, which is less than 0.8.

12. The apparatus according to claim 8, wherein:
the food product has a dielectric loss factor E″, measured prior to microwave heating, which is less than 0.2.

13. The apparatus according to claim 8, further comprising:
a conductive side wall encircling a second surface of the food product, the conductive side wall being in close proximity to the second surface of the food product.

14. The apparatus according to claim 8, wherein:
the grid has a conductive border width greater than or equal to 0.5 inch.

15. The apparatus according to claim 4, wherein:
the grid is spaced a distance from the food product of 1.2 inches.

16. The apparatus according to claim 15, wherein:
the openings are spaced apart a distance between 0.125 inch and 2.4 inches.

17. The apparatus according to claim 4, further comprising:
a conductive side wall encircling a second surface of the food product, the conductive side wall being in close proximity to the second surface of the food product.

18. The apparatus according to claim 4, wherein:
the grid has a conductive border width greater than or equal to 0.5 inch.

19. The apparatus according to claim 3, wherein:
the openings in the grid have a size of 1.25 inches, the size of the openings being substantially uniform.

20. The apparatus according to claim 3, wherein:
the grid has a region where the openings in said region have a size of 1.25 inches.

21. The apparatus according to claim 20, wherein:
the grid is spaced a distance from the food product of 1.2 inches.

22. The apparatus according to claim 21, further comprising:
a conductive side wall encircling a second surface of the food product, the conductive side wall being in close proximity to the second surface of the food product.

23. The apparatus according to claim 22, wherein:
the food product has a dielectric loss factor E″ greater than 4.

24. The apparatus according to claim 3, wherein:
the grid is spaced a distance from the food product between 0.6 inch to 1.8 inches.

25. The apparatus according to claim 24, further comprising:
a conductive side wall encircling a second surface of the food product, the conductive side wall being in close proximity to the second surface of the food product.

26. The apparatus according to claim 25, wherein:
the food product has a dielectric loss factor E″ greater than 4.

27. The apparatus according to claim 3, wherein:
the grid is spaced a distance from the food product between 0.9 inch and 1.5 inches.

28. The apparatus according to claim 27, wherein:
the openings are spaced apart a distance between 0.125 inch and 2.4 inches.

29. The apparatus according to claim 28, further comprising:
a conductive side wall encircling a second surface of the food product, the conductive side wall being in close proximity to the second surface of the food product.

30. The apparatus according to claim 29, wherein:
the food product has a dielectric loss factor E″ greater than 4.

31. The apparatus according to claim 27, wherein:
the food product has a dielectric loss factor E″, measured prior to microwave heating, which is less than 0.8.

32. The apparatus according to claim 27, wherein:
the food product has a dielectric loss factor E″, measured prior to microwave heating, which is less than 0.2.

33. The apparatus according to claim 27, further comprising:
a conductive side wall encircling a second surface of the food product, the conductive side wall being in close proximity to the second surface of the food product.

34. The apparatus according to claim 33, wherein:
the food product has a dielectric loss factor E″ greater than 4.

35. The apparatus according to claim 3, wherein:
the grid is spaced a distance from the food product of 1.2 inches.

36. The apparatus according to claim 35, wherein:
the openings are spaced apart a distance between 0.125 inch and 2.4 inches.

37. The apparatus according to claim 3, wherein:
the grid is generally parallel to the first opposing surface of the food product, the grid covering an area which is at least coextensive with said opposing surface of the food product.

38. The apparatus according to claim 3, wherein:

the grid has a conductive border width greater than or equal to 0.5 inch.

39. An apparatus for heating a food product in a microwave oven to provide for generally uniform heating, comprising:

a package including a food product for microwave heating, the package including a grid, the grid having an impedance at the microwave frequency to be used for microwave heating, the grid being spaced a distance from the position occupied by the food product, such that a combination of impedance of the grid and spacing between the grid and the food product is selected to fall within the region defined as region "C" of FIG. 38.

40. An apparatus for adjusting the temperature profile of a food product to be heated by microwave radiation at a frequency of 2.45 GHz, comprising:

a food product to be heated by microwave radiation;

a first means for adjusting the temperature profile of the food product comprising a dimensionally stable electrically continuous conductive surface which surrounds a plurality of transmissive areas, the conductive surface being formed from a material having a bulk resistivity less than 100 microohms per centimeter, the conductive surface being substantially parallel to an opposing surface of the food product, the transmissive areas having a size between 0.75 inch to 1.75 inches, the transmissive areas being spaced apart from each other by a distance between 0.6 inch to 1.8 inches, the conductive surface being spaced from the opposing surface of the food product by a distance between 0.25 inch to 2.4 inches.

41. The apparatus according to claim 40, wherein: the conductive surface is planar.

42. The apparatus according to claim 41, wherein: the transmissive areas are essentially microwave transparent.

43. The apparatus according to claim 42, wherein: the transmissive areas comprise circular openings in the conductive surface.

44. The apparatus according to claim 43, wherein: the circular openings are arranged in a staggered lattice configuration.

45. The apparatus according to claim 43, wherein: the circular openings are arranged in a square lattice configuration.

46. The apparatus according to claim 43, wherein: the circular openings are arranged in a circular array.

47. The apparatus according to claim 40, further comprising:

a dielectric material on one side of the conductive surface and in close proximity to the conductive surface, the dielectric material having a dielectric constant E', the transmissive areas having a size in inches between $$\frac{0.75}{2}\left(\frac{1}{E'}+1\right)\frac{2.45}{F}$$

and $$\frac{1.75}{2}\left(\frac{1}{E'}+1\right)\frac{2.45}{F}$$

where F is the frequency of microwave radiation that is to be used to heat the food product.

48. An apparatus for heating meat, comprising:

a meat patty initially in a frozen condition, to be heated to an edible temperature in a short period of time;

means for preheating the meat patty using microwave radiation to establish a predetermined temperature profile in the meat patty, such means including a generally cylindrical dielectric bowl adapted to receive the meat patty, a circular conductive ring which encircles the sides of the meat patty, the conductive ring having a conductive bottom, the conductive bottom having an opening therein which is substantially transparent to microwave radiation, the conductive ring being supported by the bowl; and, infrared means for heating the meat patty using infrared heat after microwave preheating.

49. The apparatus according to claim 48, wherein: the meat patty has a diameter of 4.6 inches; and, the opening in the conductive bottom is circular and has a diameter of 3 inches.

50. The apparatus according to claim 49, wherein: the conductive ring has a height of $1\frac{3}{8}$ inches.

51. The apparatus according to claim 50, further comprising:

a planar conductive top sheet placed over the top of the dielectric bowl and spaced from the conductive ring thereby defining an essentially microwave transparent gap between the conductive top sheet and the conductive ring.

52. The apparatus according to claim 51, wherein: the conductive top sheet is substantially parallel to the meat patty and spaced from the meat patty by a distance of 1 inch.

53. The apparatus according to claim 52, wherein: the meat patty has a thickness of $\frac{3}{4}$ inch.

54. The apparatus according to claim 52, wherein: the conductive bottom has a diameter of $5\frac{1}{4}$ inches.

55. The apparatus according to claim 54, wherein: the conductive top sheet has an opening therein having a diameter of $3\frac{1}{8}$ inches, the opening in the conductive top sheet being generally aligned concentrically with the opening in the conductive bottom.

* * * * *

UNITED STATES PATENT AND TRADEMARK OFFICE

CERTIFICATE OF CORRECTION

PATENT NO. : 4,972,059

DATED : November 20, 1990

INVENTOR(S) : Dan J. Wendt et al

It is certified that error appears in the above-identified patent and that said Letters Patent is hereby corrected as shown below:

On the title page, "26 Drawing Sheets" should be -- 31 Drawing Sheets --.

In the Drawings, Figures 35C and 35D were left out and are attached hereto.

Column 2, line 12, after "absorb" insert -- a --.

Column 4, line 38, after "graph" insert -- (effect of grid in changing temperature profile) --.

Column 4, line 42, after "graph" insert -- (effect of grid in changing temperature profile) --.

Column 4, line 45, after "graph" insert -- (iris package for controlling burger temperature profile-- temperature profile change with iris diameter [iris diameter in inches]) --.

Column 4, line 54, after "graph" insert -- (iris package for controlling burger temperature profile-- temperature profile change with iris spacing [iris height in inches]) --.

Column 4, line 57, after "graph" insert -- (single iris package for burger thawing--spacing iris above burger with foil reflector below burger [iris height in inches]) --.

UNITED STATES PATENT AND TRADEMARK OFFICE

CERTIFICATE OF CORRECTION

PATENT NO. : 4,972,059

DATED : November 20, 1990

INVENTOR(S) : Dan J. Wendt et al

It is certified that error appears in the above-identified patent and that said Letters Patent is hereby corrected as shown below:

Column 5, line 1, after "graph" insert -- (effect of grid in changing temperature profile--temperature profile change with grid hole diameter) --.

Column 5, line 4, after "graph" insert -- (effect of hole diameter grid on food [dielectric of slab E' = 12.8, E" = 0.85]) --.

Column 5, line 7, after "graph" insert -- (effect of hole diameter grid on food [dielectric of slab E' = 12.8, E" = 0.85]) --.

Column 5, line 10, after "plot" insert -- (effect of hole diameter on brownie performance [temperature variability (one sigma C)]) --.

Column 5, line 13, after "plot" insert -- (effect of hole diameter on brownie performance [temperature variability (one sigma C)]) --.

Column 5, line 15, after "plot" insert -- (effect of hole diameter on brownie performance [average temperature degrees C]) --.

Column 5, line 18, after "plot" insert -- (effect of hole diameter on brownie performance [average temperature degrees C]) --.

UNITED STATES PATENT AND TRADEMARK OFFICE

CERTIFICATE OF CORRECTION

PATENT NO. : 4,972,059

DATED : November 20, 1990

INVENTOR(S) : Dan J. Wendt et al

It is certified that error appears in the above-identified patent and that said Letters Patent is hereby corrected as shown below:

Column 5, line 20, after "graph" insert -- (iris package for controlling burger temperature profile--profile change with iris spacing from one side only [iris height in inches]) --.

Column 5, line 24, after "graph" insert -- (single iris package for burger thawing, spacing reflector below burger, with iris on burger [reflector height in inches]) --.

Column 5, line 36, after "plot" insert -- (effect of hole spacing on brownie performance [temperature variation (one sigma C)]) --.

Column 5, line 39, after "plot" insert -- (effect of hole spacing on brownie performance [temperature variation (one sigma C)]) --.

Column 5, line 41, after "plot" insert -- (effect of hole spacing on brownie performance [average temperature °C]) --.

Column 5, line 44, after "plot" insert -- (effect of hole spacing on brownie performance [average temperature degrees C]) --.

Column 5, line 46, after "graph" insert -- (effect of grid on brownie temperature--Chen model absorption prediction) --.

UNITED STATES PATENT AND TRADEMARK OFFICE

CERTIFICATE OF CORRECTION

PATENT NO. : 4,972,059

DATED : November 20, 1990

INVENTOR(S) : Dan J. Wendt et al

It is certified that error appears in the above-identified patent and that said Letters Patent is hereby corrected as shown below:

Column 5, line 51, after "graph" insert -- (effect of grid on brownie temperature--experiment 186) --.

Column 5, line 58, after "graph" insert -- (predicted susceptance with grid design [0.1" margins between holes]) --.

Column 5, line 62, after "graph" insert -- (predicted susceptance with grid design [0.5" margins between holes]) --.

Column 5, line 64, after "graph" insert -- (grid effectiveness in compact ovens--comparison with and without grid) --.

Column 6, line 1, after "graph" insert -- (brownie baking tolerance--grid's effect on brownie hardness) --.

Column 6, line 5, after "plot" insert -- (computer modeled heating profile in food systems [E' = 5.6, E" = 1.8, Z = 1]) --.

Column 6, line 8, after "plot" insert -- (computer modeled heating profile in food systems [E' = 3.1, E" = 4.1, Z = 1]) --.

Column 6, line 10, after "plot" insert -- (computer modeled heating profile in food systems [E' = 18.0, E" = 9.2, Z = 1]) --.

UNITED STATES PATENT AND TRADEMARK OFFICE

CERTIFICATE OF CORRECTION

PATENT NO. : 4,972,059

DATED : November 20, 1990

INVENTOR(S) : Dan J. Wendt et al

It is certified that error appears in the above-identified patent and that said Letters Patent is hereby corrected as shown below:

Column 6, line 13, "22B" should be -- 22A --; after "graph" insert -- (computer modeled heating profile--through product center) --.

Column 6, line 16, after "graph" insert -- (computer modeled heating profile--through product center) --.

Column 6, line 18, after "graph" insert -- (edge heating versus dielectric loss factor--temperature profiles of 12.7 cm square layers) --.

Column 6, line 21, after "graph" insert -- (edge heating versus dielectric loss factor--temperature profiles of 25.4 cm square layers) --.

Column 6, line 23, after "graph" insert -- (effect of grid margins on uniformity) --.

Column 6, line 25, after "graph" insert -- (effect of margins on grid temperature) --.

Column 6, line 31, after "graph" insert -- (effect of grid in changing temperature profile--contoured hole sizes versus constant size holes) --.

Column 6, line 38, "is" should be -- in --.

Column 6, line 55, after "graph" insert -- (slot margin interactions; effect of margin width) --.

UNITED STATES PATENT AND TRADEMARK OFFICE

CERTIFICATE OF CORRECTION

PATENT NO. : 4,972,059

DATED : November 20, 1990

INVENTOR(S) : Dan J. Wendt et al

It is certified that error appears in the above-identified patent and that said Letters Patent is hereby corrected as shown below:

Column 7, line 7, after "invention" insert -- (i.e., no grid) --.

Column 7, line 11, after "invention" insert -- (grid with uniform holes) --.

Column 7, line 23, after "graph" insert -- (impedance and grid height criterion--percent improvement in uniformity over control) --.

Column 7, line 27, after "graph" insert -- (effect of hole diameter--grid against dielectric versus spaced away) --.

Column 8, line 4, after "grid 53" insert -- which --.

Column 16, line 14, after "hole" insert a period.

Column 19, line 23, "H" should be -- $H_1$ --; line 24, "range" should be -- about --.

Column 24, line 30, "about" should be -- above --.

Column 35, line 4, "ring 190" should be -- ring 109 --; line 28, "Table II" should be -- Table III --.

Column 41, line 27, "mos tuseful" should be -- most useful --.

Column 42, line 60, after "single" insert a comma.

UNITED STATES PATENT AND TRADEMARK OFFICE

CERTIFICATE OF CORRECTION

PATENT NO. : 4,972,059

DATED : November 20, 1990

INVENTOR(S) : Dan J. Wendt et al

It is certified that error appears in the above-identified patent and that said Letters Patent is hereby corrected as shown below:

Column 44, after line 25 in claim 2, the equation should be as follows:

$$D_{min} = \frac{D}{2}\left(\frac{1}{\sqrt{E'}} + 1\right)\frac{2.45}{F}$$

Column 44, after line 36 in claim 2, the equation should be as follows:

$$D_{max} = \frac{D}{2}\left(\frac{1}{\sqrt{E'}} + 1\right)\frac{2.45}{F}$$

Column 48, the equation at the top should be as follows:

$$\frac{0.75}{2}\left(\frac{1}{\sqrt{E'}} + 1\right)\frac{2.45}{F}$$

UNITED STATES PATENT AND TRADEMARK OFFICE

CERTIFICATE OF CORRECTION

PATENT NO. : 4,972,059

DATED : November 20, 1990

INVENTOR(S) : Dan J. Wendt et al

It is certified that error appears in the above-identified patent and that said Letters Patent is hereby corrected as shown below:

Column 48, the second equation at the top should be as follows:

$$\frac{1.75}{2}\left(\frac{1}{\sqrt{E'}}+1\right)\frac{2.45}{F}$$

Signed and Sealed this

Twenty-fifth Day of August, 1992

*Attest:*

DOUGLAS B. COMER

*Attesting Officer*

*Acting Commissioner of Patents and Trademarks*